US010822188B2

(12) United States Patent
Kodama et al.

(10) Patent No.: US 10,822,188 B2
(45) Date of Patent: Nov. 3, 2020

(54) CORRUGATED PAPERBOARD BOX MAKING MACHINE AND SHEET FEEDING CONTROL APPARATUS

(71) Applicant: KABUSHIKI KAISHA ISOWA, Aichi (JP)

(72) Inventors: Junichi Kodama, Kasugai (JP); Shunsuke Miyashita, Kasugai (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 218 days.

(21) Appl. No.: 15/642,594

(22) Filed: Jul. 6, 2017

(65) Prior Publication Data

US 2018/0009616 A1 Jan. 11, 2018

(30) Foreign Application Priority Data

Jul. 7, 2016 (JP) ..... 2016-154996

(51) Int. Cl.
*B65H 7/20* (2006.01)
*B65H 5/06* (2006.01)
(Continued)

(52) U.S. Cl.
CPC ..... *B65H 7/20* (2013.01); *B31B 50/006* (2017.08); *B31B 50/062* (2017.08); *B31B 50/26* (2017.08);
(Continued)

(58) Field of Classification Search
CPC .. B65H 7/20; B65H 3/063; B65H 2701/1766; B65H 2701/1762; B65H 2513/512;
(Continued)

(56) References Cited

U.S. PATENT DOCUMENTS 2,268,767 A * 1/1942 Moore ..... B31D 5/02 223/95
4,889,331 A 12/1989 Sardella
(Continued)

FOREIGN PATENT DOCUMENTS

JP 05-050329 A 3/1993
JP H11-272312 A 10/1999
(Continued)

*Primary Examiner* — Thanh K Truong
*Assistant Examiner* — Scott A Howell
(74) *Attorney, Agent, or Firm* — Brinks Gilson & Lione

(57) ABSTRACT

Disclosed is a corrugated paperboard box making machine which comprises a sheet feeding apparatus, a processing apparatus, a folder-gluer, a counter-ejector for stacking the box-structured corrugated paperboard sheets and separating them as a batch, a speed setting unit for setting a sheet feeding speed, and a control apparatus. The control apparatus is operable to execute a sheet feeding control processing of the sheet feeding apparatus such that a sheet feeding operation of feeding one corrugated paperboard sheet is successively repeated a number of times corresponding to the number of the given number of box-structured corrugated paperboard sheets in the batch, and a sheet feeding stop control processing of, when the sheet feeding speed is greater than an allowable speed, the sheet feeding apparatus such that the sheet feeding operation is stopped at least once after execution of the sheet feeding control processing.

9 Claims, 25 Drawing Sheets

(51) Int. Cl.

| | |
|---|---|
| ***B65H 3/06*** | (2006.01) |
| ***B65H 33/08*** | (2006.01) |
| ***B31B 50/06*** | (2017.01) |
| ***B31B 50/26*** | (2017.01) |
| ***B31B 50/62*** | (2017.01) |
| ***B31B 50/88*** | (2017.01) |
| ***B31B 50/98*** | (2017.01) |
| ***B31B 50/00*** | (2017.01) |
| ***B31F 1/28*** | (2006.01) |
| ***B65H 31/32*** | (2006.01) |
| ***B65H 31/10*** | (2006.01) |
| *B31B 120/70* | (2017.01) |

(52) U.S. Cl.

CPC ..... *B31B 50/62* (2017.08); *B31B 50/88* (2017.08); *B31B 50/98* (2017.08); *B31F 1/2822* (2013.01); *B65H 3/063* (2013.01); *B65H 5/062* (2013.01); *B65H 31/10* (2013.01); *B65H 31/32* (2013.01); *B65H 33/08* (2013.01); *B31B 2120/70* (2017.08); *B65H 2511/11* (2013.01); *B65H 2511/30* (2013.01); *B65H 2513/10* (2013.01); *B65H 2513/512* (2013.01); *B65H 2701/1762* (2013.01); *B65H 2701/1766* (2013.01)

(58) Field of Classification Search

CPC ..... B65H 2513/10; B65H 3/00; B65H 5/062; B65H 31/10; B65H 31/32; B65H 33/08; B65H 2120/11; B65H 2511/11; B65H 2511/30; B65H 2513/13; B65H 39/00; B31F 1/2822; B31B 50/006; B31B 50/88; B31B 50/2822; B31B 50/62; B31B 50/062; B31B 50/26; B31B 50/98; B31B 50/00; B31B 50/005; B31B 50/02; B31B 2120/70

USPC ..... 493/51, 321

See application file for complete search history.

(56) References Cited

U.S. PATENT DOCUMENTS

| | | | | |
|---|---|---|---|---|
| 4,896,872 | A * | 1/1990 | Sardella | B65H 3/063 271/102 |
| 4,928,950 | A | 5/1990 | Sardella | |
| 4,993,907 | A * | 2/1991 | Clark | B65H 31/3054 414/795.3 |
| 5,048,812 | A * | 9/1991 | Holmes | B65H 3/063 271/11 |
| 5,307,549 | A | 5/1994 | Tsutsumi et al. | |
| 5,314,566 | A * | 5/1994 | Gallagher | G07B 17/00661 156/350 |
| 5,816,994 | A * | 10/1998 | Hill | B31B 50/00 493/324 |
| 7,601,218 | B2 * | 10/2009 | Stepaniak | B05C 5/027 118/300 |
| 8,409,067 | B2 * | 4/2013 | Cooper | B65H 29/008 493/175 |
| 8,657,555 | B2 * | 2/2014 | Kokubo | B65H 31/20 271/215 |
| 8,876,681 | B2 * | 11/2014 | Taketsugu | B65G 57/03 493/141 |
| 8,911,338 | B2 * | 12/2014 | Ishizuka | B31B 50/00 493/32 |
| 9,022,913 | B2 * | 5/2015 | Graham | B65D 5/0227 493/51 |
| 9,033,599 | B2 * | 5/2015 | Kodama | B41F 17/24 400/76 |
| 9,033,646 | B2 * | 5/2015 | Kokubo | B65H 31/3054 414/796.1 |
| 9,120,285 | B2 * | 9/2015 | Kodama | B65H 5/062 |
| 9,162,834 | B1 * | 10/2015 | Lee | B65H 3/063 |
| 9,187,273 | B2 * | 11/2015 | Kodama | B65H 3/68 |
| 9,701,498 | B2 * | 7/2017 | Kodama | B65H 3/063 |
| 9,840,385 | B2 * | 12/2017 | Kodama | B65H 3/126 |
| 9,914,598 | B2 * | 3/2018 | Iori | B65G 57/09 |
| 2006/0217831 | A1 * | 9/2006 | Butterworth | B65H 26/00 700/126 |
| 2011/0268551 | A1 | 11/2011 | Kokubo et al. | |
| 2013/0184133 | A1 * | 7/2013 | Sugimoto | B65H 43/04 493/29 |
| 2013/0184134 | A1 * | 7/2013 | Suzuki | B41F 33/0036 493/53 |
| 2014/0162862 | A1 * | 6/2014 | Shimura | B31B 50/00 493/56 |
| 2016/0200532 | A1 * | 7/2016 | Kodama | B65H 3/063 271/10.12 |
| 2017/0057766 | A1 * | 3/2017 | Kodama | B65H 3/126 |
| 2018/0009616 | A1 * | 1/2018 | Kodama | B65H 7/20 |
| 2018/0015682 | A1 * | 1/2018 | Iori | B65H 29/38 |
| 2018/0127225 | A1 * | 5/2018 | Kodama | B65H 31/20 |

FOREIGN PATENT DOCUMENTS

| | | | |
|---|---|---|---|
| JP | 2000-006362 | A | 1/2000 |
| JP | 2006-072399 | A | 3/2006 |
| JP | 2011-230432 | A | 11/2011 |

* cited by examiner

REAR
LEFT
RIGHT
FRONT
A
A
140

CORRUGATED PAPERBOARD BOX MAKING MACHINE AND SHEET FEEDING CONTROL APPARATUS

RELATED APPLICATIONS

This application claims priority under 35 U.S.C. § 119 to Japanese Patent Application No. 2016-154996 filed on Jul. 7, 2016, the entire content of which is hereby incorporated by reference.

BACKGROUND OF THE INVENTION

1. Field of the Invention

The present invention relates to a corrugated paperboard box making machine, and more particularly to a corrugated paperboard box making machine configured to enable a counter-ejector thereof to reliably separate a batch consisting of a given number of box-structured corrugated paperboard sheets.

2. Description of the Related Art

Heretofore, a corrugated paperboard box making machine equipped with a counter-ejector has been well known. For example, a corrugated paperboard box making machine described in JP 2011-230432A (Patent Document 1) comprises a sheet feeding apparatus for feeding corrugated paperboard sheets one-by-one, a plurality of type of processing apparatuses for subjecting each of the corrugated paperboard sheets to given processings such as printing and creasing, and a folder-gluer for applying glue onto a joint flap and folding and gluing the glue-applied corrugated paperboard sheet along creases and through the joint flap to form a box structure. The corrugated paperboard box making machine further comprises a counter-ejector disposed downstream of the folder-gluer and configured to count the number of the resulting folded and glued (i.e., box-structured) corrugated paperboard sheets to form a batch consisting of a given number of the box-structured corrugated paperboard sheets and eject the batch therefrom. The counter-ejector comprises a hopper for receiving therein the box-structured corrugated paperboard sheets, a main ledge, an auxiliary ledge, and an elevator.

The box-structured corrugated paperboard sheets are fed out from a folder-gluer outlet roll pair toward the hopper while being counted. When the box-structured corrugated paperboard sheets are fed out into the hopper by the given number, the main ledge starts to move downwardly from a standby position located above an installation height of the outlet roll pair. The main ledge further continues to move downwardly while allowing a next batch of box-structured corrugated paperboard sheets fed out from the output roll pair after the start of the downward movement to be sequentially stacked thereon. Then, when the main ledge moves downwardly to an installation position of the auxiliary ledge, the box-structured corrugated paperboard sheets stacked on the main ledge are passed to and stacked on the auxiliary ledge. When the given number of box-structured corrugated paperboard sheets are stacked on the auxiliary ledge, they are passed to the elevator located below the auxiliary ledge.

After the box-structured corrugated paperboard sheets stacked on the main ledge are passed to the auxiliary ledge, the main ledge continues to move further downwardly to a given lower position. When the downward movement to the given lower position has been completed, the main ledge moves upwardly from the given lower position to the standby position so as to receive a next batch of box-structured corrugated paperboard sheets from the output roll pair. By enabling the main ledge to repeat the downward and upward movements between the standby position and the given lower position, the batch consisting of the given number of box-structured corrugated paperboard sheets will be continuously formed.

SUMMARY OF THE INVENTION

Recent years, in the field of the corrugated paperboard box making machines, a higher production rate has been demanded. As the production rate becomes higher, time intervals at which box-structured corrugated paperboard sheets are sequentially fed out from the output roll pair of the folder-gluer into the hopper of the counter-ejector becomes shorter. When the time intervals are shortened, the main ledge tends to become failing to accurately enter between a last one of box-structured corrugated paperboard sheets in a previous batch and a first one of box-structured corrugated paperboard sheets in a next, new, batch. This is likely to lead to a situation where the first box-structured corrugated paperboard sheet in the new batch comes into collision with the main ledge, resulting in occurrence of jam-up. This is also likely to lead to a situation where the first box-structured corrugated paperboard sheet in the new batch falls in the hopper without being loaded on the main ledge, and thus the box-structured corrugated paperboard sheets being stacked are not separated as a given number of the box-structured corrugated paperboard sheets.

It is an object of the present invention to provide a corrugated paperboard box making machine capable of reliably separating the box-structured corrugated paperboard sheets being stacked, as a batch of a given number of the box-structured corrugated paperboard sheets, and to provide a sheet feeding control apparatus for the corrugated paperboard box making machine.

[Solution to Technical Problem]

First Aspect of Present Invention and Specific Embodiments Thereof

In order to achieve the above object, according to a first aspect of the present invention, there is provided a corrugated paperboard box making machine comprising: a sheet feeding apparatus for feeding one-by-one corrugated paperboard sheets each having a sheet length specified in accordance with an order; a processing apparatus for subjecting each of the corrugated paperboard sheets fed from the sheet feeding apparatus to a given processing; a folder-gluer for folding and gluing each of corrugated paperboard sheets subjected to the given processing to form a box structure; a counter-ejector for stacking the box-structured corrugated paperboard sheets fed out from the folder-gluer and separating the box-structured corrugated paperboard sheets being stacked, as a batch consisting of a given number of the box-structured corrugated paperboard sheets; a speed setting unit for setting a sheet feeding speed at which corrugated paperboard sheets are fed, in advance of execution of the order; and a control apparatus for controlling at least the sheet feeding apparatus, wherein the control apparatus is operable to execute a sheet feeding control processing of controlling the sheet feeding apparatus such that a sheet feeding operation of feeding one corrugated paperboard sheet is successively repeated a number of times corresponding to the number of the given number of box-structured corrugated paperboard sheets in the batch, and a sheet feeding stop control processing of, when the sheet feeding speed set by the speed setting unit is greater than an allowable speed set based on the sheet length specified in accordance with the order, controlling the sheet feeding apparatus such that the sheet feeding operation is stopped at least once after execution of the sheet feeding control processing.

In the first aspect of the present invention, the sheet feeding stop control processing is configured to, when the sheet feeding speed set by the speed setting unit is greater than an allowable speed set based on the sheet length specified in accordance with the order, control the sheet feeding apparatus such that the sheet feeding operation is stopped at least once after execution of the sheet feeding control processing. This makes it possible to enable the counter-ejector to reliably separate the box-structured corrugated paperboard sheets being stacked, as a batch consisting of a given number of the box-structured corrugated paperboard sheets.

In the first aspect of the present invention, the sheet feeding apparatus may have any configuration as long as it has a function of feeding corrugated paperboard sheets one-by-one. For example, the sheet feeding apparatus may be configured to feed out corrugated paperboard sheets one-by-one while catching a rear end of each of the corrugated paperboard sheets by a claw of a kicker. Alternatively, the sheet feeding apparatus may comprise a raisable-lowerable member raisable and lowerable with respect to a plurality of feeding rollers, wherein it may be configured such that, every time the raisable-lowerable member is lowered, corrugated paperboard sheets are placed on and fed out by the plurality of feeding rollers one-by-one.

In the first aspect of the present invention, when the processing apparatus comprises a printer, the control apparatus may be configured to control the sheet feeding apparatus such that the sheet feeding operation is performed once so as to feed one corrugated paperboard sheet during the period of time in which the printing cylinder of the printer is rotated 360 degrees, or may be configured to control the sheet feeding apparatus such that the sheet feeding operation is performed plural times so as to feed a plurality of corrugated paperboard sheets during the period of time in which the printing cylinder of the printer is rotated 360 degrees.

In the first aspect of the present invention, in the case where the sheet feeding apparatus is controlled to perform the sheet feeding operation plural times so as to feed a plurality of corrugated paperboard sheets during the period of time in which the printing cylinder of the printer is rotated 360 degrees, the control apparatus may be configured to control the sheet feeding apparatus in the sheet feeding stop processing such that, among a plurality of cycles of the sheet feeding operations during the period of time in which the printing cylinder of the printer is rotated 360 degrees, at least one cycle of the sheet feeding operation is stopped.

In the first aspect of the present invention, the speed setting unit may be configured to automatically set the sheet feeding speed to a value suitable for specifications of each order. For example, the speed setting unit may be configured to automatically set the sheet feeding speed to a value suitable for specifications of each order, such as a material and a sheet width of a corrugated paperboard sheet, a total number of box-structured corrugated paperboard sheets, a type of printing pattern, and the presence or absence of skipping or non-execution of a specific processing. Examples of the type of printing pattern may include an area, a color, etc., of a solid print. Alternatively, the speed setting unit may comprise a manipulation section manipulatable by an operator, where it may be configured to set the sheet feeding speed according to manipulation of the manipulation section. As one example, the speed setting unit may be configured to, when an operator manipulates the manipulation section while taking into account the above specifications of each order, and a state of corrugated paperboard sheets, such as warpage, set the sheet feeding speed according to the manipulation of the manipulation section.

In the first aspect of the present invention, the number of times the sheet feeding operation is stopped may be constant, or may vary depending on the sheet feeding speed set by the speed setting unit or the number of the given number of box-structured corrugated paperboard sheets in the batch.

In the first aspect of the present invention, in the case where the sheet feeding apparatus comprises the raisable-lowerable member raisable and lowerable with respect to the plurality of feeding rollers, the control apparatus may be configured to control a drive section of the raisable-lowerable member such that the raisable-lowerable member is stopped at a position above the plurality of feeding rollers, or may be configured to control a drive section of the plurality of feeding rollers such that rotation of the plurality of feeding rollers is stopped.

In the first aspect of the present invention, a technique of setting the allowable speed is not particularly limited as long as the allowable speed is set based on the sheet length specified in accordance with the order. Generally, the allowable speed is set to a lower speed as the sheet length of the corrugated paperboard sheet becomes longer. The allowable speed may be preliminarily stored in a storage device in association with a sheet length, or may be calculated based on the sheet length specified in accordance with the order.

In the first aspect of the present invention, the control apparatus may be configured to execute a determination processing of determining whether or not the sheet feeding speed set by the speed setting unit is greater than the allowable speed, and execute the sheet feeding stop control processing according to a result of the determination in the determination processing. In the case where the speed setting unit is configured to automatically set the sheet feeding speed to a value suitable for specifications of each order, the control apparatus may be configured to execute the sheet feeding stop control processing, according to a stop instruction preliminarily set for an order whose sheet feeding speed is greater than the allowable speed.

In a specific embodiment of the first aspect of the present invention, the control apparatus is operable to execute a determination processing of determining whether or not the sheet feeding speed set by the speed setting unit is greater than the allowable speed set based on the sheet length specified in accordance with the order, wherein the sheet feeding stop control processing is configured to, when the sheet feeding speed set by the speed setting unit is determined in the determination processing to be greater than the allowable speed, control the sheet feeding apparatus such that the sheet feeding operation is stopped at least once after execution of the sheet feeding control processing.

In this specific embodiment, the determination processing is configured to determine whether or not the sheet feeding speed set by the speed setting unit is greater than the allowable speed. The sheet feeding stop control processing is operable, when the sheet feeding speed set by the speed setting unit is determined in the determination processing to be greater than the allowable speed, to control the sheet feeding apparatus such that the sheet feeding operation is stopped at least once after execution of the sheet feeding control processing. Thus, even in a situation where the sheet feeding speed and the sheet length change in each order, it becomes possible to enable the counter ejector to reliably separate the box-structured corrugated paperboard sheets being stacked, as a batch consisting of a given number of the box-structured corrugated paperboard sheets.

In this specific embodiment, a timing of execution of the determination processing is not particularly limited as long as the control apparatus is operable to execute the determination processing before execution of the sheet feeding stop control processing.

In another specific embodiment of the first aspect of the present invention, the allowable speed is a maximum sheet feeding speed at which the counter-ejector is allowed to separate the box-structured corrugated paperboard sheets being stacked, as a batch consisting of a given number of the box-structured corrugated paperboard sheets, when the sheet feeding apparatus feeds corrugated paperboard sheets each having a sheet length specified in accordance with an order, wherein the control apparatus is operable to execute a speed deciding processing of deciding the allowable speed based on the sheet length specified in accordance with the order.

In this specific embodiment, the allowable speed is a maximum sheet feeding speed at which the counter-ejector is allowed to separate the box-structured corrugated paperboard sheets being stacked, as a batch consisting of a given number of the box-structured corrugated paperboard sheets, when the sheet feeding apparatus feeds corrugated paperboard sheets each having a sheet length specified in accordance with an order. The speed deciding processing is configured to decide the allowable speed based on the sheet length specified in accordance with the order. Thus, unless the sheet feeding speed exceeds the allowable speed which is the maximum sheet feeding speed at which the counter-ejector is allowed to separate the batch, the sheet feeding operation is never stopped. Therefore, even when the sheet feeding speed is increased, it becomes possible to minimize a situation where the sheet feeding operation is stopped.

In this specific embodiment, the speed deciding processing may be configured to decide the allowable speed based on a plurality of factors including the sheet length specified in accordance with the order. Examples of the factors include: a distance between respective leading edges of two successive corrugated paperboard sheets fed by the sheet feeding apparatus; a raising-lowering speed of a ledge for allowing a first one of the box-structured corrugated paperboard sheets of the batch to be loaded thereon; and the number of the given number of box-structured corrugated paperboard sheets in the batch.

In still another specific embodiment of the first aspect of the present invention, the speed setting unit comprises a manipulation section manipulatable by an operator, wherein the speed setting unit is configured to set the sheet feeding speed according manipulation of the manipulation section.

In this specific embodiment, the speed setting unit is operable to set the sheet feeding speed according operator's manipulation of the manipulation section. This makes it possible to, in advance of execution of each order, enable the operator to set the sheet feeding speed while taking into account various production conditions, such as specifications of each order, and a state of corrugated paperboard sheets. For example, when using corrugated paperboard sheets having low-warpage property, the operator can set the sheet feeding speed to a relatively high value.

In yet another specific embodiment of the first aspect of the present invention, the control apparatus is operable to execute a display control processing of causing a display unit to display thereon an upper limit speed at which the sheet feeding apparatus is allowed to feed corrugated paperboard sheets, the sheet feeding speed set by the speed setting unit, and the allowable speed, individually, wherein the speed setting unit is configured to allow the operator to set the sheet feeding speed in a speed range equal to or less than the upper limit speed.

In this specific embodiment, the display control processing is configured to cause the display unit to display thereon the upper limit speed at which the sheet feeding apparatus is allowed to feed corrugated paperboard sheets, the sheet feeding speed set by the speed setting unit, and the allowable speed, individually. The speed setting unit is operable to allow the operator to set the sheet feeding speed in a speed range equal to or less than the upper limit speed. This makes it possible to enable the operator to set the sheet feeding speed to a possibly high value suited to any of various production conditions, while recognizing a relationship between the upper limit speed and the allowable speed, from contents displayed on the display unit.

In this specific embodiment, the upper limit speed is preliminarily set, while taking into account a drive mechanism of the sheet feeding apparatus itself and a drive mechanism associated with sheet feeding from the sheet feeding apparatus to the counter-ejector, specifically, a mechanical configuration of each of the drive mechanisms, and performance of a drive motor. A display mode for the upper limit speed, the sheet feeding speed set by the speed setting unit, and the allowable speed may be configured such that each value of the speeds is displayed in the form of a numerical value, or may be configured such that a magnitude relationship among values of the speeds can be visually recognized.

In yet still another specific embodiment of the first aspect of the present invention, the processing apparatus comprises a printer for printing a given printing pattern on each of the corrugated paperboard sheets, wherein the printer comprises a printing cylinder to which a printing die having the given printing pattern is attached, and wherein the control apparatus is operable to control the sheet feeding apparatus such that the sheet feeding operation is performed once during a period of time in which the printing cylinder is rotated 360 degrees, and wherein the sheet feeding stop control processing is configured to control the sheet feeding apparatus such that the sheet feeding operation is stopped only once after execution of the sheet feeding control processing.

In this specific embodiment, the control apparatus is operable to control the sheet feeding apparatus such that the sheet feeding operation is performed once during the period of time in which the printing cylinder is rotated 360 degrees. The sheet feeding stop control processing is configured to control the sheet feeding apparatus such that the sheet feeding operation is stopped only once after execution of the sheet feeding control processing. This makes it possible to separate the box-structured corrugated paperboard sheets being stacked, as a batch consisting of a given number of the box-structured corrugated paperboard sheets, by simple control of stopping the sheet feeding operation only during the period of time in which the printing cylinder is rotated 360 degrees.

In another further specific embodiment of the first aspect of the present invention, the control apparatus is configured to be set to one of a first feeding control mode for controlling the sheet feeding apparatus such that the sheet feeding operation is performed once during the period of time in which the printing cylinder is rotated 360 degrees, and a second feeding control mode for controlling the sheet feeding apparatus such that the sheet feeding operation is performed twice during the period of time in which the printing cylinder is rotated 360 degrees, wherein the sheet feeding stop control processing is configured to, when the control apparatus is set to the second feeding control mode, and the number of the given number of box-structured corrugated paperboard sheets in the batch is an even number, control the sheet feeding apparatus such that the sheet feeding operation is stopped twice, and to, when the control apparatus is set to the second feeding control mode, and the number of the given number of box-structured corrugated paperboard sheets in the batch is an odd number, control the sheet feeding apparatus such that the sheet feeding operation is stopped only once.

In this specific embodiment, the control apparatus is configured to be set to one of the first feeding control mode and the second feeding control mode. The sheet feeding stop control processing is configured to, when the control apparatus is set to the second feeding control mode, and the number of the given number of box-structured corrugated paperboard sheets in the batch is an even number, control the sheet feeding apparatus such that the sheet feeding operation is stopped twice, and to, when the control apparatus is set to the second feeding control mode, and the number of the given number of box-structured corrugated paperboard sheets in the batch is an odd number, control the sheet feeding apparatus such that the sheet feeding operation is stopped only once. Thus, in the second feeding control mode, irrespective of whether the number of the given number of box-structured corrugated paperboard sheets in the batch is an even number or an odd number, a positional relationship between each of two corrugated paperboard sheets fed by the first and second sheet feeding operations during the period of time in which the printing cylinder is rotated 360 degrees, and the printing die of the printing cylinder, is kept constant. This makes it possible to form the given printing pattern with good positional accuracy.

In yet a further specific embodiment of the first aspect of the present invention, the sheet feeding apparatus comprises: a plurality of feeding rollers rotatable to feed a bottommost one of a plurality of stacked corrugated paperboard sheets; a raisable-lowerable member raisable and lowerable with respect to the plurality of feeding rollers; a roller drive motor for rotating the plurality of feeding rollers, individually; a raising-lowering drive motor; a motion conversion mechanism configured to convert a rotation of the raising-lowering drive motor into a motion for causing the raisable-lowerable member to be raised and lowered, and transmit the converted motion to the raisable-lowerable member, wherein the control apparatus is operable to execute the sheet feeding control processing such that a rotational speed of the raising-lowering drive motor is variably controlled according to a raising-lowering speed control pattern of the raisable-lowerable member, wherein the raising-lowering speed control pattern is changed in conformity to the sheet length specified in accordance with the order.

In this specific embodiment, the sheet feeding apparatus comprises the raisable-lowerable member raisable and lowerable with respect to the plurality of feeding rollers, and the motion conversion mechanism configured to convert a rotation of the raising-lowering drive motor into a motion for causing the raisable-lowerable member to be raised and lowered, and transmit the converted motion to the raisable-lowerable member. The control apparatus is operable to execute the sheet feeding control processing such that a rotational speed of the raising-lowering drive motor is variably controlled according to a raising-lowering speed control pattern of the raisable-lowerable member, while the raising-lowering speed control pattern is changed in conformity to the sheet length specified in accordance with the order. This makes it possible to perform the sheet feeding operation suited to the sheet length of the corrugated paperboard sheet, by changing the raising-lowering speed control pattern.

In this specific embodiment, the sheet feeding apparatus may be configured to rotate a plurality of roller drive shafts by a single roller drive motor, or may be configured to rotate a plurality of roller drive shafts, respectively, by a plurality of roller drive motors.

In still a further specific embodiment of the first aspect of the present invention, the sheet feeding stop control processing is configured to stop the sheet feeding operation by stopping the roller drive motor.

In this specific embodiment, the sheet feeding stop control processing is configured to stop the sheet feeding operation by stopping the roller drive motor. In this case, a required accuracy in stop position of roller drive motor is not so high as compared to processing of stopping the raising-lowering drive motor. Thus, it becomes possible to stop the sheet feeding operation by simple control processing.

In an additional specific embodiment of the first aspect of the present invention, the processing apparatus comprises a printer for printing a given printing pattern on each of the corrugated paperboard sheets, wherein the printer comprises a printing cylinder to which a printing die having the given printing pattern is attached, and an application mechanism for applying ink to the printing die, and wherein the control apparatus is operable to execute an application control processing of controlling the application mechanism to prevent ink from being applied to the printing die during at least a part of a period of time in which the sheet feeding operation is stopped by execution of the sheet feeding stop control processing.

In this specific embodiment, the application control processing is configured to control the application mechanism to prevent ink from being applied to the printing die during at least a part of the period of time in which the sheet feeding operation is stopped by execution of the sheet feeding stop control processing. This makes it possible to prevent ink from being excessively applied to the printing die during a printing operation performed just after stopping of the sheet feeding operation.

In this specific embodiment, the application control processing may be configured to prevent ink from being applied to the printing die during at least a part of the period of time in which the sheet feeding operation is stopped, so as to prevent ink from being excessively applied to the printing die during the printing operation performed just after stopping of the sheet feeding operation. A period of time in which no ink is applied to the printing die may vary depending on the given printing pattern.

Second Aspect of Present Invention

According to a second aspect of the present invention, there is provided a sheet feeding control apparatus for use in a corrugated paperboard box making machine, wherein the corrugated paperboard box making machine comprises: a sheet feeding apparatus for feeding one-by-one corrugated paperboard sheets each having a sheet length specified in accordance with an order; a processing apparatus for subjecting each of the corrugated paperboard sheets fed from the sheet feeding apparatus to a given processing; a folder-gluer for folding and gluing each of corrugated paperboard sheets subjected to the given processing to form a box structure; a counter-ejector for stacking the box-structured corrugated paperboard sheets fed out from the folder-gluer and separating the box-structured corrugated paperboard sheets being stacked, as a batch consisting of a given number of the box-structured corrugated paperboard sheets; and a speed setting unit for setting a sheet feeding speed at which corrugated paperboard sheets are fed, in advance of execution of the order. The sheet feeding control apparatus is configured to execute a sheet feeding control processing of controlling the sheet feeding apparatus such that a sheet feeding operation of feeding one corrugated paperboard sheet is successively repeated a number of times corresponding to the number of the given number of box-structured corrugated paperboard sheets in the batch, and a sheet feeding stop control processing of, when the sheet feeding speed set by the speed setting unit is greater than an allowable speed set based on the sheet length specified in accordance with the order, controlling the sheet feeding apparatus such that the sheet feeding operation is stopped at least once after execution of the sheet feeding control processing.

In the second aspect of the present invention, the sheet feeding stop control processing is configured to, when the sheet feeding speed set by the speed setting unit is greater than an allowable speed, control the sheet feeding apparatus such that the sheet feeding operation is stopped at least once after execution of the sheet feeding control processing. The makes it possible to enable the counter-ejector to reliably separate the box-structured corrugated paperboard sheets being stacked, as a batch consisting of a given number of the box-structured corrugated paperboard sheets.

In the second aspect of the present invention, the sheet feeding stop control processing of controlling a sheet feeding apparatus having any of various configurations can be embodied in various control configurations, as with the first aspect of the present invention and the specific embodiments thereof.

DETAILED DESCRIPTION OF THE PREFERRED EMBODIMENTS

Embodiment

With reference to accompanying drawings, a corrugated paperboard box making machine according to one embodiment of the present invention will now be described. A sheet feeding apparatus comprised in the corrugated paperboard box making machine 1 according to this embodiment is capable of feeding corrugated paperboard sheets in a designated one of a one-sheet feeding mode for feeding one corrugated paperboard sheet in a given processing cycle during which a printing cylinder of a printer is rotated 360 degrees, and a two-sheet feeding mode for sequentially feeding two corrugated paperboard sheets in the given processing cycle.

<<Overall Configuration>>

Figure 1:
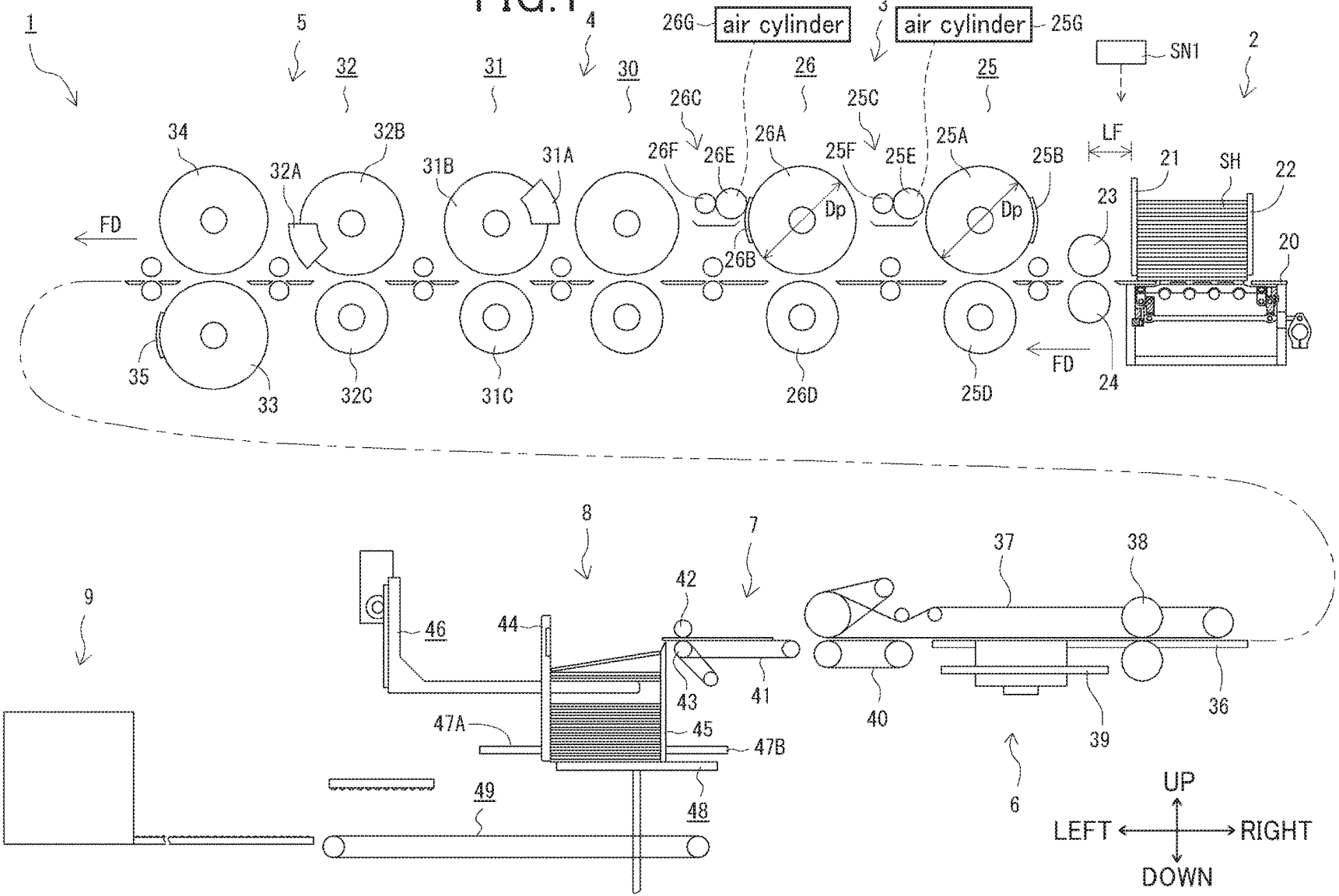
FIG. 1 is a front view depicting a corrugated paperboard box making machine equipped with a processing apparatus comprising a printer for one-sheet feeding mode.

As depicted in FIG. 1, the corrugated paperboard box making machine 1 comprises the sheet feeding apparatus 2, a printer 3, a creaser-slotter 4, a die cutter 5, a folder-gluer 6, a sheet transfer apparatus 7, a counter-ejector 8, and a bundler 9 for bundling a batch together.

The sheet feeding apparatus 2 comprises a table 20. A large number of corrugated paperboard sheets SH produced by a corrugating machine are stacked on the table 20 while being positioned between a front gate 21 and a back guide 22. The front gate 21 is disposed to allow the corrugated paperboard sheets SH to be fed out one-by-one through a gap between the front gate 21 and the table 20. The back guide 22 is configured to be movable with respect to the front gate 21, in a direction parallel to a feeding (conveyance) direction FD, so as to receive a plurality of types of corrugated paperboard sheets having different sheet lengths in the feeding direction FD. The sheet feeding apparatus 2 comprises a large number of feeding rollers, a raisable-lowerable grate, and a pair of feed rolls 23, 24. The feeding rollers are configured to, when the grate is lowered below the feeding rollers, come into contact with a bottommost one of the corrugated paperboard sheets SH, whereby the stacked corrugated paperboard sheets SH are fed out one-by-one toward the pair of feed rolls 23, 24. The pair of feed rolls 23, 24 is configured to feed the corrugated paperboard sheets SH one-by-one toward the printer 3. The pair of feed rolls 23, 24 is drivenly coupled to a main drive motor MT.

The sheet feeding apparatus 2 comprises a sheet sensor SN1 for counting the number of corrugated paperboard sheets SH fed out therefrom. The sheet sensor SN1 is composed of a heretofore-known optical sensor comprising a light-emitting section and a light-receiving section, and disposed in adjacent relation to the front gate 21. The sheet sensor SN1 is operable to detect a leading edge of each of the corrugated paperboard sheets SH passing through the front gate 21 to generate a sheet detection signal ST1. A detailed configuration of the sheet feeding apparatus 2 comprising the large number of feeding rollers and the grate will be described later.

The printer 3 comprises two printing units 25, 26. Each of the printing units 25, 26 comprises a printing cylinder (25A, 26A), a printing die (25B, 26B), an ink application mechanism (25C, 26C), and a press roll (25D, 26D). Each of the printing dies 25B, 26B has a given printing pattern, and is attached to an outer peripheral surface of a corresponding one of the printing cylinders 25A, 26A. In the one-sheet feeding mode, only one printing die is attached to each of the printing cylinders. Each of the ink application mechanisms 25C, 26C is configured to apply ink having a color which is different in each of the printing units. The printer 3 is configured to subject the fed corrugated paperboard sheet SH to two-color printing by using the two printing units 30, 31, and supply the printed corrugated paperboard sheet SH to the creaser-slotter 4. Each of the printing units 25, 26 is drivenly coupled to the main drive motor MT. The printing cylinders 25A, 26A have the same diameter Dp. Each of the ink application mechanisms 25C, 26C comprises an anilox roll (25E, 26E) and a rubber-covered roll (25F, 26F). Each of the anilox rolls 25E, 26E is configured to be movable between a contactable position for applying ink and a spaced-apart position for keeping ink from being applied, with respect to a corresponding one of the printing dies 25B, 26B attached, respectively, to the printing cylinders 25A, 26A. Two air cylinders 25G, 26G are provided as a means to move respective ones of the anilox rolls 25E, 26E between the contactable position and the spaced-apart position. A configuration for moving an anilox roll between the contactable position and the spaced-apart position by an actuating unit such as an air cylinder has heretofore been known, as described, for example, in JP 2000-006362A.

The creaser-slotter 4 comprises one creaser unit 30, and two slotter units 31, 32. The creaser unit 30 serves as a means to subject the printed corrugated paperboard sheet SH to creasing, and comprises a pair of creasing rolls arranged one above the other. Each of the slotter units 31, 32 serves as a means to subject the creased corrugated paperboard sheet SH to slotting, and comprises an upper slotter (31B, 32B) to which a slotter blade (31A, 32A) is attached, and a lower slotter (31C, 32C) formed with a groove fittable with the slotter blade (31A, 32A). In the one-sheet feeding mode, only one slotter blade is attached to each of the upper slotters. The creaser-slotter 4 is configured to subject the printed corrugated paperboard sheet SH to creasing and slotting to form a joint flap, by using the creaser unit 30 and the slotter units 31, 32, and supply the processed corrugated paperboard sheet SH to the die cutter 5. Each of the creaser unit 30 and the slotter units 31, 32 is drivenly coupled to the main drive motor MT.

The die cutter 5 comprises a die cylinder 33 and an anvil cylinder 34 which are disposed across a conveyance path. One punching die 35 for subjecting the processed corrugated paperboard sheet SH to punching is attached to a plate-like body made of veneer-core plywood or the like, and the plate-like body with the punching die is wound around an outer peripheral surface of the die cylinder 33. On the occasion of order change, the punching die 35 can be replaced with another punching die having a punching pattern conforming to a new order. Each of the die cylinder 33 and the anvil cylinder 34 is drivenly coupled to the main drive motor MT.

The folder-gluer 6 is operable to convey the punched corrugated paperboard sheet SH, and, during the conveyance, apply glue onto the joint flap of the punched corrugated paperboard sheet SH and then fold and glue the glue-applied corrugated paperboard sheet SH along the creases or the like and through the joint flap. The folder-gluer 6 comprises a guide rail 36 along the feeding direction FD of the corrugated paperboard sheet SH. A loop-shaped conveyance belt 37 is provided just above the guide rail 36 in a circulatingly (endlessly) movable manner. A glue supply device 38, a bending bar 39 and a folding belt 40 are arranged along the guide rail 36 and the conveyance belt 37.

The folder-gluer 6 is operable to support and convey the punched corrugated paperboard sheet SH formed with the creases and the joint flap, by using the guide rail 36 and the conveyance belt 37. During the conveyance of the punched corrugated paperboard sheet SH, the folder-gluer 6 is operable to apply glue onto the joint flap the glue supply device 38, and then bend the glue-applied corrugated paperboard sheet SH by using the bending bar 39. Then, the folder-gluer 6 is operable to fold the bent corrugated paperboard sheet SH and glue the folded corrugated paperboard sheet SH through the joint flap, by using the folding belt 40, thereby preparing a folded and glued (i.e., box-structured) corrugated paperboard sheet SH. The conveyance belt 37 is drivenly coupled to a non-depicted conveyance drive motor, and the folding belt 40 is drivenly coupled to a non-depicted folding drive motor.

The sheet transfer apparatus 7 primarily comprises a transfer conveyor 41 and an upper conveyance roll 42. The transfer conveyor 41 is operable to receive the box-structured corrugated paperboard sheet SH from the folder-gluer 6 and convey the received corrugated paperboard sheet SH. The upper conveyance roll 42 is disposed above and in opposed relation to a lower conveyance roll 43 disposed on an outlet side of the transfer conveyor 41. The upper conveyance roll 42 is operable to nip the box-structured corrugated paperboard sheet SH in cooperation with the transfer conveyor 41, and convey the box-structured corrugated paperboard sheet SH toward the counter-ejector 8. Each of the transfer conveyor 41 and the upper conveyance roll 42 is drivenly coupled to a non-depicted conveyor drive motor.

The counter-ejector 8 is operable to count the number of the box-structured corrugated paperboard sheets SH sequentially supplied from the sheet transfer apparatus 7 to form a batch BT consisting of a given number of the box-structured corrugated paperboard sheets SH. The counter-ejector 8*a* primarily comprises a front contact plate 44, a correction plate 45, a main ledge 46, a pair of auxiliary ledges 47A, 47B, an elevator 48, and a lower conveyor 49. The lower conveyor 49 is operable to feed out the batch BT toward the bundler 9. A detailed configuration of the counter-ejector 8 will be described later.

<Detailed Configuration of Sheet Feeding Apparatus 2>

Figure 2:
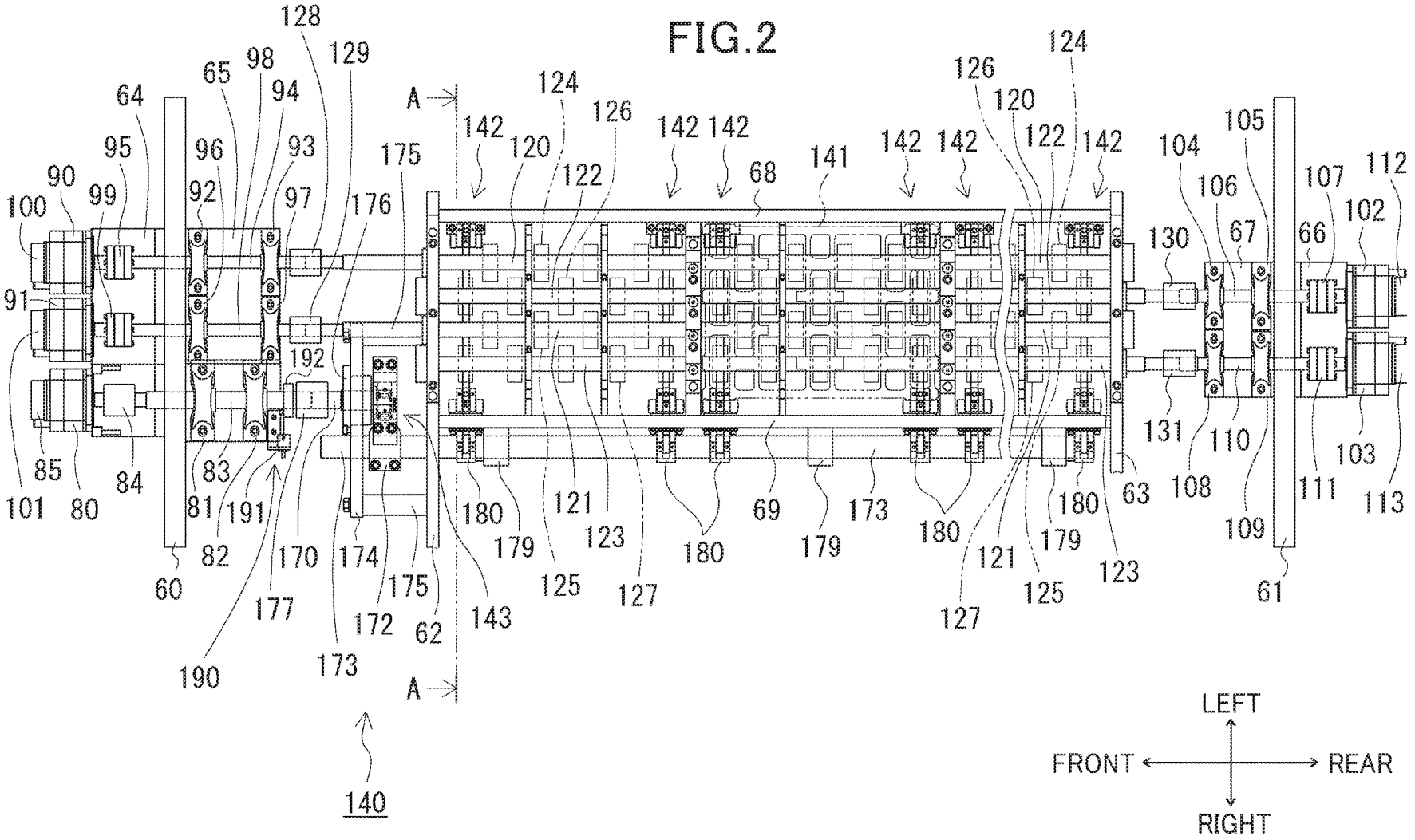
FIG. 2 is a top plan view depicting an internal structure of a corrugated paperboard sheet feeding apparatus in a region below a table thereof.
Figure 3:
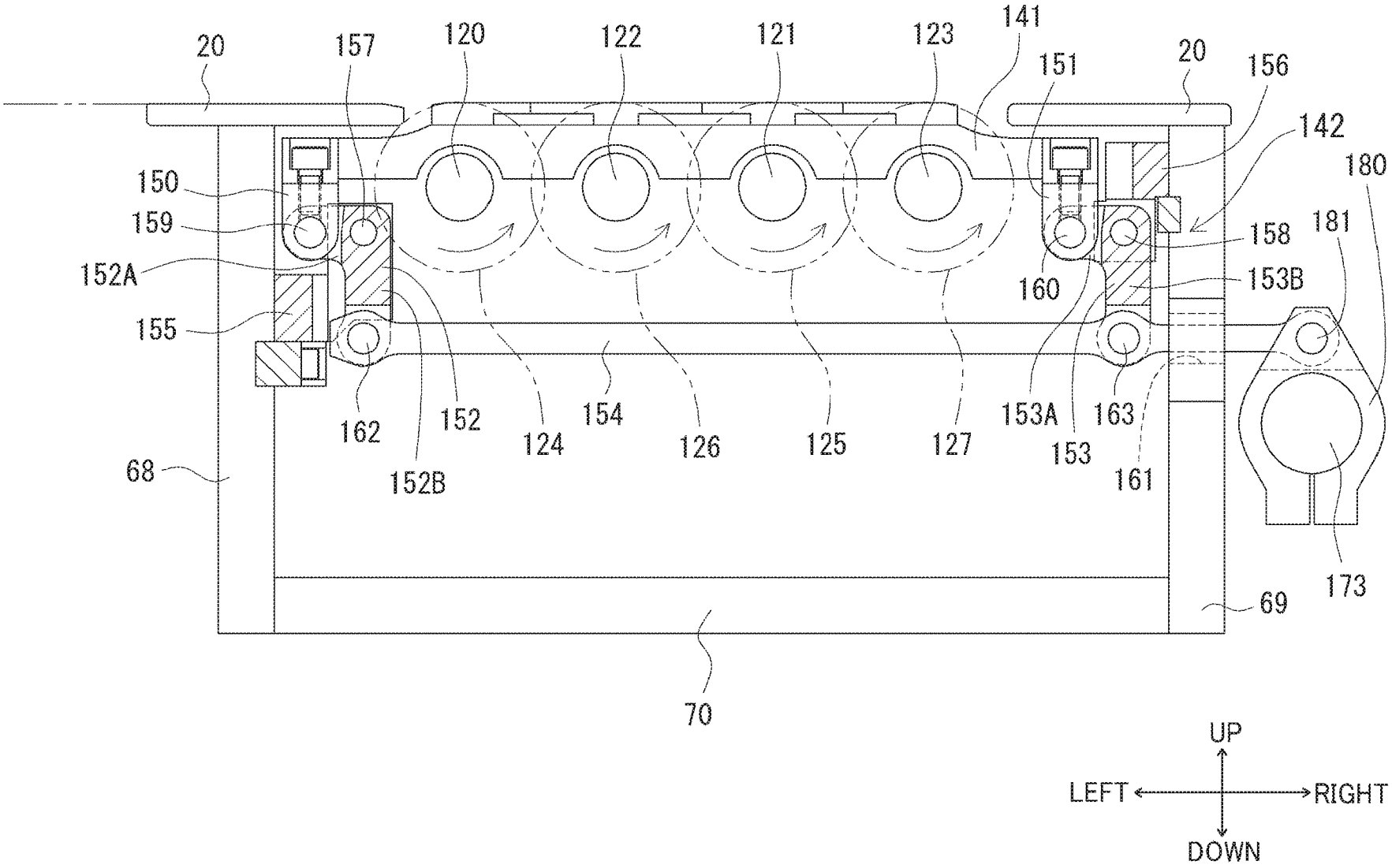
FIG. 3 is an enlarged sectional view of the corrugated paperboard sheet feeding apparatus 2, taken along the line A-A in FIG. 2.

With reference to FIGS. 2 to 5C, the detailed configuration of the sheet feeding apparatus 2 will be described. As depicted in FIG. 2, the sheet feeding apparatus 2 comprises a front frame 60, a rear frame 61, and a pair of front and rear intermediate frames 62, 63 disposed between the front and rear frames 60, 61. A motor mounting plate 64 is fixed to a front side of the front frame 60, and a bearing mounting plate 65 is fixed to a rear side of the front frame 60. A motor mounting plate 66 is fixed to a rear side of the rear frame 61, and a bearing mounting plate 67 is fixed to a front side of the front frame 61. A left frame 68 and a right frame 69 are arranged in parallel to extend in a frontward-rearward direction, and individually fixed to each of the intermediate frames 62, 63. As depicted in FIG. 3, a lower frame 70 is fixed to the left frame 68 and the right frame 69.

A raising-lowering motor 80 composed of an AC servomotor is fixed to the motor mounting plate 64. Two paired bearings 81, 82 are individually fixed to the bearing mounting plate 65 so as to rotatably support an intermediate drive shaft 83. The raising-lowering motor 80 has a rotary shaft coupled to the intermediate drive shaft 83 via a coupler 84. An encoder 85 is coupled to the rotary shaft of the raising-lowering motor 80.

A first roller motor 90 and a second roller motor 91 each composed of an AC servomotor are individually fixed to the motor mounting plate 64. Two paired bearings 92, 93 are individually fixed to the bearing mounting plate 65 to rotatably support a first roller drive shaft 94. The first roller motor 90 has a rotary shaft coupled to the first roller drive shaft 94 via a coupler 95. Two paired bearings 96, 97 are individually fixed to the bearing mounting plate 65 to rotatably support a second roller drive shaft 98. The second roller motor 91 has a rotary shaft coupled to the second roller drive shaft 98 via a coupler 99. Two encoders 100, 101 are coupled, respectively, to the rotary shaft of the first roller motor 90 and the rotary shaft of the second roller motor 91.

A third roller motor 102 and a fourth roller motor 103 each composed of an AC servomotor are individually fixed to the motor mounting plate 66. Two paired bearings 104, 105 are individually fixed to the bearing mounting plate 67 to rotatably support a third roller drive shaft 106. The third roller motor 102 has a rotary shaft coupled to the third roller drive shaft 106 via a coupler 107. Two paired bearings 108, 109 are individually fixed to the bearing mounting plate 67 to rotatably support a fourth roller drive shaft 110. The fourth roller motor 103 has a rotary shaft coupled to the fourth roller drive shaft 110 via a coupler 111. Two encoders 112, 113 are coupled, respectively, to the rotary shaft of the third roller motor 102 and the rotary shaft of the fourth roller motor 103.

As depicted in FIG. 2, first to fourth roller support shafts 120 to 123 are arranged parallel to each other to extend in the forward-rearward direction, and individually supported rotatably by the intermediate frames 62, 63. A large number of first feeding rollers 124 are fixed to the first roller support shaft 120, and a large number of second feeding rollers 125 are fixed to the second roller support shaft 121. A large number of third feeding rollers 126 are fixed to the third roller support shaft 122, and a large number of fourth feeding rollers 127 are fixed to the fourth roller support shaft 123. The first to fourth feeding rollers 124 to 127 are arranged in a staggered manner so as to prevent interference therebetween. The feeding rollers 124 to 127 have the same diameter Dr.

The first roller drive shaft 94 is coupled to the first roller support shaft 120 via a coupler 128, and the second roller drive shaft 98 is coupled to the second roller support shaft 121 via a coupler 129. The third roller drive shaft 106 is coupled to the third roller support shaft 122 via a coupler 130, and the fourth roller drive shaft 110 is coupled to the fourth roller support shaft 123 via a coupler 131.

The sheet feeding apparatus 2 comprises a motion conversion mechanism 140. The motion conversion mechanism 140 is configured to convert a unidirectional rotation of the raising-lowering motor 80 into a raising-lowering motion of an aftermentioned grate 141. In FIG. 2, actually, a large number of grates are arranged side-by-side in the frontward-rearward direction to cover a region in which the large number of feeding rollers 124 to 127 are arranged. It should be noted that FIG. 2 depicts only one of the grates 141, without depicting the remaining grates.

(Detailed Configuration of Motion Conversion Mechanism 140)

The motion conversion mechanism 140 comprises a plurality of support mechanisms 142 supporting the grates 141 in a raisable and lowerable manner, and a swing mechanism 143. The swing mechanism 143 is configured to convert the unidirectional rotation of the raising-lowering motor 80 to a swinging motion, and transmit the swinging motion to the support mechanisms 142.

With reference to FIG. 3, the configuration of each of the support mechanisms 142 will be described. The support mechanism 142 comprises a pair of left and right coupling blocks 150, 151, a pair of left and right two-arm levers 152, 153, and a coupling rod 154. As depicted in FIG. 3, a left mounting member 155 is fixed to a right surface of the left frame 68, and a right mounting member 156 fixed to a left surface of the right frame 69. The left two-arm lever 152 is swingably attached to the left mounting member 155 via a pivot shaft 157. The right two-arm lever 153 is swingably attached to the right mounting member 156 via a pivot shaft 158.

As depicted in FIG. 3, the grate 141 is horizontally disposed above and in adjacent relation to the four roller support shafts 120 to 123. The left coupling block 150 is fixed to a left end of the grate 141 to extend downwardly. The right coupling block 151 is fixed to a right end of the grate 141 to extend downwardly. One arm 152A of the left two-arm lever 152 is coupled to a lower end of the left coupling block 150 via a coupling pin 159. One arm 153A of the right two-arm lever 153 is coupled to a lower end of the right coupling block 151 via a coupling pin 160.

The coupling rod 154 is horizontally disposed below the four roller support shafts 120 to 123. The coupling rod 154 is disposed such that a right end thereof extends through a through-hole 161 formed in the right frame 69. In this state, a left end of the coupling rod 154 is coupled to the other arm 152B the left two-arm lever 152 via a coupling pin 162. An intermediate portion of the coupling rod 154 is coupled to the other arm 153B of the right two-arm lever 153 via a coupling pin 163, at a position adjacent to the right frame 69.

With reference to FIGS. 2 to 5C, the configuration of the swing mechanism 143 will be described. The swing mechanism 143 comprises a raising-lowering drive shaft 170, an eccentric member 171, a swingable member 172, and a raising-lowering coupling shaft 173. As depicted in FIG. 2, an auxiliary frame 174 is fixed to a left surface of the left intermediate frame 62 via a plurality of spacers 175, with a given distance therebetween. The raising-lowering drive shaft 170 is rotatably supported by the auxiliary frame 174 via a bearing 176. The raising-lowering drive shaft 170 is coupled to the intermediate drive shaft 83 via a coupler 177.

Figure 4:
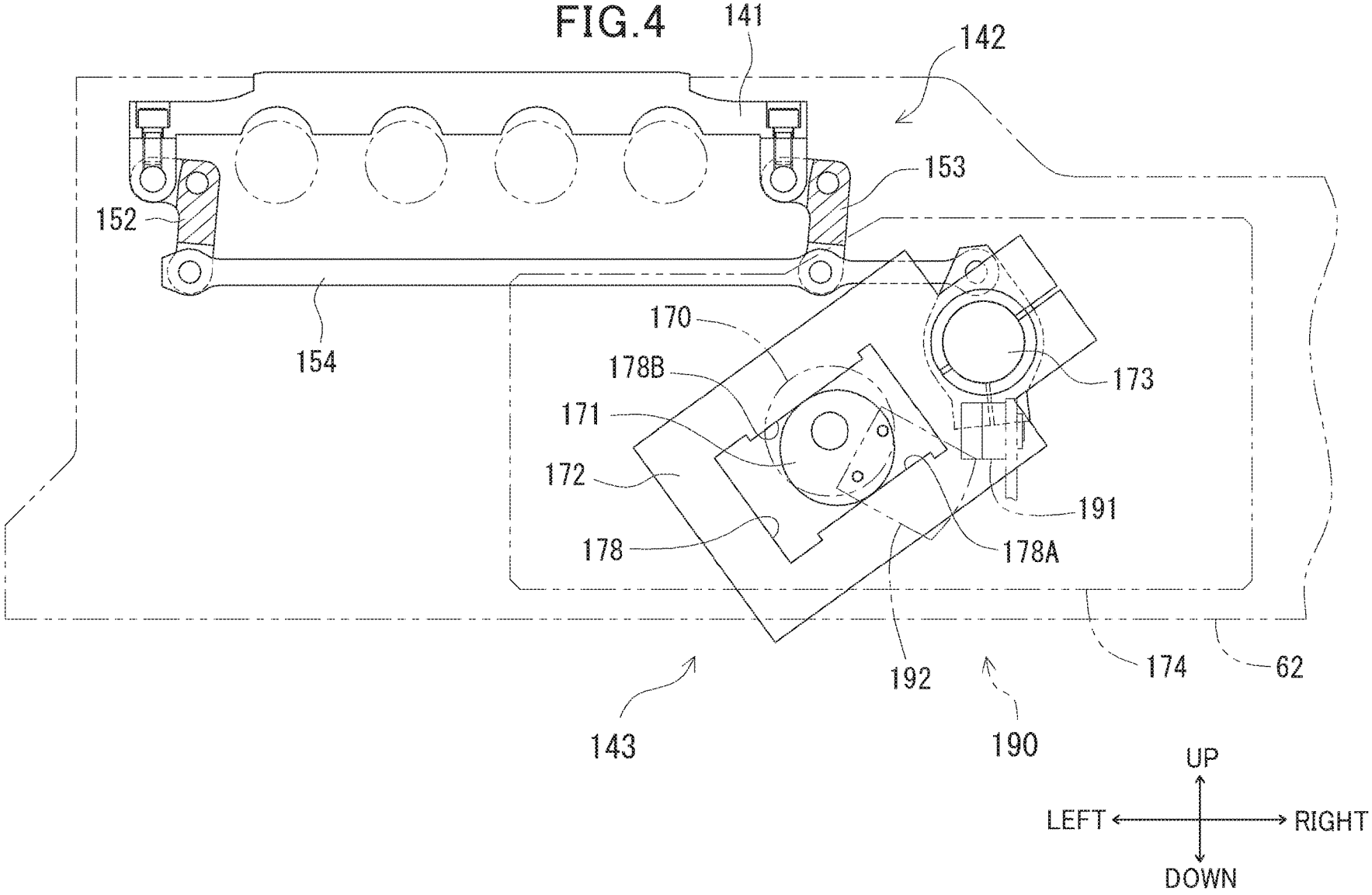
FIG. 4 is a diagram schematically depicting a coupling relationship between a support mechanism and a swing mechanism of the corrugated paperboard sheet feeding apparatus.

As depicted in FIG. 4, the eccentric member 171 is fixed to the raising-lowering drive shaft 170. The eccentric member 171 is formed to have a circular profile having a rotational axis center offset from a rotational axis of the raising-lowering drive shaft 170. The swingable member 172 is fixed to the raising-lowering coupling shaft 173 in such a manner as be swingable about the raising-lowering coupling shaft 173. The swingable member 172 is formed with an approximately rectangular-shaped fitting groove 178. The fitting groove 178 has a pair of contact surfaces 178A, 178B opposed to each other. Each of the contact surfaces 178A, 178B is formed to extend in a direction parallel to a line connecting the center of the circular profile of the eccentric member 171 and a rotational center of the raising-lowering coupling shaft 173. The eccentric member 171 is formed such that an outer peripheral surface thereof is always in contact with the contact surfaces 178A, 178B of the fitting groove 178.

As depicted in FIG. 2, the raising-lowering coupling shaft 173 is rotatably supported by a right surface of the right frame 69 via a plurality of bearings 179. The raising-lowering coupling shaft 173 is disposed parallel to the roller support shafts 120 to 123. A plurality of coupling members 180 are fixed to the raising-lowering coupling shaft 173, at respective positions corresponding to the plurality of support mechanisms 142. As depicted in FIG. 3, each of the coupling members 180 is coupled to the right end of the coupling rod 154 of a corresponding one of the support mechanisms 142, via a coupling pin 181.

Figure 5A:
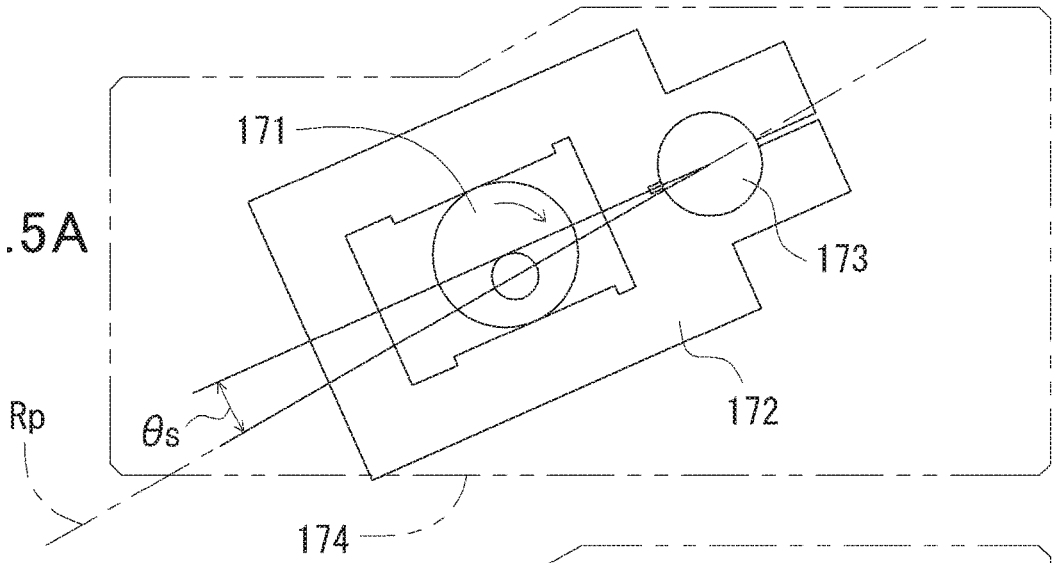
FIG. 5A is a diagram depicting a state in which a swing angle of a swingable member changes along with rotation of an eccentric member of the swing mechanism.
Figure 5B:
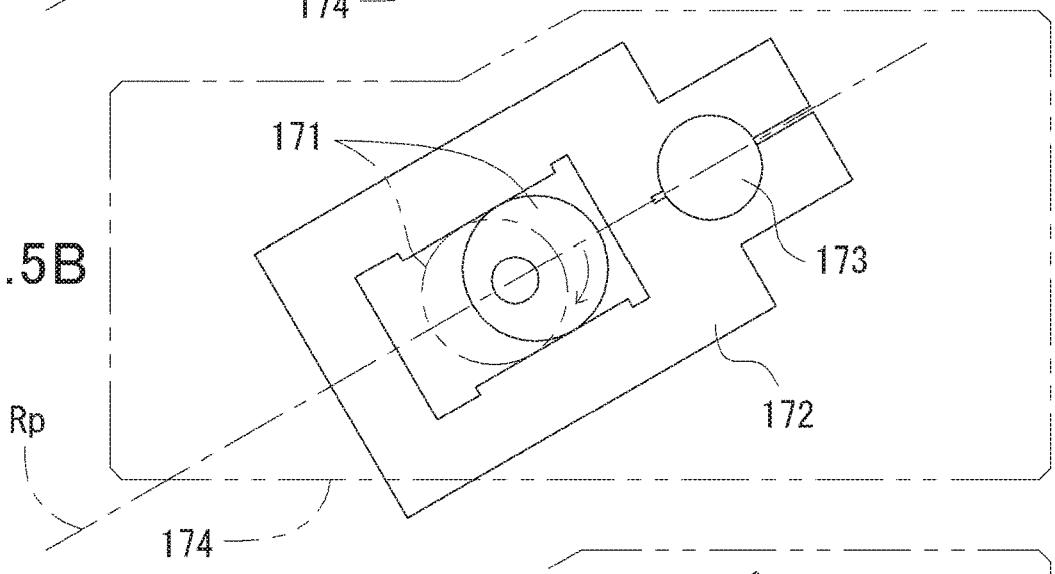
FIG. 5B is a diagram depicting a state in which the swing angle of the swingable member changes along with rotation of the eccentric member of the swing mechanism.
Figure 5C:
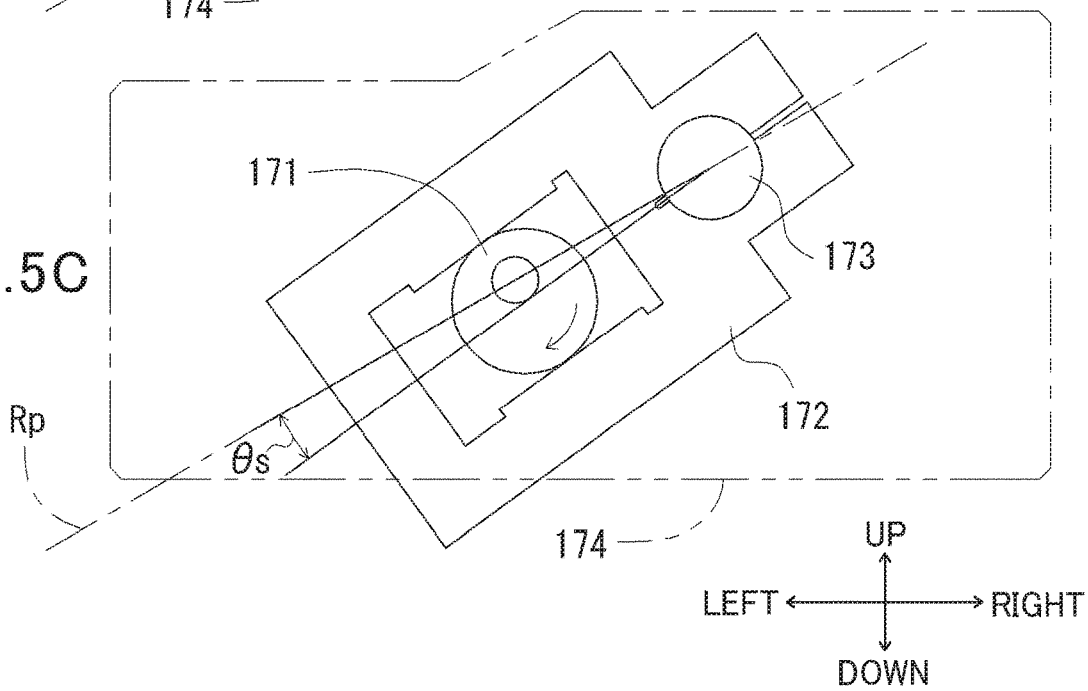
FIG. 5C is a diagram depicting a state in which the swing angle of the swingable member changes along with rotation of the eccentric member of the swing mechanism.

Referring to FIGS. 5(A) to 5(C), a reference angular position Rp is an angular position coincident with a line connecting a rotational center of the eccentric member 171 and the rotational center of the raising-lowering coupling shaft 173. It is to be understood that the rotational center of the eccentric member 171 is coincident with a rotation center of the raising-lowering drive shaft 170. The angular position of the swingable member 172 depicted in FIG. 5A corresponds to a state just after the swingable member 172 is swung in a clockwise direction from the reference angular position Rp by a given angle θs. At the angular position of the swingable member 172 depicted in FIG. 5A, the grate 141 is located at a lowermost position. The angular position of the swingable member 172 depicted in FIG. 5C corresponds to a state just after the swingable member 172 is swung in a counterclockwise direction from the reference angular position Rp by the given angle θs. At the angular position of the swingable member 172 depicted in FIG. 5C, the grate 141 is located at an uppermost position. The angular position of the swingable member 172 depicted in FIG. 5B corresponds to a state in which the swingable member 172 is located at the reference angular position Rp. At the angular position of the swingable member 172 depicted in FIG. 5B, the grate 141 is located at an intermediate position between the lowermost position and the uppermost position. In this embodiment, the given angle θs is set to 6 degrees. Further, in this embodiment, the swing mechanism 143 is configured such that, when the swingable member 172 is swung to the angular position depicted in FIG. 5A, the right end of the coupling rod 154 is elastically deformed along with a slight downward movement of the coupling pin 181.

(Configuration of Rotational Position Sensor 190)

A rotational position sensor 190 is provided as a means to detect a given rotational position of the raising-lowering drive shaft 170. The rotational position sensor 190 comprises an optical sensor 191, and a light-blocking member 192. The optical sensor 191 has a heretofore-known configuration comprising a light-emitting section and a light-receiving section, wherein it is fixed to the bearing mounting plate 65, as depicted in FIG. 2. As depicted in FIG. 2, the light-blocking member 192 is fixed to the intermediate drive shaft 83 coupled to the raising-lowering drive shaft 170. The light-blocking member 192 is operable, every time the raising-lowering drive shaft 170 reaches the given rotational position, to block light from the light-emitting section of the optical sensor 191.

In FIG. 4, the optical sensor 191 and the light-blocking member 192 are indicated by the two-dot chain lines. A rotational position of the light-blocking member 192 depicted in FIG. 4 corresponds a state just before the light-blocking member 192 passes through the optical sensor 191. In the state depicted in FIG. 4, the grate 141 is located at a height position just before it reaches the uppermost position. In this embodiment, the rotational position sensor 190 is configured to generate a detection signal SD when the raising-lowering drive shaft 170 is rotated to the given rotational position and thereby the grate 141 reaches the uppermost position.

<Detailed Configuration of the Counter-Ejector>

Figure 6:
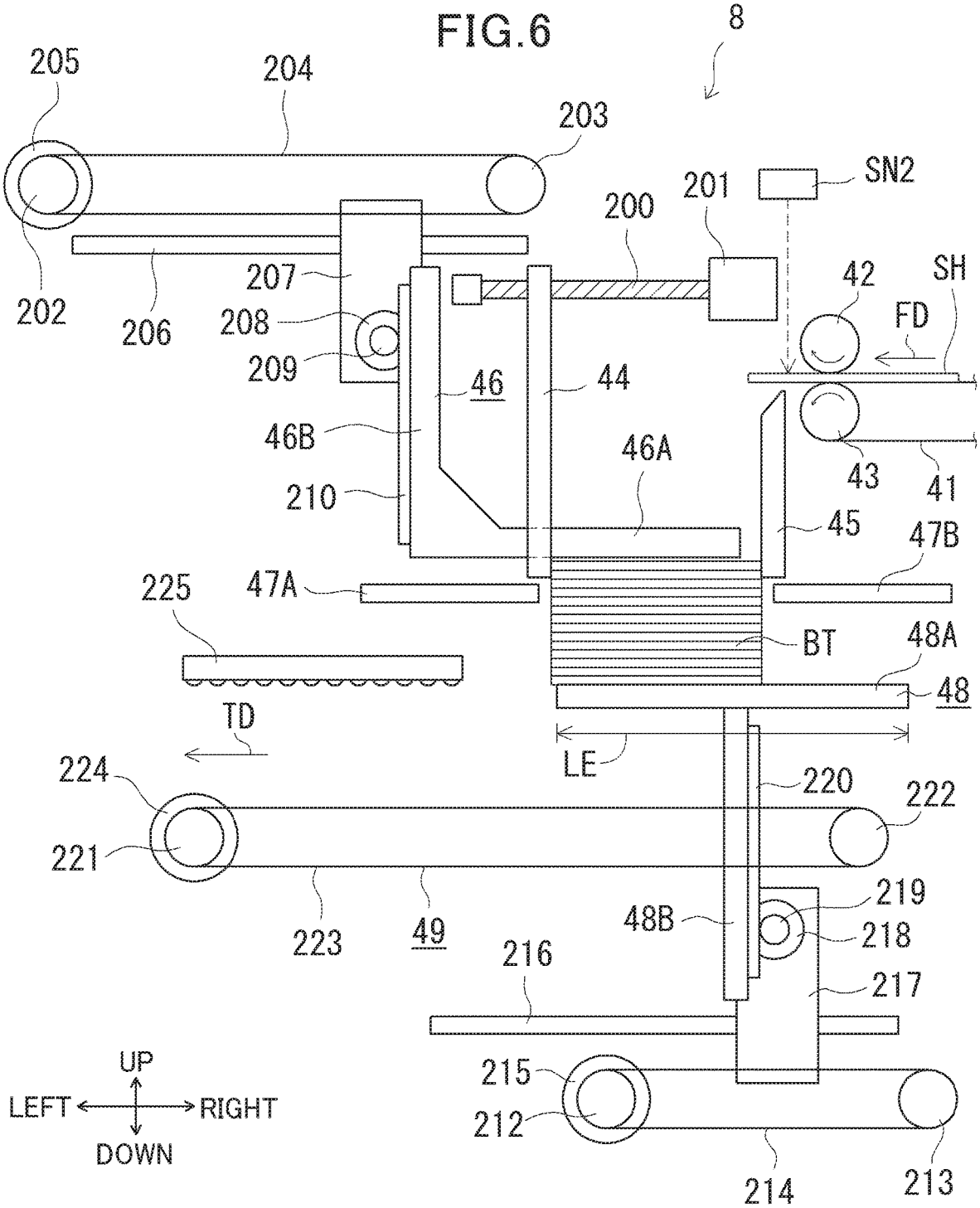
FIG. 6 is a front view depicting a counter-ejector.

With reference to FIG. 6, the detailed configuration of the counter-ejector 8 will be described. The front contact plate 44 is disposed to be contactable with a leading edge of the box-structured corrugated paperboard sheet SH conveyed (fed) in the conveyance (feeding) direction FD by the transfer conveyor 41 and the upper conveyance roll 42. A threaded shaft 200 is rotatably supported in a horizontal posture by a frame of the counter-ejector 8, and one end thereof is coupled to an output shaft of a front contact plate drive motor 201. On the other hand, the other end of the threaded shaft 200 is threadingly engaged with an upper end of the front contact plate 44, to cause the front contact plate 44 to be displaced in a rightward-leftward direction depending on a rotational direction and a rotational amount of the front contact plate drive motor 201. The front contact plate 44 is positioned such that a distance with respect to the correction plate 45 is set to a value corresponding to a dimension of the box-structured corrugated paperboard sheet BS in the feeding direction FD.

The correction plate 45 is located in adjacent relation to the transfer conveyor 41 and the upper conveyance roll 42, and disposed to be contactable with a trailing edge of the box-structured corrugated paperboard sheet SH. The box-structured corrugated paperboard sheets SH are stacked in a receiving space defined by the front contact plate 44, the correction plate 45 and others. The correction plate 45 is configured to perform a heretofore-known corrective motion, i.e., to be reciprocatingly moved in the rightward-leftward direction, so as to enable the edges of the stacked box-structured corrugated paperboard sheets SH to be arranged in order. The correction plate 45 is disposed in a certain positional relationship with the transfer conveyor 41 and the upper conveyance roll 42, which allows contact with the trailing edges of the stacked box-structured corrugated paperboard sheets SH according to the corrective motion.

The main ledge 46 has an L shape, and comprises a horizontally extending portion 46A and a vertically standing portion 46B. A drive pulley 202 and a driven pulley 203 are rotatably supported by the frame of the counter-ejector 8. A ledge drive belt 204 is disposed to extend horizontally in the rightward-leftward direction while being wound around between the drive pulley 202 and the driven pulley 203. The drive pulley 202 is coupled to an output shaft of a belt drive motor 205. A guide rail 206 is horizontally supported by the frame of the counter-ejector 8 at a position adjacent to the ledge drive belt 204. The guide rail 106 supports a ledge support member 207 movably in the rightward-leftward direction. The ledge support member 207 has an upper end fixed to the ledge drive belt 204. A ledge raising-lowering motor 208 is fixed onto the ledge support member 207. A pinion 209 is fixed to an output shaft of the ledge raising-lowering motor 208. A rack 210 is fixed to the vertically standing portion 46B of the main ledge 46, and meshed with the pinion 109. The vertically standing portion 46B of the main ledge 46 is supported movably in an upward-downward direction by a support mechanism provided on the ledge support member 207. The main ledge 46 is positioned in the rightward-leftward direction according to a rotational direction and a rotational amount of the belt drive motor 205, and positioned in the upward-downward direction according to a rotational direction and a rotational amount of the ledge raising-lowering motor 208.

The auxiliary ledge 47A is disposed to be movable forwardly and backwardly in the rightward-leftward direction with respect to the front contact plate 44. The auxiliary ledge 47B is disposed to be movable forwardly and backwardly in the rightward-leftward direction with respect to the correction plate 45. The two auxiliary ledges 47A, 47B are configured to be moved in directions causing them to come close to each other so as to support a lower surface of the stacked box-structured corrugated paperboard sheet SH, and to be moved in directions causing them to come away from each other so as to pass the stacked box-structured corrugated paperboard sheet SH to the elevator 48. The two auxiliary ledges 47A, 48B are coupled to a non-depicted ledge drive motor via a heretofore-known coupling mechanism.

The elevator 48 has an upper portion formed as a table 48A and a lower portion formed as a support rod 48B. The table 48A has a size capable of being loaded with a box-structured corrugated paperboard sheet SH having a maximum size producible by the corrugated paperboard box making machine 1. Specifically, a dimension LE of the table 48A in the rightward-leftward direction is approximately equal to a length of the maximum-size box-structured corrugated paperboard sheet in the rightward-leftward direction.

A drive pulley 212 and a driven pulley 213 are rotatably supported by the frame of the counter-ejector 8. An elevator drive belt 214 is disposed to extend horizontally in the rightward-leftward direction while being wound around between the drive pulley 212 and the driven pulley 213. The drive pulley 212 is coupled to an output shaft of a table displacement motor 215. A guide rail 216 is horizontally supported by the frame of the counter-ejector 8 at a position adjacent to the elevator drive belt 214. An elevator support member 217 is supported movably in the rightward-leftward direction by the guide rail 216. The elevator support member 217 has a lower end fixed to the elevator drive belt 214. A table raising-lowering motor 218 is fixed onto the elevator support member 217. A pinion 219 is fixed to an output shaft of the table raising-lowering motor 218. A rack 220 is fixed to the support rod 48B of the elevator 48, and meshed with the pinion 219. The support rod 48B of the elevator 48 is supported movably in the upward-downward direction by a support mechanism provided on the elevator support member 217.

The elevator 48 is positioned in the rightward-leftward direction according to a rotational direction and a rotational amount of the table displacement motor 215, and positioned in the upward-downward direction according to a rotational direction and a rotational amount of the table raising-lowering motor 218. In other words, the table 48A of the elevator 48 is configured to be displaced in the rightward-leftward direction with respect to a position of the correction plate 45 in the rightward-leftward direction, and to be displaced in the upward-downward direction between a height position of a lower edge of each of the front contact plate 44 and the correction plate 45, and a height position of the lower conveyor 49.

The lower conveyor 49 comprises a drive pulley 221, a driven pulley 222, a conveyor drive belt 223, and a belt drive motor 224. The drive pulley 221 and the driven pulley 222 are rotatably supported by the frame of the counter-ejector 8. The conveyor drive belt 223 is disposed to extend horizontally in the rightward-leftward direction while being wound around between the drive pulley 221 and the driven pulley 222. The drive pulley 221 is coupled to an output shaft of the belt drive motor 224.

An upper conveyor 225 is disposed with a distance from the lower conveyor 49. The upper conveyor 225 is configured to be moved in the upward-downward direction by a non-depicted servo motor, such that the distance between the upper conveyor 225 and the lower conveyor 49 becomes approximately equal to a thickness of the batch BT in the upward-downward direction, and then positioned with respect to the lower conveyor 49. The upper conveyor 225 is coupled to the output shaft of the belt drive motor 224 via a heretofore-known coupling mechanism. According to rotation of the belt drive motor 224, the lower conveyor 49 is operable to eject the batch BT in a given ejection direction TD toward the bundler 9, in cooperation with the upper conveyor 225. The given ejection direction TD is a direction parallel to the feeding (conveyance) direction FD, and identical to a direction causing the front contact plate 44 to come away from the correction plate 45.

The counter-ejector 8 comprises a sheet sensor SN2 for counting the number of the box-structured corrugated paperboard sheets SH supplied from the sheet transfer apparatus 7. The sheet sensor SN2 is composed of a heretofore-known optical sensor comprising a light-emitting section and a light-receiving section, and disposed in adjacent relation to the transfer conveyor 41 and the upper conveyance roll 42. The sheet sensor SN2 is operable to detect the leading edge of each of the box-structured corrugated paperboard sheets SH passing through the upper conveyance roll 42 to generate a sheet detection signal ST2.

<Configuration of Corrugated Paperboard Box Making Machine 1 Prepared for Two-Sheet Feeding Mode>

As regards a corrugated paperboard box making machine 1 depicted in FIG. 7, only a difference from the corrugated paperboard box making machine 1 depicted in FIG. 1 will be described below.

Figure 7:
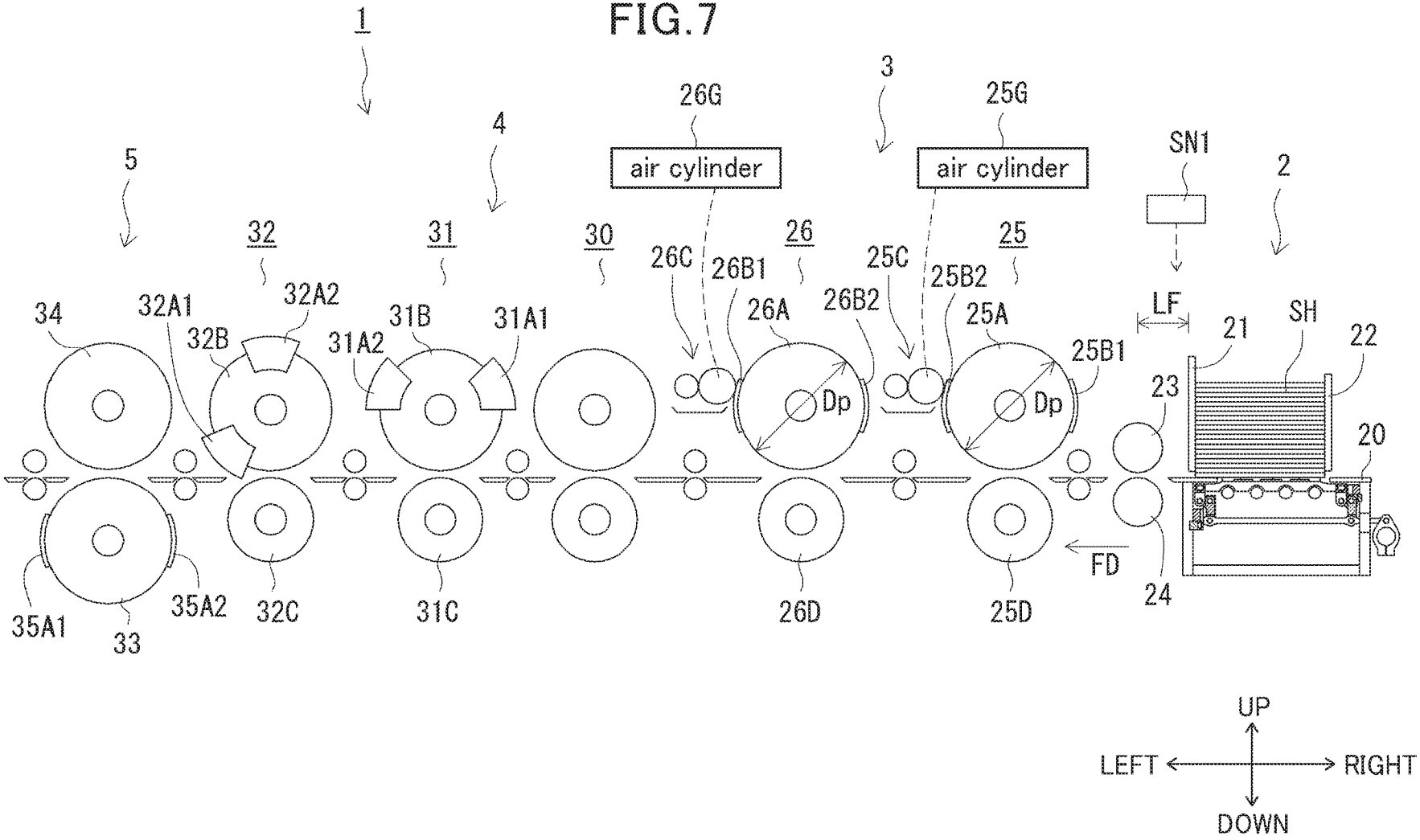
FIG. 7 is a front view depicting a corrugated paperboard box making machine equipped with a processing apparatus comprising a printer for two-sheet feeding mode.

As depicted in FIG. 7, two printing die members 25B1, 25B2 are attached to the outer peripheral surface of the printing cylinders 25A in a point symmetrical positional relation. Similarly, two printing die members 26B1, 26B2 are attached to the outer peripheral surface of the printing cylinders 26A in a point symmetrical positional relation. Thus, the printing die members 25B1, 26B1 are operable to subject an initial or first one of two corrugated paperboard sheets SH fed in a processing cycle during which each printing cylinder is rotated 360 degrees, to two-color printing. Further, the printing die members 25B2, 26B2 are operable to subject a next or second one of the two corrugated paperboard sheets SH fed in the processing cycle, to two-color printing.

Two slotter blades 31A1, 31A2 are attached to an outer peripheral surface of the upper slotter 31B of the slotter unit 31. Similarly, two slotter blades 32A1, 32A2 are attached to an outer peripheral surface of the upper slotter 32B of the slotter unit 32. The slotter blades 31A1, 31A2 are operable to subject front and rear ends of an initial or first one of two creased corrugated paperboard sheets SH fed in the processing cycle, to slotting. The slotter blades 32A1, 32A2 are operable to subject front and rear ends of a next or second one of the two creased corrugated paperboard sheets SH fed in the processing cycle, to slotting.

Two punching dies 35A1, 35A2 are attached to the outer peripheral surface of the die cylinder 33 in a point symmetrical positional relation. The punching die 35A1 is operable to subject an initial or first one of two slotted corrugated paperboard sheets SH fed in the processing cycle, to punching. The punching die 35A2 is operable to subject a next or second one of the two slotted corrugated paperboard sheets SH fed in the processing cycle, to punching.

<<Electrical Configuration>>

Figure 8:
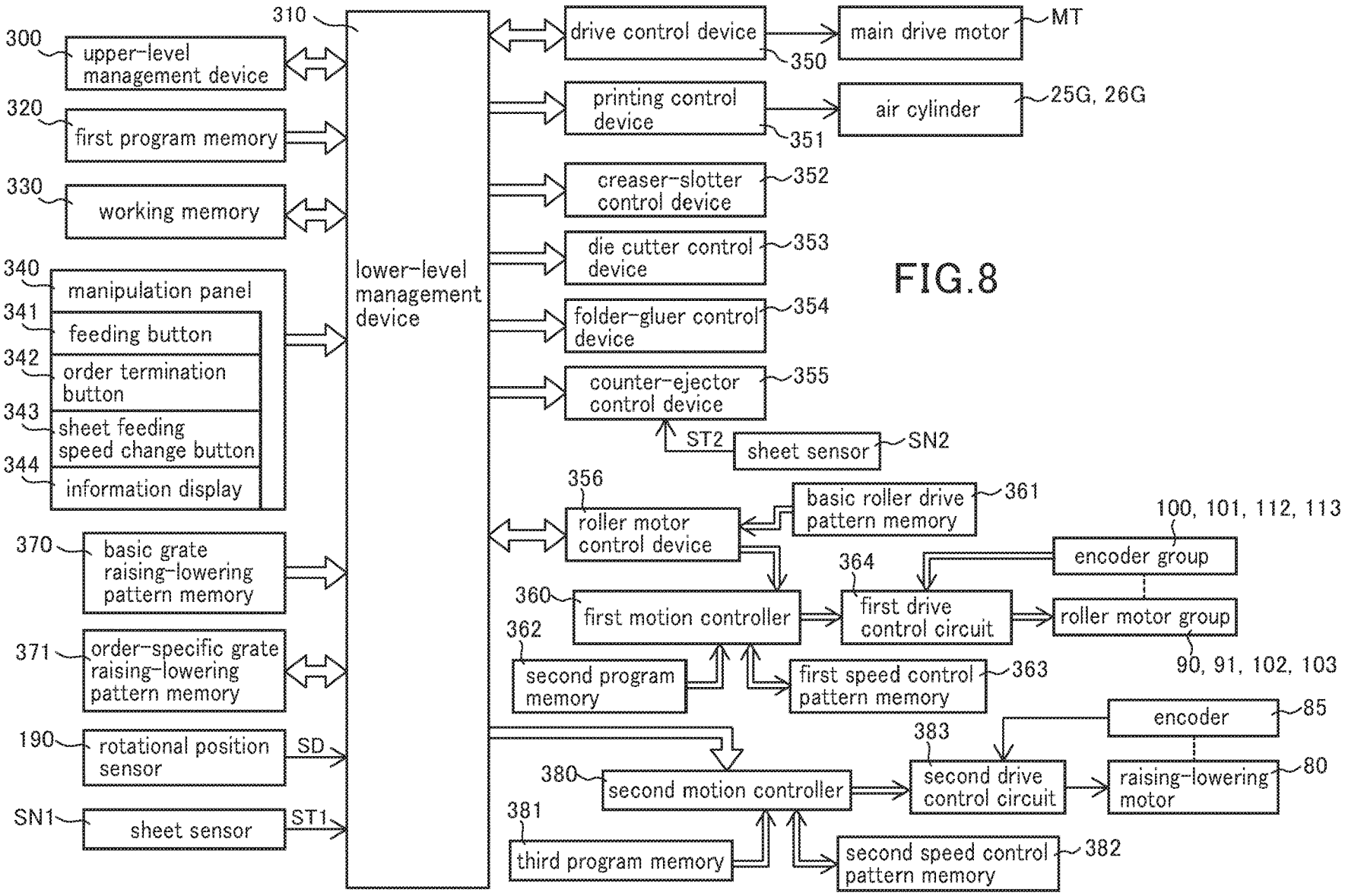
FIG. 8 is a block diagram depicting an electrical configuration of the corrugated paperboard box making machine.

With reference to FIG. 8, an electrical configuration of the corrugated paperboard box making machine 1 will be described. An upper-level management device 300 and a lower-level management device 310 are provided as a means to generally manage processing of corrugated paperboard sheets in the corrugated paperboard box making machine 1. In this embodiment, the upper-level management device 300 stores therein a production management plan for executing a large number of orders in a predetermined sequence. The upper-level management device 300 is operable to send, to the lower-level management device 310, control instruction information regarding specifications of an order, such as a size of a corrugated paperboard sheet SH including a sheet length in the feeding direction FD, a batch-forming sheet number (i.e., a given number of corrugated paperboard sheets SH forming one batch), and a feeding mode. The feeding mode means one of the one-sheet feeding mode and the two-sheet feeding mode.

The lower-level management device 310 is operable, according to the control instruction information sent from the upper-level management device 300, to control operations of drive sections such as the main drive motor MT, and perform a management control, for example, of counting the number of processed corrugated paperboard sheets SH and sending the obtained data to the upper-level management device 300. The lower-level management device 310 is connected to a first program memory 320 and a working memory 330, thereby making up a computer for controlling the corrugated paperboard box making machine 1 in cooperation with these memories. The first program memory 320 is a memory fixedly storing therein a control program for controlling an entirety of the corrugated paperboard box making machine 1, a program for executing a feeding control processing depicted in FIG. 19, a grate raising-lowering pattern creation program for creating an order-specific grate raising-lowering pattern DGP in conformity to the sheet length and the feeding mode of each order, given set values, etc. The working memory 330 is a memory configured to temporarily store therein a variety of information sent from the upper-level management device 300 and calculation results, during execution of the control programs, and to temporarily store therein a manipulation signal sent from a manipulation panel 340.

The lower-level management device 310 is connected to the manipulation panel 340. The manipulation panel 340 comprises a feeding button 341, an order termination button 342, a sheet feeding speed change button 343, and an information display 344. The feeding button 341 is configured to be manipulated to cause the sheet feeding apparatus 2 to start feeding of corrugated paperboard sheets SH. The manipulation panel 340 is operable, upon manipulation of the feeding button 341, to generate a feeding start signal SF. The order termination button 342 is configured to be manipulated to terminate a currently executed order. The sheet feeding speed change button 343 is configured to be manipulated to change a sheet feeding speed to an arbitrary value. The sheet feeding speed change button 343 comprises a speed increasing button for increasing the sheet feeding speed, and a speed reducing button for reducing the sheet feeding speed. The information display 344 is configured to display information such as a numerical value representing a changed value of the sheet feeding speed.

The lower-level management device 310 is connected to each of a drive control device 350, a printing control device 351, a creaser-slotter control device 352, a die cutter control device 353, a folder-gluer control device 354, a counter-ejector control device 355, and a roller motor control device 356. The drive control device 350 is operable, according to the control instruction information from the lower-level management device 310, to control activation and deactivation of the main drive motor MT, and a rotational speed thereof. The rotational speed of the main drive motor MT is controlled according to the sheet feeding speed contained in the control instruction information. The printing control device 351 is operable, according to the control instruction information from the lower-level management device 310, to control an operation of the printing units 25, 26. The creaser-slotter control device 352 is operable, according to the control instruction information from the lower-level management device 310, to control an operation of the creaser unit 30 and to control an operation of the slotter units 31, 32. The die cutter control device 353 is operable, according to the control instruction information from the lower-level management device 310, to control an operation of the die cutter 5. The folder-gluer control device 354 is operable, according to the control instruction information from the lower-level management device 310, to control operations of the glue supply device 38, the conveyance drive motor, the folding drive motor and others. The counter-ejector control device 355 is connected to the sheet sensor SN2, and operable, based on the sheet detection signal ST2 received from the sheet sensor SN2, to count the number of the box-structured corrugated paperboard sheets SH fed from the sheet transfer apparatus 7. Further, the counter-ejector control device 355 is operable, according to the control instruction information from the lower-level management device 310, to control activation and deactivation of each of the motors provided in the counter-ejector 8, such as the belt drive motor 205 and the ledge raising-lowering motor 208. For example, the counter-ejector control device 355 is operable to control the activation of the ledge raising-lowering motor 208 such that, when the sheet sensor SN2 detects a leading edge of a last one of the box-structured corrugated paperboard sheets SH forming one batch, the main ledge 46 starts to move downwardly from the given standby position toward the given lower position. In FIG. 8, depiction about control devices for controlling respective operations of the sheet transfer apparatus 7 and the bundler 9 are omitted.

The rotational position sensor 190 and the sheet sensor SN1 are individually connected to the lower-level management device 310. The lower-level management device 310 is operable, upon manipulation of the feeding button 341, to send control instruction information containing a feeding start instruction to the roller motor control device 356. After sending the feeding start instruction, the lower-level management device 310 is operable, every time it receives the detection signal SD from the rotational position sensor 190, to send control instruction information containing a synchronization instruction to the roller motor control device 356. Further, the lower-level management device 310 is operable, based on the sheet detection signal ST1 received from the sheet sensor SN1, to count the number of corrugated paperboard sheets SH fed from the sheet feeding apparatus 2.

The roller motor control device 356 is operable, according to the control instruction information from the lower-level management device 310, to control a sequence of operations of a first motion controller 360. A basic roller drive pattern memory 361 is connected to the roller motor control device 356. The basic roller drive pattern memory 361 stores therein two basic roller drive patterns BRP11, BRP12 preliminarily set for the one-sheet feeding mode, and three basic roller drive patterns BRP21 to BRP23 preliminarily set for the two-sheet feeding mode, in order to control the rotational speed of each of the roller motors 90, 91, 102, 103. The lower-level management device 310 is operable, upon receiving control instruction information for carrying out preparation for execution of the next (new) order, from the upper-level management device 300, to send control instruction information containing an order preparation instruction to the roller motor control device 356. The roller motor control device 356 is operable, upon receiving the control instruction information containing the order preparation instruction, from the lower-level management device 310, to read out one of a combination of the basic roller drive patterns BRP11, BRP12, and a combination of the basic roller drive patterns BRP21 to BRP23, from the basic roller drive pattern memory 361, to generate a roller speed control pattern creation instruction. The roller motor control device 356 is operable to send the roller speed control pattern creation instruction to the first motion controller 360. The roller speed control pattern creation instruction contains the sheet feeding speed contained in the control instruction information from the lower-level management device 310, and the read-out combination of basic roller drive patterns BRP. Further, the roller motor control device 356 is operable, in response to the feeding start instruction or the synchronization instruction contained in the control instruction information from the lower-level management device 310, to send a motion start instruction to the first motion controller 360.

The first motion controller 360 comprises a built-in motion CPU, and is connected to a second program memory 362 and a first speed control pattern memory 363. The second program memory 362 preliminarily stores therein a roller speed control pattern creation program for creating a roller speed control pattern RT, and a phase-difference set value DPP. The phase-difference set value DPP is a value for setting a phase difference by which a start phase of an acceleration region (BR11, BR21) in each of the basic roller drive patterns BRP11, BRP21 depicted in FIGS. 9A to 10C is displaced, in a direction of the horizontal axis representing rotational angle θp, from a start phase of an acceleration region (BS11A, BL11A, BS21A, BL21A) in corresponding one of aftermentioned four basic grate raising-lowering patterns BGS1, BGL1, BGS2, BGL2 depicted in FIGS. 11 to 18. In this embodiment, the phase-difference set value DPP is set to an angle of 71 degrees in terms of a rotational angle θp of each of the printing cylinders. The first speed control pattern memory 363 is operable to temporarily store therein the roller speed control pattern RT created by the first motion controller 360. The roller speed control pattern RT contains a series, large number of speed control instructions for designating the rotational speed of each of the roller motors. The first motion controller 360 is operable, upon receiving the roller speed control pattern creation instruction from the roller motor control device 356, to execute the roller speed control pattern creation program. According to the execution of the roller speed control pattern creation program, the first motion controller 360 is operable, based on the sheet feeding speed and the basic roller drive patterns BRP contained in the roller speed control pattern creation instruction, to create a roller speed control pattern RT and temporarily store the created roller speed control pattern RT in the first speed control pattern memory 363.

Then, the first motion controller 360 is operable, upon receiving the motion start instruction from the roller motor control device 356, to read out the speed control instructions from the first speed control pattern memory 363 at intervals of a given control cycle, and sequentially send the speed control instructions to a first drive control circuit 364. For example, the given control cycle is 1 msec, which is a time period during which the first motion controller 360 can reliably execute processing such as read-out of the speed control instructions, even in a situation where the sheet feeding speed is set to an upper limit speed which is a maximum sheet feeding speed realizable in the corrugated paperboard box making machine 1. A basic configuration of the first motion controller 360 is commonly known, as disclosed, for example, in JP 2006-072399A, JP 11-272312A and JP 05-050329A. Thus, detailed description thereof will be omitted.

The first drive control circuit 364 is operable to receive the speed control instructions from the first motion controller 360 and rotation pulses from the group of encoders 100, 101, 112, 113, to control the rotational speed and the activation-deactivation of each of the roller motors 90, 91, 102, 103. That is, the first drive control circuit 364 is operable to control supply of electricity to the roller motors, such that the rotational speed of each of the roller motors becomes equal to a value conforming to the speed control instruction, during the given control cycle. According to rotation of the roller motors 90, 91, 102, 103, the feeding rollers 124 to 127 are rotated in the counterclockwise direction as indicated by the arrowed lines in FIG. 3. In this embodiment, each of the encoders is capable of generating a large number of rotation pulses, e.g., 1000 pulses/msec or more, during the given control cycle.

A basic grate raising-lowering pattern memory 370 and an order-specific grate raising-lowering pattern memory 371 are connected to the lower-level management device 310. The basic grate raising-lowering pattern memory 370 stores therein: a basic grate raising-lowering pattern BGS1 preliminarily set in conformity to a minimum sheet length in the one-sheet feeding mode; a basic grate raising-lowering pattern BGL1 preliminarily set in conformity to a maximum sheet length in the one-sheet feeding mode; a basic grate raising-lowering pattern BGS2 preliminarily set in conformity to a minimum sheet length in the two-sheet feeding mode; and a basic grate raising-lowering pattern BGL2 preliminarily set in conformity to a maximum sheet length in the two-sheet feeding mode, in order to control the rotational speed of the raising-lowering motor 80. The order-specific grate raising-lowering pattern memory 371 is operable to temporarily store an order-specific grate raising-lowering pattern DGP, as mentioned below.

The lower-level management device 310 is operable, upon receiving control instruction information for carrying out preparation for execution of the next (new) order, from the upper-level management device 300, to execute the grate raising-lowering pattern creation program stored in the first program memory 320. According to the execution of the grate raising-lowering pattern creation program, the lower-level management device 310 is operable, based on one of the basic grate raising-lowering patterns BGS1, BGL1, BGS2, BGL2 stored in the basic grate raising-lowering pattern memory 370, to create an order-specific grate raising-lowering pattern DGP conforming to a sheet length of the next order, and temporarily store the created order-specific grate raising-lowering pattern DGP in the order-specific grate raising-lowering pattern memory 371. Subsequently, the lower-level management device 310 is operable to read out the order-specific grate raising-lowering pattern DGP from the order-specific grate raising-lowering pattern memory 371 to generate a grate raising-lowering speed control pattern creation instruction. The grate raising-lowering speed control pattern creation instruction contains a sheet feeding speed set by manipulation of the sheet feeding speed change button 343 or the like, and the order-specific grate raising-lowering pattern DGP.

The lower-level management device 310 is operable, upon manipulation of the feeding button 341, to receive the feeding start signal SF from the manipulation panel 340, and send, as the motion start instruction, control instruction information containing the feeding start instruction, to a second motion controller 380. After sending the feeding start instruction, the lower-level management device 310 is operable, every time it receives the detection signal SD from the rotational position sensor 190, to send, as the motion start instruction, control instruction information containing the synchronization instruction, to the second motion controller 380.

The second motion controller 380 is connected to the lower-level management device 310. The second motion controller 380 comprises a built-in motion CPU, and is connected to a third program memory 381 storing therein a program, and a second speed control pattern memory 382. The third program memory 381 preliminarily stores therein a grate raising-lowering speed control pattern creation program for creating a grate raising-lowering speed control pattern GT. The second speed control pattern memory 382 is operable to temporarily store therein a grate raising-lowering speed control pattern GT created by the second motion controller 380. The grate raising-lowering speed control pattern GT contains a series, large number of speed control instructions for designating the rotational speed of the raising-lowering motor 80. The second motion controller 380 is operable, upon receiving the grate raising-lowering speed control pattern creation instruction from the lower-level management device 310, to execute the grate raising-lowering speed control pattern creation program. According to the execution of the grate raising-lowering speed control pattern creation program, the second motion controller 380 is operable, based on the sheet feeding speed and the order-specific grate raising-lowering pattern DGP contained in the grate raising-lowering speed control pattern creation instruction, to create a grate raising-lowering speed control pattern GT and temporarily store the created grate raising-lowering speed control pattern GT in the second speed control pattern memory 382.

Then, the second motion controller 380 is operable, upon receiving the motion start instruction from the lower-level management device 310, to read out the speed control instructions from the second speed control pattern memory 382 at intervals of a given control cycle, and sequentially send the speed control instructions to a second drive control circuit 383. For example, the given control cycle is 1 msec, which is a time period during which the second motion controller 380 can reliably perform processing such as read-out of the speed control instructions even in a situation where the sheet feeding speed is set to an upper limit speed which is a maximum sheet feeding speed realizable in the corrugated paperboard box making machine 1. The second motion controller 380 has the same basic configuration as that of the first motion controller 360.

The second drive control circuit 383 is operable to receive the speed control instructions from the second motion controller 380, and rotation pulses from the encoder 85, to control the rotational speed and the activation-deactivation of the raising-lowering motor 80. That is, the second drive control circuit 383 is operable to control supply of electricity to the raising-lowering motor 80 such that the rotational speed of the raising-lowering motor 80 becomes equal to a rotational speed conforming to the speed control instruction, during the given control cycle. While the rotary shaft of the raising-lowering motor 80 is rotated 360 degrees, the eccentric member 171 is rotated 360 degrees in the clockwise direction as indicated by the arrowed lines in FIGS. 5A to 5C, and thus the grate 141 undergoes one cycle of raising-lowering motion. In this embodiment, the encoder 85 is capable of generating a large number of rotation pulses, e.g., 1000 pulses/msec or more, during the given control cycle.

<Basic Roller Drive Pattern BRP>

Figure 9A:
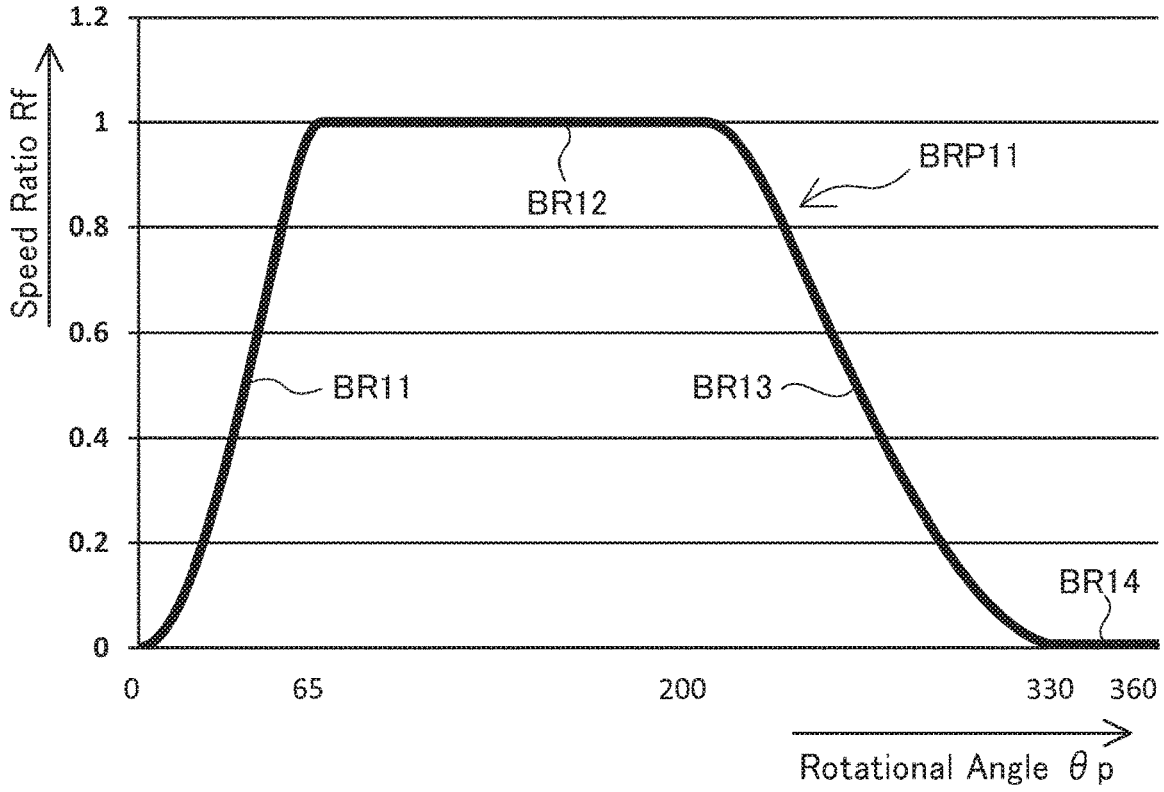
FIG. 9A is a chart depicting one example of a basic roller drive pattern BRP11 for the one-sheet feeding mode.
Figure 9B:
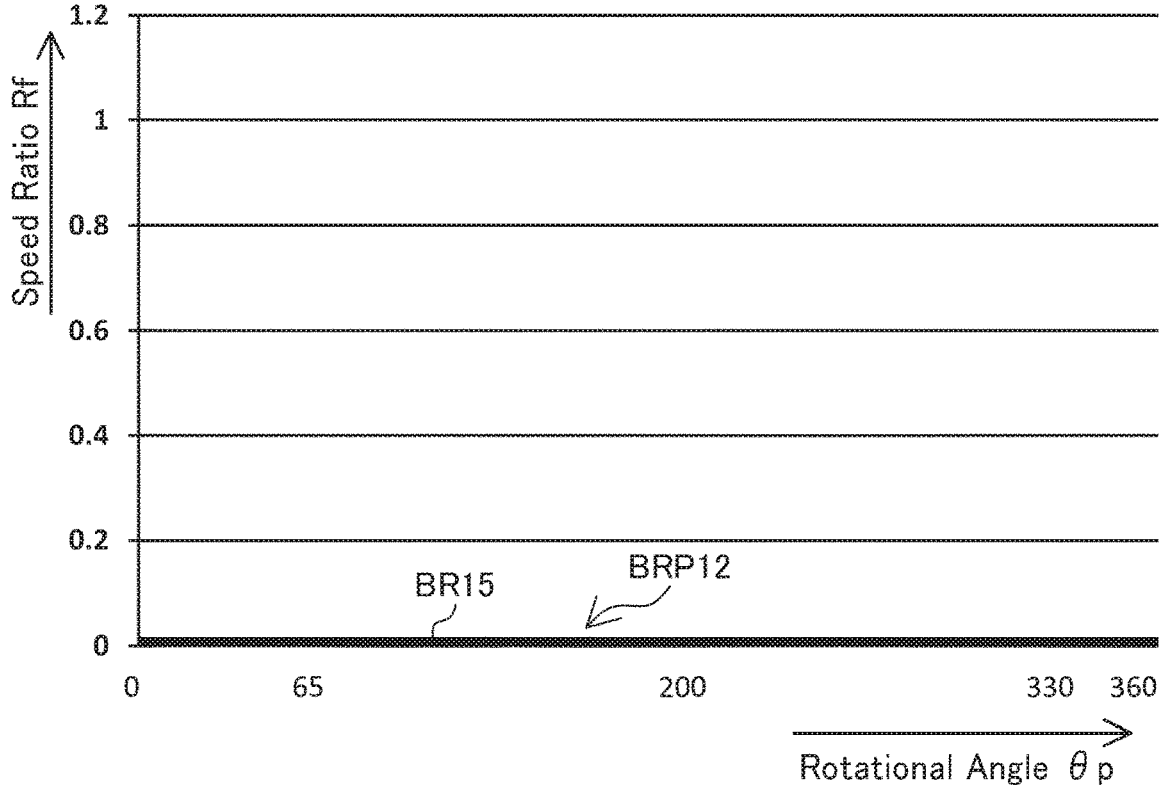
FIG. 9B is a chart depicting one example of another basic roller drive pattern BRP12 for the one-sheet feeding mode.
Figure 10A:
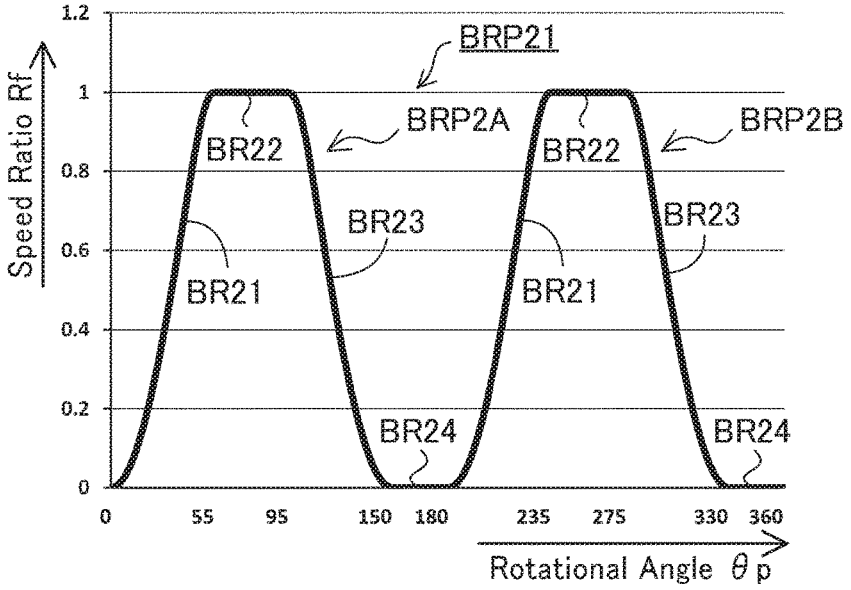
FIG. 10A is a chart depicting one example of a basic roller drive pattern BRP21 for the two-sheet feeding mode.
Figure 10B:
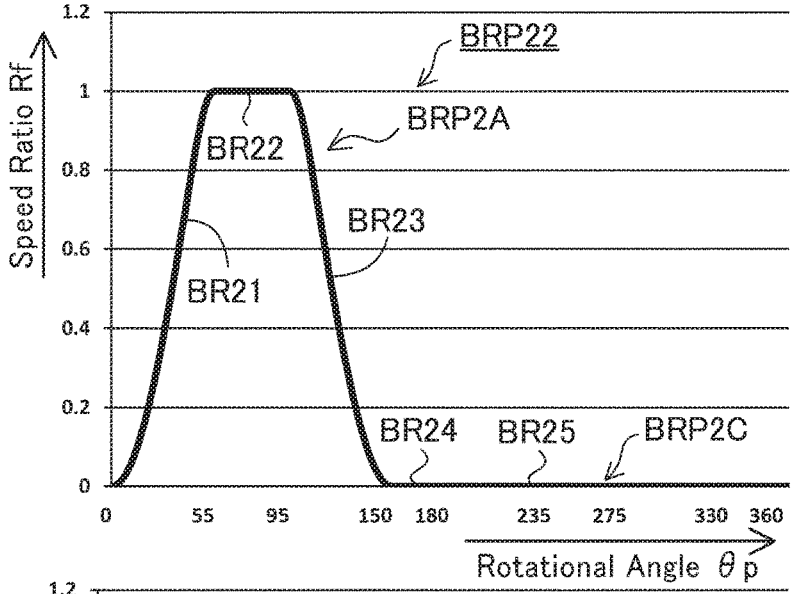
FIG. 10B is a chart depicting one example of another basic roller drive pattern BRP22 for the two-sheet feeding mode.
Figure 10C:
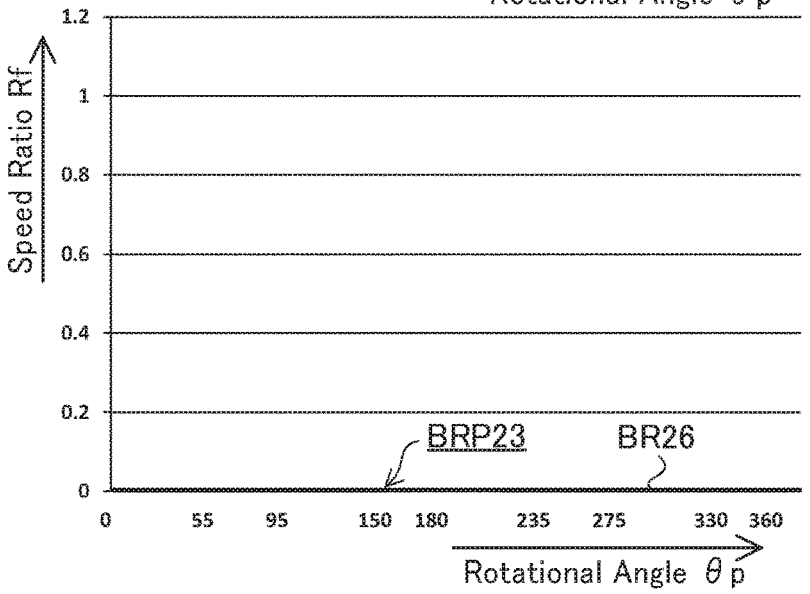
FIG. 10C is a chart depicting one example of yet another basic roller drive pattern BRP23 for the two-sheet feeding mode.

With reference to FIGS. 9A and 9B and FIGS. 10A to 10C, the basic roller drive patterns BRP11, BRP12, BRP21 to BRP23 will be described. Each of the basic roller drive patterns is a pattern serving as a basis for creating a roller speed control pattern RT. FIGS. 9A and 9B depict, respectively, one example of a basic roller drive pattern BRP11 for the one-sheet feeding mode, and one example of a full cycle-stop basic roller drive pattern BRP12 for the one-sheet feeding mode, in this embodiment. FIGS. 10A, 10B and 10C depict, respectively, one example of a basic roller drive pattern BRP21 for the two-sheet feeding mode, one example of a half cycle-stop basic roller drive pattern BRP22 for the two-sheet feeding mode, one example of a full cycle-stop basic roller drive pattern BRP23 for the two-sheet feeding mode, in this embodiment. In FIGS. 9A and 9B and FIGS. 10A to 10C, the horizontal axis represents the rotational angle θp of each of the printing cylinders of the printer 2, and the vertical axis represents a speed ratio Rf of a circumferential speed Vr of each of the feeding rollers to a circumferential speed Vp of each of the printing cylinders.

(Basic Roller Drive Pattern BRP11 for One-Sheet Feeding Mode)

As depicted in FIG. 9A, the basic roller drive pattern BRP11 comprises: an acceleration region BR11 in which the rotational angle θp changes from 0 degree to 65 degrees; a constant-speed region BR12 in which the rotational angle θp changes from 65 degree to 200 degrees; a deceleration region BR13 in which the rotational angle θp changes from 200 degree to 330 degrees; and a stop region BR14 in which the rotational angle θp changes from 330 degree to 360 degrees.

A rate of change of speed per unit time (speed change rate per unit time) at which each of the roller motors 90, 91, 102, 103 is rotationally accelerated in the acceleration region BR11 is preliminarily set based on a maximum speed change rate per unit time for each of the roller motors, so as to allow an amount of change of the rotational angle θp in the acceleration region BR11 to be minimized. In particular, the speed change rate per unit time in acceleration region BR11 needs to be set such that the circumferential speed Vr of each of the feeding rollers is accelerated from the stopped state to a value equal to the circumferential speed Vp of each of the printing cylinders, within a time period after a leading edge of a corrugated paperboard sheet SH passes through the front gate 21 through until the corrugated paperboard sheet SH is fed by a distance LF depicted in FIG. 1. The distance LF is a distance between the front gate 2 and a position of a nip between the feed rolls 23, 24 in the feeding direction FD.

A maximum time period during which one corrugated paperboard sheet SH is fed by the feeding rollers 124 to 127, in a processing cycle where each of the printing cylinders is rotated 360 degrees, i.e., in a time period during which the rotational angle θp changes from 0 degree to 360 degrees, is a sum of a duration of the acceleration region BR11 and a duration of the constant-speed region BR12. Thus, an amount of change of the rotational angle θp in the acceleration region BR11 and the constant-speed region BR12 is preliminarily set based on a maximum sheet length processable by the corrugated paperboard box making machine 1 under the condition that the feeding mode is set to the one-sheet feeding mode. In the constant-speed region BR12, the circumferential speed Vp of each of the printing cylinders and the circumferential speed Vr of each of the feeding rollers need to become equal to each other and set to a value corresponding to the sheet feeding speed, i.e., the speed ratio Rf needs to be 1. In order to reliably stop the roller motors in the stop region BR 14, a rate of change of speed per unit time (speed change rate per unit time) at which each of the roller motors is rotationally decelerated in the deceleration region BR13 is set to be less than the speed change rate per unit time in the acceleration region BR11.

An upper surface of each of the grates 141 undergoes wear due to frictional contact with corrugated paperboard sheets SH. When the upper surface of the grate 141 is worn away, a height position of the upper surface of the grate 141 is lowered by a distance corresponding to an amount of the wear, and a timing at which a lower surface of a corrugated paperboard sheet SH comes into contact with the feeding rollers is changed according to the wear amount. In order to allow the corrugated paperboard sheet SH to reliably come into contact with the feeding rollers in the stopped state, at a start time point of the processing cycle, a duration of the stop region BR14 is preliminarily set by taking into account a predetermined allowable wear amount. In this embodiment, the allowable wear amount is set to 0.4 mm.

(Full Cycle-Stop Basic Roller Drive Pattern BRP12 for One-Sheet Feeding Mode)

In FIG. 9B, the full cycle-stop basic roller drive pattern BRP12 is formed of a stop region BR15 in which the rotational angle θp changes from 0 degree to 360 degrees. In the stop region BR15, the speed ratio Rf is "0".

(Basic Roller Drive Pattern BRP21 for Two-Sheet Feeding Mode)

As depicted in FIG. 10A, the basic roller drive pattern BRP21 is formed of two basic roller drive sub-patterns BRP2A, BRP2B each having the same pattern shape. The basic roller drive sub-pattern BRP2A is generated in a time period during which the rotational angle θp changes from 0 degree to 180 degrees, and the basic roller drive sub-pattern BRP2B is generated in a time period during which the rotational angle θp changes from 180 degree to 360 degrees. The basic roller drive sub-pattern BRP2A comprises: an acceleration region BR21 in which the rotational angle θp changes from 0 degree to 55 degrees; a constant-speed region BR22 in which the rotational angle θp changes from 55 degree to 95 degrees; a deceleration region BR23 in which the rotational angle θp changes from 95 degree to 150 degrees; and a stop region BR24 in which the rotational angle θp changes from 150 degree to 180 degrees. The basic roller drive sub-pattern BRP2B comprises: an acceleration region BR21 in which the rotational angle θp changes from 180 degree to 235 degrees; a constant-speed region BR22 in which the rotational angle θp changes from 235 degree to 275 degrees; a deceleration region BR23 in which the rotational angle θp changes from 275 degree to 330 degrees; and a stop region BR24 in which the rotational angle θp changes from 330 degree to 360 degrees.

A speed change rate per unit time at which each of the roller motors 90, 91, 102, 103 is rotationally accelerated in the acceleration region BR21 is preliminarily set based on a maximum speed change rate per unit time for each of the roller motors, so as to allow an amount of change of the rotational angle θp in the acceleration region BR21 to be minimized. Specifically, it is preliminarily set to be greater than the speed change rate per unit time in the acceleration region BR11. In particular, the speed change rate per unit time in acceleration region BR21 needs to be set such that the circumferential speed Vr of each of the feeding rollers is accelerated from the stopped state to a value equal to the circumferential speed Vp of each of the printing cylinders, within a time period after a leading edge of a corrugated paperboard sheet SH passes through the front gate 21 through until the corrugated paperboard sheet SH is fed by the distance LF depicted in FIG. 1.

Two corrugated paperboard sheets SH need to be sequentially fed in a processing cycle where each of the printing cylinders is rotated 360 degrees, i.e., in a time period during which the rotational angle θp changes from 0 degree to 360 degrees. Thus, a maximum time period during which each of two corrugated paperboard sheets SH is fed by the feeding rollers 124 to 127 is a sum of a duration of the acceleration region BR21 and a duration of the constant-speed region BR22, so that an amount of change of the rotational angle θp in the acceleration region BR21 and the constant-speed region BR22 is preliminarily set based on a maximum sheet length processable by the corrugated paperboard box making machine 1 under the condition that the feeding mode is set to the two-sheet feeding mode. In the constant-speed region BR22, the circumferential speed Vp of each of the printing cylinders and the circumferential speed Vr of each of the feeding rollers need to become equal to each other and set to a value corresponding to the sheet feeding speed, i.e., the speed ratio Rf needs to be 1. In order to reliably stop the roller motors in the stop region BR 24, a speed change rate per unit time at which each of the roller motors is rotationally decelerated in the deceleration region BR23 is set to be less than the speed change rate per unit time in the acceleration region BR21.

In order to enable the corrugated paperboard sheet SH to reliably come into contact with the feeding rollers in the stopped state, at a start time point of the processing cycle, a duration of the stop region BR24 is preliminarily set by taking into account the predetermined allowable wear amount.

The basic roller drive sub-pattern BRP2B has the same pattern shape as that of the basic roller drive sub-pattern BRP2A, as depicted in FIG. 10A. Thus, detailed description thereof will be omitted.

(Half Cycle-Stop Basic Roller Drive Pattern BRP22 for Two-Sheet Feeding Mode)

In FIG. 10B, the half cycle-stop basic roller drive pattern BRP22 comprises a basic roller drive sub-pattern BRP2A, and a stop sub-pattern BRP2C. The basic roller drive sub-pattern BRP2A of the half cycle-stop basic roller drive pattern BRP 22 is the same as the basic roller drive sub-pattern BRP2A of the basic roller drive pattern BRP21. Thus, detailed description thereof will be omitted. The stop sub-pattern BRP2C is formed of a stop region BR25 in which the rotational angle θp changes from 180 degree to 360 degrees. In the stop region BR25, the speed ratio Rf is "0".

(Full Cycle-Stop Basic Roller Drive Pattern BRP23 for Two-Sheet Feeding Mode)

In FIG. 10B, the full cycle-stop basic roller drive pattern BRP23 is formed of a stop region BR26 in which the rotational angle θp changes from 0 degree to 360 degrees. In the stop region BR26, the speed ratio Rf is "0".

<Basic Grate Raising-Lowering Pattern>

With reference to FIGS. 11 to 18, the basic grate raising-lowering patterns BGS1, BGL1, BGS2, BGL2 will be described. Each of these basic grate raising-lowering patterns is a pattern serving as a basis for creating a grate raising-lowering speed control pattern GT. FIGS. 11 to 14 depict, respectively, one example of each of the basic grate raising-lowering patterns BGS1, BGL1 conforming, respectively, to a minimum sheet length and a minimum sheet length in the one-sheet feeding mode, and one example of each of the basic grate raising-lowering patterns BGS2, BGL2 conforming, respectively, to a minimum sheet length and a maximum sheet length in the two-sheet feeding mode, in this embodiment. For example, in the one-sheet feeding mode, the minimum sheet length is 280 mm, and the maximum sheet length is 1160 mm. On the other hand, in the two-sheet feeding mode, the minimum sheet length is 280 mm, and the maximum sheet length is 500 mm. In FIGS. 11, 13, 15 and 17, the horizontal axis represents the rotational angle θp of each of the printing cylinders of the printer 3, and the left vertical axis and the right vertical axis represent, respectively, a speed ratio Rg of an angular speed ωg of the raising-lowering drive shaft 170 to an angular speed ωp of each of the printing cylinders, and a rotational angle θg of the raising-lowering drive shaft 170. Each of four curves AS1, AL1, AS2, AL2 indicated by the broken lines in FIGS. 11, 13, 15 and 17 represents a change in the rotational angle θg of the raising-lowering drive shaft 170. In FIGS. 12, 14, 16 and 18, the horizontal axis represents the rotational angle θp of each of the printing cylinders of the printer 3, and the left vertical axis and the right vertical axis represent the speed ratio Rg of the angular speed ωg of the raising-lowering drive shaft 170 to the angular speed ωp of each of the printing cylinders, and a height position Hg of the upper surface of each of the grates 141 on the basis of an upper surface of the table 20, respectively. Each of four curves HS1, HL1, HS2, HL2 indicated by the broken lines in FIGS. 12, 14, 16 and 18 represents a change in the height position Hg of the upper surface of each of the grates 141. In this embodiment, each of the grates 141 is raised and lowered between an uppermost position located above the upper surface of the table 20 by 2 mm, and a lowermost position located below the upper surface of the table 20 by 2 mm. Each of the feeding rollers 124 to 127 is disposed such that an uppermost point of an outer peripheral surface thereof is located above the upper surface of the table 20 by 0.9 mm. A position PR indicated by the broken line in FIGS. 12, 14, 16 and 18 presents a position of the uppermost point of the outer peripheral surface of each of the feeding rollers.

(Basic Grate Raising-Lowering Pattern BGS1 Set in Conformity to Minimum Sheet Length in One-Sheet Feeding Mode)

Figure 11:
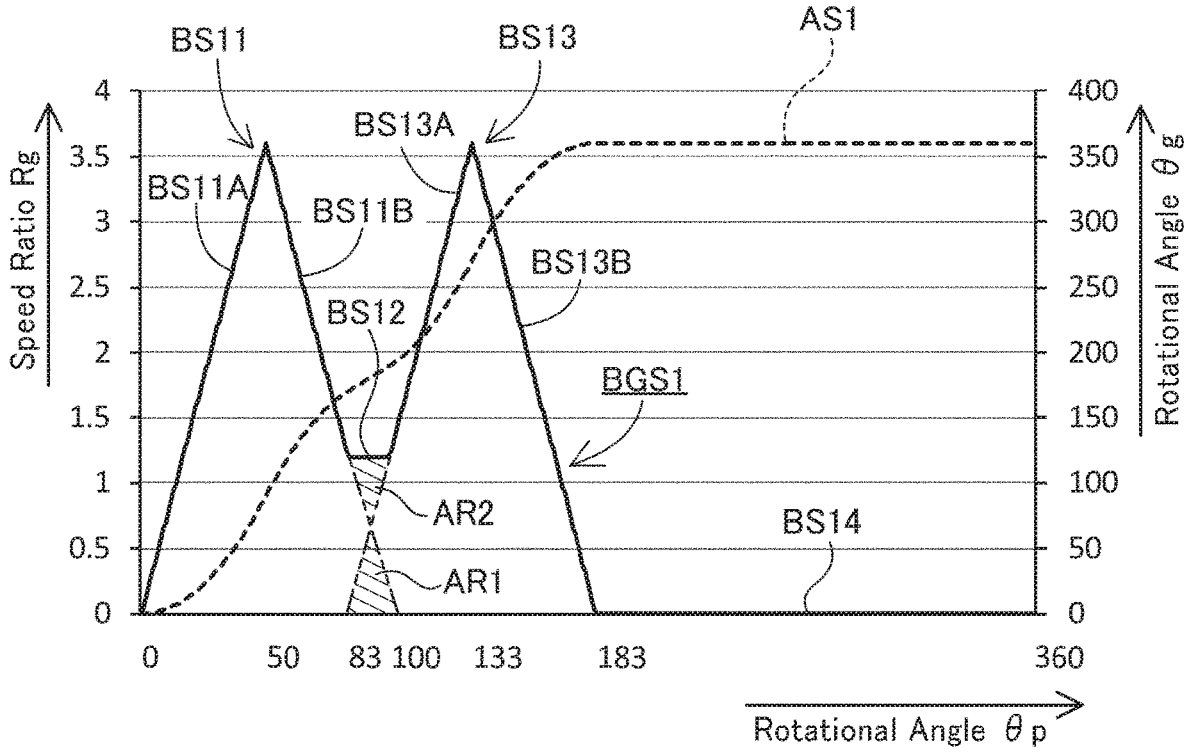
FIG. 11 is a chart depicting one example of a basic grate raising-lowering pattern BGS1 conforming to a minimum sheet length in the one-sheet feeding mode, and a curve AS1 representing a change in rotational angle θg of a raising-lowering drive shaft.
Figure 12:
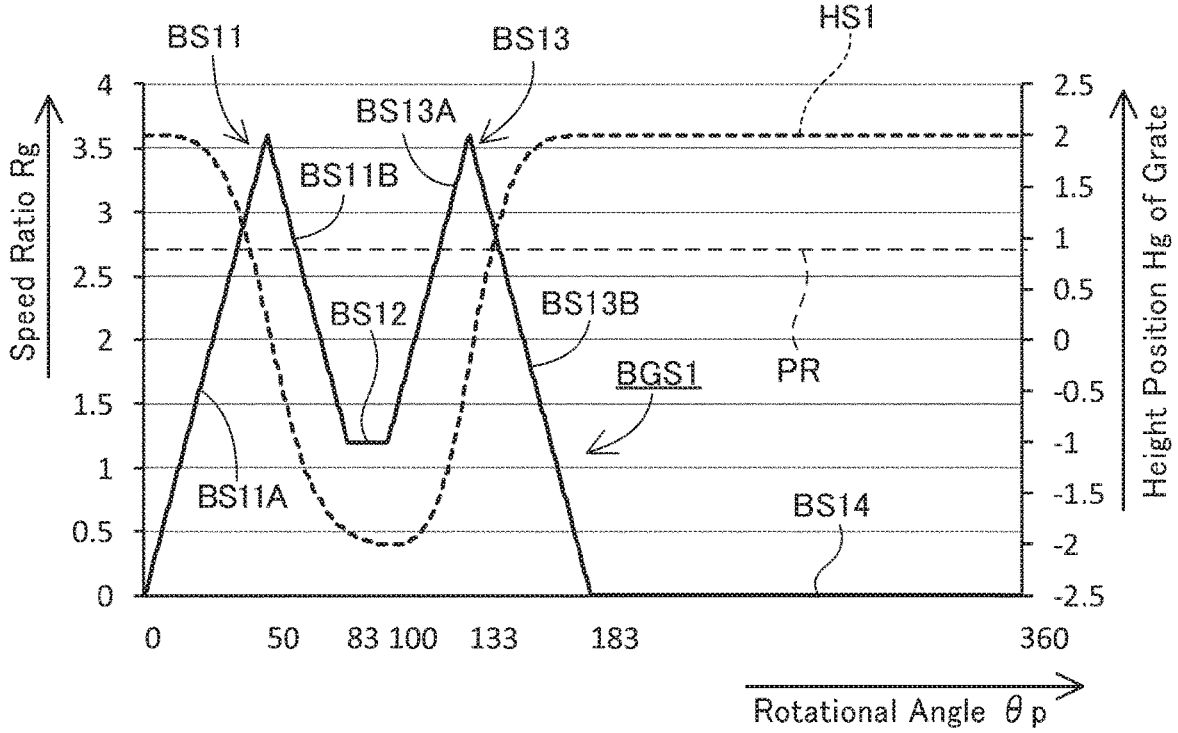
FIG. 12 is a chart depicting one example of the basic grate raising-lowering pattern BGS1 conforming to the minimum sheet length in the one-sheet feeding mode, and a curve HS1 representing a change in height position Hg of an upper surface of a grate.

With reference to FIGS. 11 and 12, the basic grate raising-lowering pattern BGS1 will be described. The basic grate raising-lowering pattern BGS1 is one of two basic grate raising-lowering patterns serving as a basis for creating a grate raising-lowering speed control pattern GT for the one-sheet feeding pattern. FIGS. 11 and 12 is one example of the basic grate raising-lowering pattern BGS1 preliminarily set in conformity to the minimum sheet length in the one-sheet feeding pattern, in the embodiment.

As depicted in FIG. 11, the basic grate raising-lowering pattern BGS1 comprises: a variable-speed lowering region BS11 in which the rotational angle θp changes from 0 degree to 83 degrees; a lower-position control region BS12 in which the rotational angle θp changes from 83 degree to 100 degrees; a variable-speed raising region BS13 in which the rotational angle θp changes from 100 degree to 183 degrees; and an upper-position control region BS14 in which the rotational angle θp changes from 183 degree to 360 degrees. The variable-speed lowering region BS11 is composed of an acceleration sub-region BS11A and a deceleration sub-region BS11B. The variable-speed raising region BS13 is composed of an acceleration sub-region BS13A and a deceleration sub-region BS13B. In this embodiment, a speed change rate per unit time at which the raising-lowering motor 80 is accelerated in the acceleration sub-regions BS11A, BS13A is set to be equal to a speed change rate per unit time at which the raising-lowering motor 80 is decelerated in the deceleration sub-regions BS11B, BS13B. The variable-speed lowering region BS11 and the variable-speed raising region BS13 are arranged at a time interval conforming to the minimum sheet length, in a direction causing an increase in the rotational angle θp, i.e., in the arrowed direction along the horizontal axis in FIG. 11.

The minimum sheet length can be set to a smaller value, as an amount of change of the rotational angle θp in the acceleration sub-regions BS11A, BS13A and the deceleration sub-regions BS11B, BS13B is set to a smaller value as much as possible. Thus, each of the speed change rate per unit time in the acceleration sub-regions BS11A, BS13A and the speed change rate per unit time in the deceleration sub-regions BS11B, BS13B is preliminarily set based on a maximum speed change rate per unit time for the raising-lowering motor 80.

In FIG. 11, an area AR1 is an area of a shaded region surrounded by an extension line of an oblique line indicative of the deceleration sub-region BS11B, an extension line of an oblique line representing the acceleration sub-region BS13A, and the horizontal axis on which the speed ratio Rg is 0. Further, an area AR2 is an area of a shaded area surrounded by the above two extension lines, and a horizontal line indicative of the lower-position control region BS12. The lower-position control region BS12 is set such that the two areas AR1, AR2 become equal to each other.

As depicted in FIG. 11, the rotational angle θg of the raising-lowering drive shaft 170 is increased to reach 360 degrees when the rotational angle θp reaches 183 degrees, and subsequently kept at 360 degrees in the upper-position control region B S14. As depicted in FIG. 12, the height position Hg of the upper surface of each of the grates 141 becomes lower than the position PR in mid-course of the acceleration sub-region BS11A, and then becomes higher than the position PR in mid-course of the deceleration sub-region BS13B.

(Basic Grate Raising-Lowering Pattern BGL1 Set in Conformity to Maximum Sheet Length in One-Sheet Feeding Mode)

Figure 13:
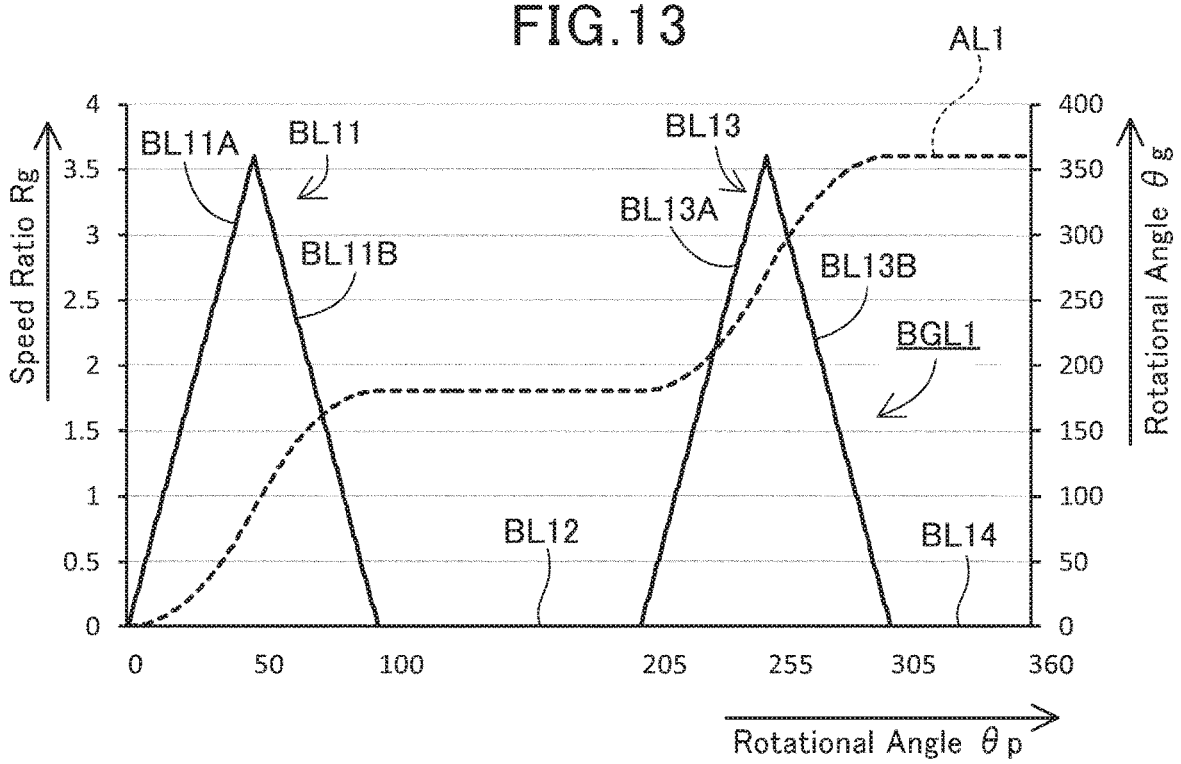
FIG. 13 is a chart depicting one example of a basic grate raising-lowering pattern BGL1 conforming to a maximum sheet length in the one-sheet feeding mode, and a curve AL1 representing a change in rotational angle θg of the raising-lowering drive shaft.
Figure 14:
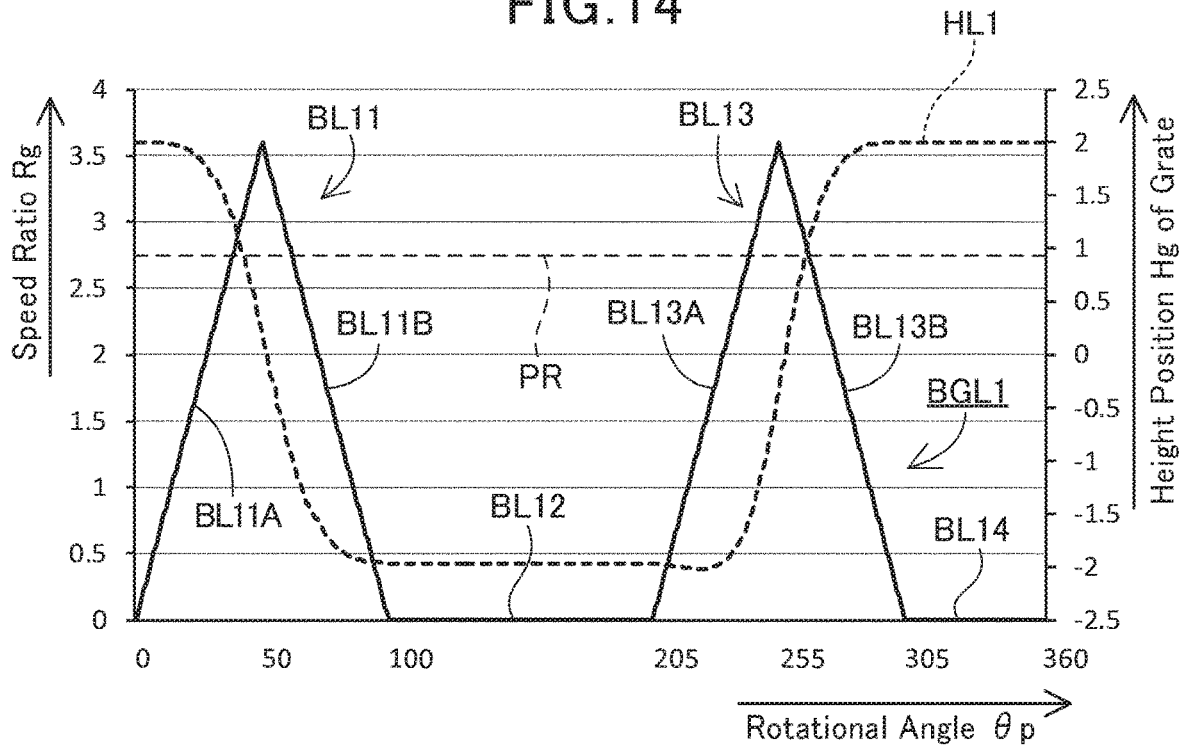
FIG. 14 is a chart depicting one example of the basic grate raising-lowering pattern BGL1 conforming to the maximum sheet length in the one-sheet feeding mode, and a curve HL1 representing a change in height position Hg of the upper surface of the grate.

With reference to FIGS. 13 and 14, the basic grate raising-lowering pattern BGL1 will be described. The basic grate raising-lowering pattern BGL1 is the remaining one of the two basic grate raising-lowering patterns serving as a basis for creating a grate raising-lowering speed control pattern GT for the one-sheet feeding pattern. FIGS. 13 and 14 is one example of the basic grate raising-lowering pattern BGL1 preliminarily set in conformity to the maximum sheet length in the one-sheet feeding pattern, in the embodiment.

As depicted in FIG. 13, the basic grate raising-lowering pattern BGL1 comprises: a variable-speed lowering region BL11 in which the rotational angle θp changes from 0 degree to 100 degrees; a lower-position control region BL12 in which the rotational angle θp changes from 100 degree to 205 degrees; a variable-speed raising region BL13 in which the rotational angle θp changes from 205 degree to 305 degrees; and an upper-position control region BL14 in which the rotational angle θp changes from 305 degree to 360 degrees. The variable-speed lowering region BL11 is composed of an acceleration sub-region BL11A and a deceleration sub-region BL11B. The variable-speed raising region BL13 is composed of an acceleration sub-region BL13A and a deceleration sub-region BL13B. In this embodiment, a speed change rate per unit time at which the raising-lowering motor 80 is accelerated in the acceleration sub-regions BL11A, BL13A is set to be equal to a speed change rate per unit time at which the raising-lowering motor 80 is decelerated in the deceleration sub-regions BL11B, BL13B. Further, each of the speed change rate per unit time in the acceleration sub-regions BL11A, BL13A and the speed change rate per unit time in the deceleration sub-regions BL11B, BL13B is set to be equal to each of the speed change rate per unit time in the acceleration sub-regions BS11A, BS13A and the speed change rate per unit time in the deceleration sub-regions BS11B, BS13B. The variable-speed lowering region BS11 and the variable-speed raising region BS13 are arranged at a time interval conforming to the maximum sheet length, in a direction causing an increase in the rotational angle θp, i.e., in the allowed direction along the horizontal axis in FIG. 13.

The maximum sheet length can be set to a larger value, as an amount of change of the rotational angle θp in the acceleration sub-regions BL11A, BL13A and the deceleration sub-regions BL11B, BL13B is set to a smaller value as much as possible. Thus, each of the speed change rate per unit time in the acceleration sub-regions BL11A, BL13A and the speed change rate per unit time in the deceleration sub-regions BL11B, BL13B is preliminarily set based on the maximum speed change rate per unit time for the raising-lowering motor 80.

As depicted in FIG. 13, the rotational angle θg of the raising-lowering drive shaft 170 is increased to reach 360 degrees when the rotational angle θp reaches 305 degrees, and subsequently kept at 360 degrees in the upper-position control region BL14. As depicted in FIG. 14, the height position Hg of the upper surface of each of the grates 141 becomes lower than the position PR in mid-course of the acceleration sub-region BL11A, and then becomes higher than the position PR in mid-course of the deceleration sub-region BL13B.

(Basic Grate Raising-Lowering Pattern BGS2 Set in Conformity to Minimum Sheet Length in Two-Sheet Feeding Mode)

Figure 15:
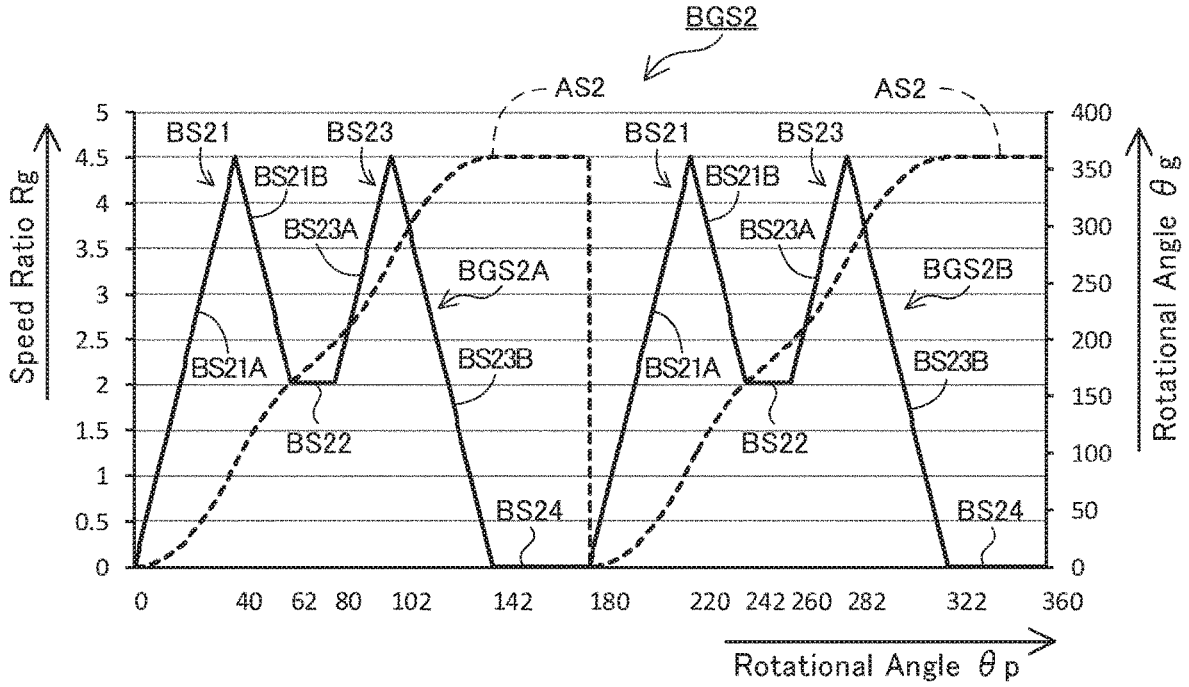
FIG. 15 is a chart depicting one example of a basic grate raising-lowering pattern BGS2 conforming to a minimum sheet length in the two-sheet feeding mode, and a curve AS2 representing a change in rotational angle θg of the raising-lowering drive shaft.
Figure 16:
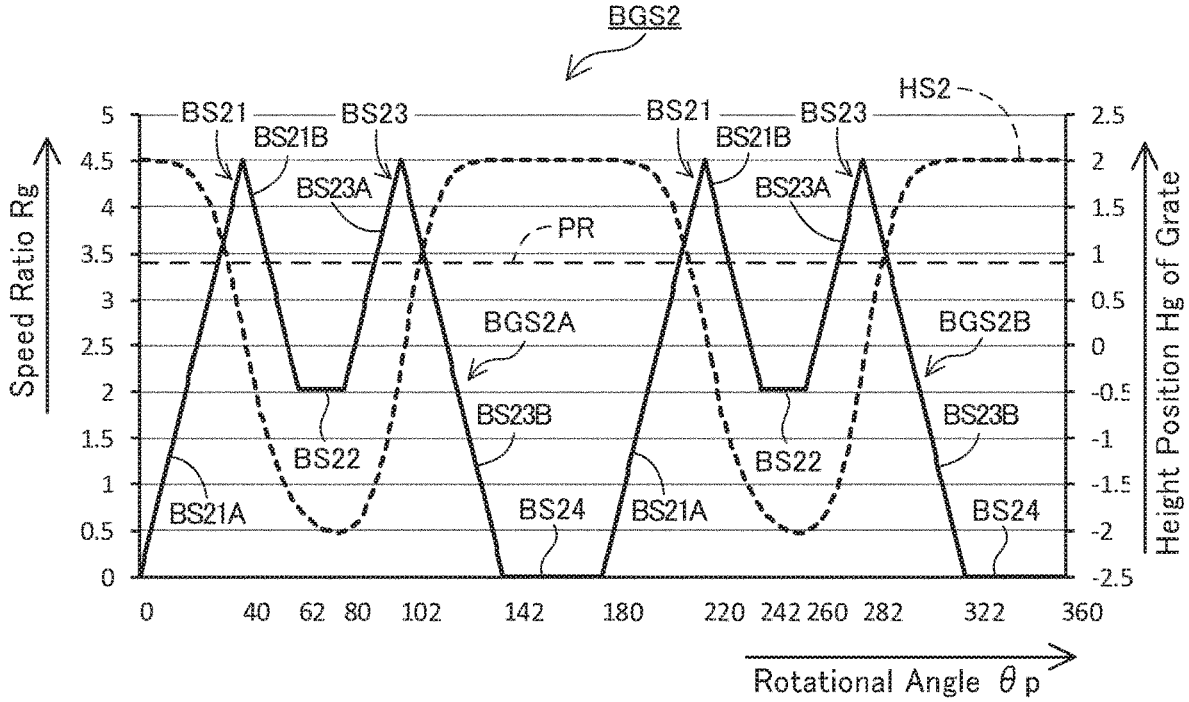
FIG. 16 is a chart depicting one example of the basic grate raising-lowering pattern BGS2 conforming to the minimum sheet length in the two-sheet feeding mode, and a curve HS2 representing a change in height position Hg of the upper surface of the grate.

With reference to FIGS. 15 and 16, the basic grate raising-lowering pattern BGS2 will be described. The basic grate raising-lowering pattern BGS2 is one of two basic grate raising-lowering patterns serving as a basis for creating a grate raising-lowering speed control pattern GT for the two-sheet feeding pattern. FIGS. 15 and 16 is one example of the basic grate raising-lowering pattern BGS2 preliminarily set in conformity to the minimum sheet length in the two-sheet feeding pattern, in the embodiment.

As depicted in FIG. 15, the basic grate raising-lowering pattern BGS2 is formed of two basic grate raising-lowering sub-patterns BGS2A, BGS2B each having the same pattern shape. The basic grate raising-lowering sub-pattern BGS2A is generated in a time period during which the rotational angle θp changes from 0 degree to 180 degrees, and the basic grate raising-lowering sub-pattern BGS2B is generated in a time period during which the rotational angle θp changes from 180 degree to 360 degrees. The basic grate raising-lowering sub-pattern BGS2A comprises: a variable-speed lowering region BS21 in which the rotational angle θp changes from 0 degree to 62 degrees; a lower-position control region BS22 in which the rotational angle θp changes from 62 degree to 80 degrees; a variable-speed raising region BS23 in which the rotational angle θp changes from 80 degree to 142 degrees; and an upper-position control region BS24 in which the rotational angle θp changes from 142 degree to 180 degrees. The basic grate raising-lowering sub-pattern BGS2B comprises: a variable-speed lowering region BS21 in which the rotational angle θp changes from 180 degree to 242 degrees; a lower-position control region BS22 in which the rotational angle θp changes from 242 degree to 260 degrees; a variable-speed raising region BS23 in which the rotational angle θp changes from 260 degree to 322 degrees; and an upper-position control region BS24 in which the rotational angle θp changes from 322 degree to 360 degrees.

Each of the variable-speed lowering regions BS21 of the basic grate raising-lowering sub-patterns BGS2A, BGS2B is composed of an acceleration sub-region BS21A and a deceleration sub-region BS21B. Similarly, each of the variable-speed raising regions BS23 of the basic grate raising-lowering sub-patterns BGS2A, BGS2B is composed of an acceleration sub-region BS23A and a deceleration sub-region BS23B. In this embodiment, a speed change rate per unit time at which the raising-lowering motor 80 is accelerated in the acceleration sub-regions BS21A, BS23A is set to be equal to a speed change rate per unit time at which the raising-lowering motor 80 is decelerated in the deceleration sub-regions BS21B, BS23B. The variable-speed lowering region BS21 and the variable-speed raising region BS23 in each of the basic grate raising-lowering sub-patterns BGS2A, BGS2B are arranged at a time interval conforming to the minimum sheet length, in a direction causing an increase in the rotational angle θp, i.e., in the arrowed direction along the horizontal axis in FIG. 15.

The minimum sheet length can be set to a smaller value, as an amount of change of the rotational angle θp in the acceleration sub-regions BS21A, BS23A and the deceleration sub-regions BS21B, BS23B is set to a smaller value as much as possible. Thus, each of the speed change rate per unit time in the acceleration sub-regions BS21A, BS23A and the speed change rate per unit time in the deceleration sub-regions BS21B, BS23B is preliminarily set based on the maximum speed change rate per unit time for the raising-lowering motor 80. The speed change rate per unit time in the acceleration sub-regions and the deceleration sub-regions, and a maximum value of the speed ratio Rg in the acceleration sub-regions, are set such that a total area of two regions surrounded by two polygonal lines indicative of respective shapes of the basic grate raising-lowering sub-patterns BGS2A, BGS2B and the horizontal axis representing the rotational angle θp in FIG. 15 becomes equal to an area of a region surrounded by a polygonal line indicative of a shape of the basic grate raising-lowering pattern BGS1 and the horizontal axis representing the rotational angle θp in FIG. 11. That is, each of the speed change rate per unit time in the acceleration sub-regions BS21A, BS23A and the speed change rate per unit time in the deceleration sub-regions BS21B, BS23B is set to be greater than each of the speed change rate per unit time in the acceleration sub-regions BS11A, BS13A and the speed change rate per unit time in the deceleration sub-regions BS11B, BS13B in the basic grate raising-lowering pattern BGS1. Further, the maximum value of the speed ratio Rg in the acceleration sub-regions BS21A, BS23A is set to be greater than a maximum value of the speed ratio Rg in the acceleration sub-regions BS11A, BS13A.

The lower-position control region BS22 is set in the same manner as that for the lower-position control region BS12 of the basic grate raising-lowering pattern BGS 1 depicted in FIG. 11. As depicted in FIG. 15, the rotational angle θg of the raising-lowering drive shaft 170 is increased to reach 360 degrees when the rotational angle θp reaches 142 degrees and when the rotational angle θp reaches 322 degrees, and subsequently kept at 360 degrees in the upper-position control region BS24. As depicted in FIG. 16, the height position Hg of the upper surface of each of the grates 141 becomes lower than the position PR in mid-course of the acceleration sub-region BS21A, and then becomes higher than the position PR in mid-course of the deceleration sub-region BS23B.

The basic grate raising-lowering sub-pattern BGS2B has the same pattern shape as that of the basic grate raising-lowering sub-pattern BGS2A, as depicted in FIG. 15. Thus, detailed description thereof will be omitted.

(Basic Grate Raising-Lowering Pattern BGL2 Set in Conformity to Maximum Sheet Length in Two-Sheet Feeding Mode)

Figure 17:
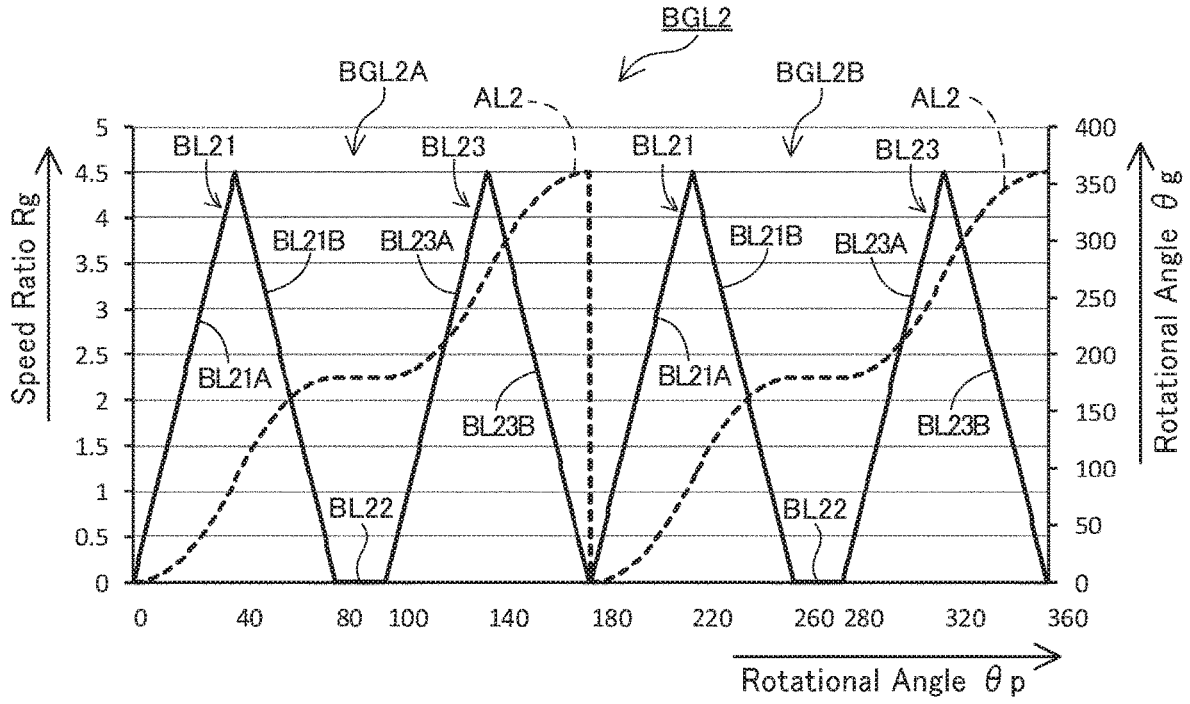
FIG. 17 is a chart depicting one example of a basic grate raising-lowering pattern BGL2 conforming to a maximum sheet length in the two-sheet feeding mode, and a curve AL2 representing a change in rotational angle θg of the raising-lowering drive shaft.
Figure 18:
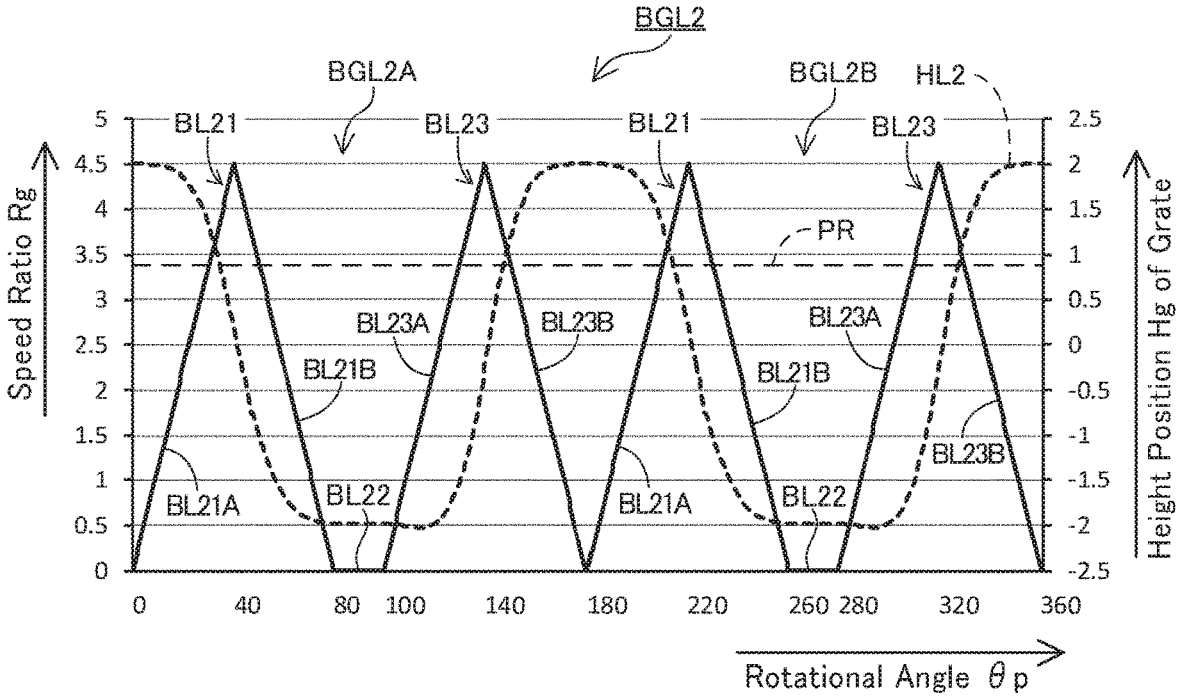
FIG. 18 is a chart depicting one example of the basic grate raising-lowering pattern BGL2 conforming to the maximum sheet length in the two-sheet feeding mode, and a curve HL2 representing a change in height position Hg of the upper surface of the grate.

With reference to FIGS. 17 and 18, the basic grate raising-lowering pattern BGL2 will be described. The basic grate raising-lowering pattern BGL2 is the remaining one of the two basic grate raising-lowering patterns serving as a basis for creating a raising-lowering speed control pattern GT for the two-sheet feeding pattern. FIGS. 17 and 18 is one example of the basic grate raising-lowering pattern BGL2 preliminarily set in conformity to the maximum sheet length in the two-sheet feeding pattern, in the embodiment.

As depicted in FIG. 17, the basic grate raising-lowering pattern BGL2 is formed of two basic grate raising-lowering sub-patterns BGL2A, BGL2B each having the same pattern shape. The basic grate raising-lowering sub-pattern BGL2A is generated in a time period during which the rotational angle θp changes from 0 degree to 180 degrees, and the basic grate raising-lowering sub-pattern BGL2B is generated in a time period during which the rotational angle θp changes from 180 degree to 360 degrees. The basic grate raising-lowering sub-pattern BGL2A comprises: a variable-speed lowering region BL21 in which the rotational angle θp changes from 0 degree to 80 degrees; a lower-position control region BL22 in which the rotational angle θp changes from 80 degree to 100 degrees; and a variable-speed raising region BL23 in which the rotational angle θp changes from 100 degree to 180 degrees. The basic grate raising-lowering sub-pattern BGL2B comprises: a variable-speed lowering region BL21 in which the rotational angle θp changes from 180 degree to 260 degrees; a lower-position control region BL22 in which the rotational angle θp changes from 260 degree to 280 degrees; and a variable-speed raising region BL23 in which the rotational angle θp changes from 280 degree to 360 degrees. Each of the basic grate raising-lowering sub-patterns BGL2A, BGL2B is devoid of a region corresponding to the upper-position control region BL14 of the basic grate raising-lowering pattern BGL1.

Each of the variable-speed lowering regions BL21 of the basic grate raising-lowering sub-patterns BGL2A, BGL2B is composed of an acceleration sub-region BL21A and a deceleration sub-region BL21B. Similarly, each of the variable-speed raising regions BL23 of the basic grate raising-lowering sub-patterns BGL2A, BGL2B is composed of an acceleration sub-region BL23A and a deceleration sub-region BL23B. In this embodiment, a speed change rate per unit time at which the raising-lowering motor 80 is accelerated in the acceleration sub-regions BL21A, BL23A is set to be equal to a speed change rate per unit time at which the raising-lowering motor 80 is decelerated in the deceleration sub-regions BL21B, BL23B. The variable-speed lowering region BL21 and the variable-speed raising region BL23 in each of the basic grate raising-lowering sub-patterns BGL2A, BGL2B are arranged at a time interval conforming to the maximum sheet length, in a direction causing an increase in the rotational angle θp, i.e., in the arrowed direction along the horizontal axis in FIG. 16.

The maximum sheet length can be set to a larger value, as an amount of change of the rotational angle θp in the acceleration sub-regions BL21A, BL23A and the deceleration sub-regions BL21B, BL23B is set to a smaller value as much as possible. Thus, each of the speed change rate per unit time in the acceleration sub-regions BL21A, BL23A and the speed change rate per unit time in the deceleration sub-regions BL21B, BL23B is preliminarily set based on the maximum speed change rate per unit time for the raising-lowering motor 80. The speed change rate per unit time in the acceleration sub-regions and the deceleration sub-regions, and a maximum value of the speed ratio Rg in the acceleration sub-regions, are set such that a total area of four regions surrounded by four polygonal lines indicative of respective shapes of the basic grate raising-lowering sub-patterns BGL2A, BGL2B and the horizontal axis representing the rotational angle θp in FIG. 17 becomes equal to a total area of two region surrounded by two polygonal lines indicative of a shape of the basic grate raising-lowering pattern BGS1 and the horizontal axis representing the rotational angle θp in FIG. 13. That is, each of the speed change rate per unit time in the acceleration sub-regions BL21A, BL23A and the speed change rate per unit time in the deceleration sub-regions BL21B, BL23B is set to be greater than each of the speed change rate per unit time in the acceleration sub-regions BL11A, BL13A and the speed change rate per unit time in the deceleration sub-regions BL11B, BL13B in the basic grate raising-lowering pattern BGL1. Further, the maximum value of the speed ratio Rg in the acceleration sub-regions BL21A, BL23A is set to be greater than a maximum value of the speed ratio Rg in the acceleration sub-regions BL11A, BL13A.

As depicted in FIG. 17, the rotational angle θg of the raising-lowering drive shaft 170 is increased to reach 360 degrees when the rotational angle θp reaches 180 degrees and when the rotational angle θp reaches 360 degrees. As depicted in FIG. 18, the height position Hg of the upper surface of each of the grates 141 becomes lower than the position PR in mid-course of the acceleration sub-region BL21A, and then becomes higher than the position PR in mid-course of the deceleration sub-region BL23B.

The basic grate raising-lowering sub-pattern BGL2B has the same pattern shape as that of the basic grate raising-lowering sub-pattern BGL2A, as depicted in FIG. 17. Thus, detailed description thereof will be omitted.

Operation and Functions of Embodiment

With reference to the drawings, an operation and functions of the corrugated paperboard box making machine 1 according to the above embodiment will be described below. As regards the operation and functions of the corrugated paperboard box making machine 1, a control operation pertaining to a feeding operation of the sheet feeding apparatus 2, a control operation of the printing control device 351 and a control operation of the counter-ejector control device 355 will be described. On the other hand, since respective control operations of the creaser-slotter control device 352, the die cutter control device 353 and the folder-gluer control device 354 are well known, detailed description thereof will be omitted.

When an operator manipulates the order termination button 342 or when a processing of a given number of corrugated paperboard sheets designated by a production plan has been completed in a previous order, the lower-level management device 310 sends a feeding termination instruction to the control devices 350 to 356. Subsequently, the lower-level management device 310 receives the order preparation instruction for directing preparation for execution of the next (new) order. The lower-level management device 310 sends the order preparation instruction containing specifications of the next order to each of the control devices 350 to 356.

<Feeding Control Processing>

Figure 19:
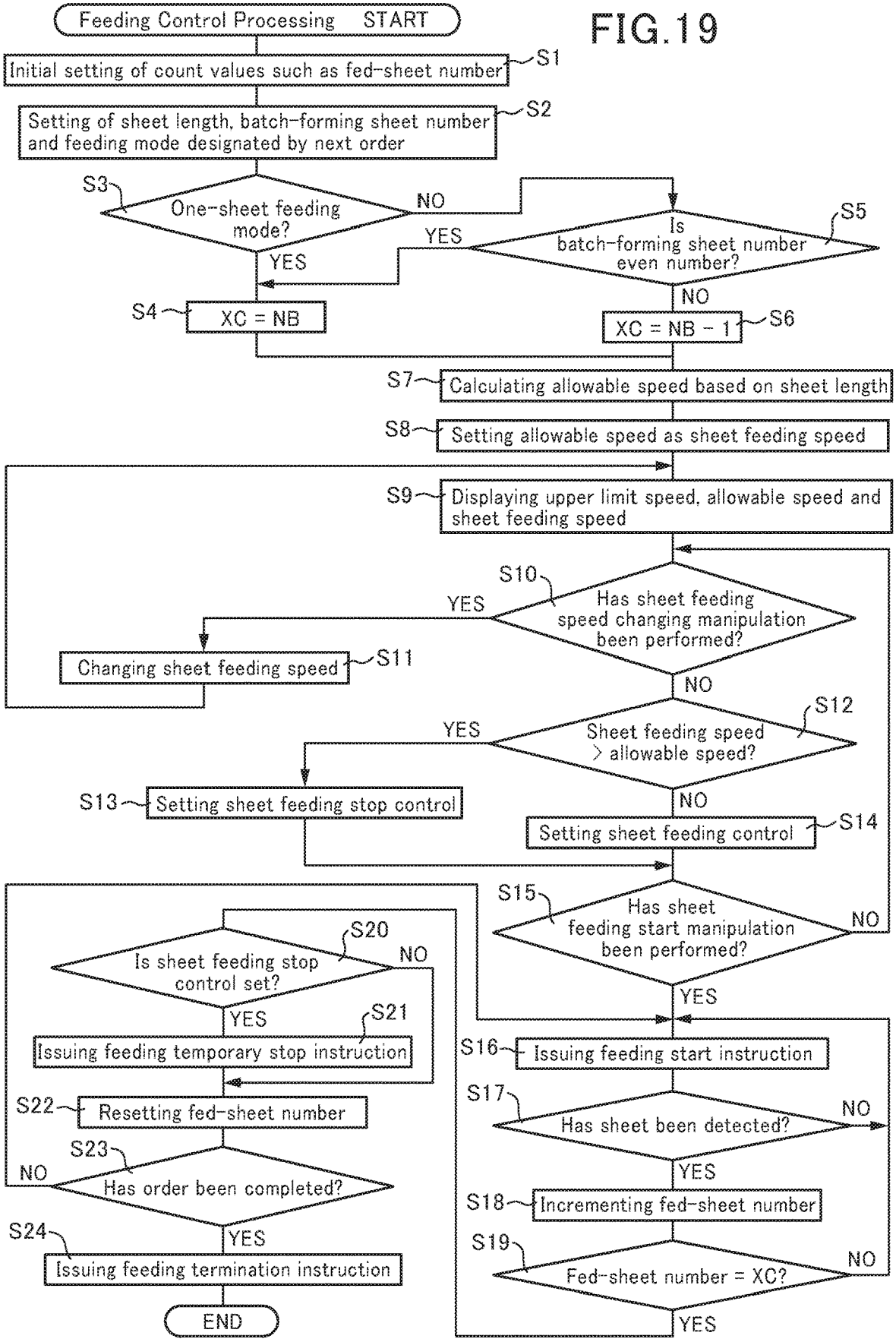
FIG. 19 is a flowchart depicting a feeding control processing to be executed by a lower-level management device.

In response to receiving the order preparation instruction from the upper-level management device 300, the lower-level management device 310 starts a program for executing a feeding control processing depicted in FIG. 19. Processings in steps S1 to S20 depicted in FIG. 19 are executed by the lower-level management device 310.

Count values such as a fed-sheet number are initialized (S1). For example, a fed-sheet number indicative of the number of corrugated paperboard sheets SH fed from the sheet feeding apparatus 2 to form one batch is set to an initial value of "0". As an example other than the fed-sheet number, a cumulative number of corrugated paperboard sheets SH fed from the sheet feeding apparatus 2 in each order is set to an initial value of "0".

Subsequently, the sheet length, the batch-forming sheet number and the feeding mode of the next order are set (S2). Specifically, information for designating the sheet length, the batch-forming sheet number and the feeding mode determined as specifications of the next order is stored and set in a given storage area of the working memory 330. The sheet length means the length of a corrugated paperboard sheet SH in the feeding direction FD. The batch-forming sheet number means a given number of corrugated paperboard sheets SH forming one batch.

Subsequently, it is determined whether or not the feeding mode in the next order is the one-sheet feeding mode (S3). Specifically, it is determined whether the feeding mode-designating information stored in the working memory 330 in the step S2 indicates the one-sheet feeding mode or the two-sheet feeding mode. When the feeding mode is determined to be the one-sheet feeding mode (S3: YES), the processing routine proceeds to step S4. On the other hand, when the feeding mode is determined to be not the one-sheet feeding mode, i.e., to be the two-sheet feeding mode (S3: NO), the processing routine proceeds to step S5.

In the former case where the feeding mode is determined to be the one-sheet feeding mode, a control value XC is set to a numerical value NB representing the batch-forming sheet number (S4). Specifically, according to the batch-forming sheet number-designating information stored in the working memory 330 in the step S2, the control value XC is set to the numerical value NB representing the batch-forming sheet number. Then, this numerical value NB is stored in a given storage area of the working memory 330.

On the other hand, in the latter case where the designated feeding mode is determined to be not the one-sheet feeding mode, it is further determined whether or not the batch-forming sheet number is an even number (S5). Specifically, it is determined whether the batch-forming sheet number-designating information stored in the working memory 330 in the step S2 indicates an even sheet number or an odd sheet number. When the batch-forming sheet number is determined to be an even number (S5: YES), the processing routine proceeds to the step S4. On the other hand, when the batch-forming sheet number is determined to be not an even number, i.e., to be an odd number (S5: NO), the processing routine proceeds to step S6.

In the latter case where the designated batch-forming sheet number is determined to be not an even number, the control value XC is set to a numerical value (NB−1) derived from subtracting "1" from the numerical value NB representing the batch-forming sheet number (S6). Specifically, according to the batch-forming sheet number-designating information stored in the working memory 330 in the step S2, the control value XC is set to the numerical value derived from subtracting "1" from the numerical value NB representing the batch-forming sheet number. Then, this numerical value NB is stored in a given storage area of the working memory 330.

After execution of processing in the step S4 or S6, an allowable speed is calculated based on the designated sheet length (S7). Specifically, the allowable speed Sa (sheets/min) is calculated based on an outer peripheral length Cp (mm) of each of the printing cylinders 25A, 26A, a feeding mode, a given downward-movement time period Td (sec) of the main ledge 46, and a sheet length Ls (mm). The outer peripheral length Cp (mm) of each of the printing cylinders 25A, 26A is calculated by multiplication of the diameter Dp of each of the printing cylinders and pi (π). The feeding mode means a feeding mode set in conformity to an order intended to be executed. The given downward-movement time period Td (sec) of the main ledge 46 means a time period necessary for the main ledge 46 to move downwardly from the standby position slightly above a height position where the box-structured corrugated paperboard sheet SH is fed out by the transfer conveyor 41 and the upper conveyance roll 42, to the given lower position slightly above a height position where the auxiliary ledges 47A, 47B are installed. The given downward-movement time period Td is determined by performance of the ledge raising-lowering motor 208, and a mechanical configuration of an up-down mechanism comprising the pinion 209 and the rack 210. The sheet length Ls means the length of the corrugated paperboard sheet SH in the feeding direction FD, set in conformity to an order intended to be executed.

For example, when the feeding mode is the one-sheet feeding mode, the allowable speed Sa (sheets/min) is calculated by the following formula:

$$Sa=60\times(\pi\times Dp-Ls)/(Td\times\pi\times Dp)$$

On the other hand, when the feeding mode is the two-sheet feeding mode, the allowable speed Sa (sheets/min) is calculated by the following formula:

$$Sa=60\times(\pi\times Dp/2\times Ls)/(Td\times\pi\times Dp/2)$$

Subsequently, the allowable speed is set as a sheet feeding speed (S8). Specifically, the allowable speed Sa calculated in the step S7 is stored and set in a given storage area of the working memory 330, as a sheet feeding speed Sf at which the sheet feeding apparatus 2 feeds the corrugated paperboard sheet SH.

Subsequently, an upper limit speed, the allowable speed and the sheet feeding speed are displayed (S9). Specifically, the upper limit speed Smax, the allowable speed Sa and the sheet feeding speed Sf are individually displayed on the information display 344, in the form of a numerical value defined as the number of the corrugated paperboard sheets SH to be fed per minutes. The upper limit speed Smax means a maximum sheet feeding speed at which the corrugated paperboard box making machine 1 can feed the corrugated paperboard sheet SH. The upper limit speed Smax is determined by a mechanical configuration of the corrugated paperboard box making machine 1. When the step S5 is executed for the first time after start of the feeding control processing, the sheet feeding speed Sf is displayed on the information display 344 as the same numerical value as that of the allowable speed Sa.

Subsequently, it is determined whether or not a sheet feeding speed changing manipulation has been performed (S10). Specifically, it is determined whether or not the sheet feeding speed change button 343 has been manipulated by an operator. When the sheet feeding speed change button 343 is determined to have been manipulated (S10: YES), the processing routine proceeds to step S11. On the other hand, when the sheet feeding speed change button 343 is determined to be not manipulated (S10: NO), the processing routine proceeds to step S12.

In the former case where the sheet feeding speed change button 343 is determined to have been manipulated, the sheet feeding speed is changed (S11). Specifically, when the speed increasing button of the sheet feeding speed change button 343 is manipulated, the sheet feeding speed is increased depending on a duration time of the manipulation of the speed increasing button. On the other hand, when the speed reducing button of the sheet feeding speed change button 343 is manipulated, the sheet feeding speed is reduced depending on a duration time of the manipulation of the speed reducing button. The changed sheet feeding speed Sf is stored in the given area of the working memory in an updating manner. In this embodiment, an operator can change the sheet feeding speed Sf within a speed range equal to or less than the upper limit speed Smax, while taking into account specifications of an order intended to be executed, and a state of corrugated paperboard sheets, such as warpage. For example, in a situation where a solid print area in a printing pattern is relatively small, an operator is apt to change the sheet feeding speed Sf to a value greater than the allowable speed Sa. On the other hand, in a situation where warpage occurs in the corrugated paperboard sheets SH, an operator is apt to change the sheet feeding speed Sf to a value less than the allowable speed Sa.

After execution of the step S11, the processing routine returns to the step S9, the upper limit speed Smax, the allowable speed Sa and the changed sheet feeding speed Sf are individually displayed on the information display 344. The operator can look at contents displayed on the information display 344 to figure out a specific numerical value of the changed sheet feeding speed Sf, and a relative magnitude of the changed sheet feeding speed Sf with respect to the upper limit speed Smax and the allowable speed Sa.

On the other hand, in the latter case where the sheet feeding speed change button 343 is determined, in the step S10, to be not manipulated, it is further determined whether or not the sheet feeding speed is greater than the allowable speed (S12). When the sheet feeding speed is determined to be greater than the allowable speed (S12: YES), the processing routine proceeds to step S13. On the other hand, when the sheet feeding speed is determined to be equal to or less than the allowable speed (S12: NO), the processing routine proceeds to step S14.

In the former case where the sheet feeding speed is determined to be greater than the allowable speed, a sheet feeding stop control is set (S13). Specifically, a control instruction for directing execution of the sheet feeding stop control is stored and set in a given storage area of the working memory 330. Further, the control instruction for directing execution of the sheet feeding stop control is sent to each of the printing control device 351 and the roller motor control device 356.

On the other hand, in the latter case where the sheet feeding speed is determined to be equal to or less than the allowable speed, a sheet feeding control is set (S14). Specifically, a control instruction for directing execution of the sheet feeding control is stored and set in a given storage area of the working memory 330. Further, the control instruction for directing execution of the sheet feeding control is sent to each of the printing control device 351 and the roller motor control device 356.

After execution of the processing in the step S13 or S14, it is determined whether or not a sheet feeding start manipulation has been performed (S15). Specifically, it is determined whether or not the feeding start signal SF generated from the manipulation panel 340 in response to manipulation of the feeding button 341 by an operator has been received. When the sheet feeding start manipulation is determined to have been performed (S15: YES), the processing routine proceeds to step S16. On the other hand, when the sheet feeding start manipulation is determined to be not performed (S15: NO), the processings in the steps S10 to S14 will be executed again.

In the former case where the sheet feeding start manipulation is determined to have been performed, an instruction for directing start of feeding is issued (S16). Specifically, according to the feeding start signal SF, control instruction information containing the feeding start instruction and the motion start instruction is sent to the drive control device 350 and the roller motor control device 356. Further, the control instruction information is also sent to the second motion controller 380 as the motion start instruction. Detailed control operations of the roller motor control device 356 and the second motion controller 380 during the sheet feeding operation will be described later.

Subsequently, it is determined whether the leading edge of the corrugated paperboard sheet SH has been detected (S17). Specifically, it is determined whether or not the sheet detection signal ST1 generated from the sheet sensor SN1 detecting the leading edge of the corrugated paperboard sheet SH fed from the sheet feeding apparatus 2 has been received. When the leading edge of the corrugated paperboard sheet SH is determined to have been detected (S17: YES), the processing routine proceeds to step S18. On the other hand, when the leading edge of the corrugated paperboard sheet SH is determined to be not detected (S17: NO), the processing routine returns to the step S16.

In the former case where the leading edge of the corrugated paperboard sheet SH is determined to have been detected, the fed-sheet number is incremented by "1" (S18). The fed-sheet number means a given number of corrugated paperboard sheets SH fed from the sheet feeding apparatus 2 to form one batch, as mentioned above.

After execution of the processing in the step S18, it is determined whether or not the fed-sheet number is identical to the control value XC. When the fed-sheet number is determined to be identical to the control value XC (S19: YES), the processing routine proceeds to step S20. On the other hand, when the fed-sheet number is determined to be not identical to the control value XC (S19: NO), the processing routine returns to the step S16.

In the former case where the fed-sheet number is determined to be identical to the control value XC, it is further determined whether or not the sheet feeding stop control is set (S20). When the sheet feeding stop control is determined to be set (S20: YES), the processing routine proceeds to step S21. On the other hand, when the sheet feeding stop control is determined to be not set (S20: NO), the processing routine proceeds to step S22.

In the former case where the sheet feeding stop control is determined to be set, an instruction for directing temporary stop of feeding is issued (S21). Specifically, when the feeding mode is the one-sheet feeding mode, a one-sheet feeding temporary stop instruction CS1 for directing temporary stop of one cycle of sheet feeding operation is issued. On the other hand, when the feeding mode is the two-sheet feeding mode, and the batch forming sheet number is an even number, a two-sheet feeding temporary stop instruction CS21 for directing temporary stop of two cycles of sheet feeding operation is issued. Further, when the feeding mode is the two-sheet feeding mode, and the batch forming sheet number is an odd number, a two-sheet feeding temporary stop instruction CS22 for directing temporary stop of one cycle of sheet feeding operation is issued. Any one of the feeding temporary stop instructions CS1, CS21, CS22 is sent to each of the printing control device 351 and the roller motor control device 356. Detailed control operations of the printing control device 351 and the roller motor control device 356 during the feeding temporary stop operation will be described later.

On the other hand, in the latter case where the sheet feeding stop control is determined, in the step S20, to be not set, the fed-sheet number is reset to "0" (S22). That is, the fed-sheet number is reset so as to count the number of corrugated paperboard sheets fed to form a next batch.

After execution of the step S22, it is determined whether or not the current order has been completed (S23). Specifically, it is determined whether or not the order termination button 342 has been manipulated by an operator, or a processing of a given number of corrugated paperboard sheets designated by a production plan has been completed in the current order. When the order is determined to have been completed (S23: YES), the processing routine proceeds to step S24. On the other hand, when the order is determined to be not completed (S23: NO), the processing routine returns to the step S22.

In the former case where the order is determined to have been completed, an instruction for directing termination of feeding is issued (S24). Specifically, the feeding termination instruction for directing termination of the sheet feeding operation is sent to each of the control devices 350 to 356 and the second motion controller 380. After execution of the processing in the step S24, the feeding control processing is terminated.

<Sheet Feeding Operation>

With reference to FIGS. 20 to 30, a control operation for the sheet feeding operation to be executed by the roller motor control device 356 and the first and second motion controllers 360, 380 according to the feeding start instruction issued in the step S16 depicted in FIG. 19 will be described. As examples of the control operation for the sheet feeding operation, a control operation in the two-sheet feeding mode and a control operation in the one-sheet feeding mode will be described.

<Control Operation for Sheet Feeding Operation in Two-Sheet Feeding Mode>

A sheet feeding operation of the sheet feeding apparatus 2 will be described, on the assumption that a feeding mode set in conformity to a next order is the two-sheet feeding mode. In order to process corrugated paperboard sheets SH according to a sheet feeding operation in the two-sheet feeding mode, an operator carries out preparatory works, such as replacement of printing die members, replacement of slotter blades and replacement of punching dies. FIG. 7 depicts the corrugated paperboard box making machine 1 in a state after the preparatory works for the two-sheet feeding mode are completed. In this embodiment, the feeding mode and the batch-forming sheet number each conforming to the next order are displayed on the information display 344. In advance of the preparatory works, the operator can look at contents displayed on the information display 344 to ascertain that the feeding mode is the two-sheet feeding mode, and a value of the batch-forming sheet number.

In the step S2 depicted in FIG. 19, the lower-level management device 310 temporarily stores the feeding mode-designating information representing the two-sheet feeding mode conforming to the next order, in a given storage area of the working memory 330. Further, according to the order preparation instruction and the feeding mode-designating information, the lower-level management device 310 issues an instruction for adjusting a rotational phase of each of the printing cylinders 25A, 26A, an instruction for adjusting a rotational phase of each of the upper slotters 31B, 32B, and an instruction for adjusting a rotational phase of the die cylinder 33, respectively, to the printing control device 351, the creaser-slotter control device 352 and the die cutter control device 353.

(Creation of Roller Speed Control Pattern RT)

Upon detecting an input manipulation complete signal from the manipulation panel 340 after receiving from the upper-level management device 300 the order preparation instruction for directing preparation for execution of the next order, the lower-level management device 310 reads out the feeding mode-designating information and the batch-forming sheet number-designating information from the working memory 330 and sends the feeding mode designation signal, the batch-forming sheet number-designating information and the order preparation instruction to the roller motor control device 356. According to the feeding mode-designating information and the batch-forming sheet number-designating information about the next order in the order preparation instruction, the roller motor control device 356 reads out, from the basic roller drive pattern memory 361, the combination of two basic roller drive patterns for the two-sheet feeding mode, and generates a roller speed control pattern creation instruction. Specifically, when the batch-forming sheet number-designating information represents an even sheet number, the roller motor control device 356 reads out, from the basic roller drive pattern memory 361, the combination of the basic roller drive pattern BRP21 and the full cycle-stop basic roller drive pattern BRP23, and generates a roller speed control pattern creation instruction. On the other hand, when the batch-forming sheet number-designating information represents an odd sheet number, the roller motor control device 356 reads out, from the basic roller drive pattern memory 361, the combination of the basic roller drive pattern BRP21 and the half cycle-stop basic roller drive pattern BRP22, and generates a roller speed control pattern creation instruction. The roller motor control device 356 sends the roller speed control pattern creation instruction to the first motion controller 360.

Upon receiving the roller speed control pattern creation instruction from the roller motor control device 356, the first motion controller 360 reads out the roller speed control pattern creation program from the second program memory 362, and executes the roller speed control pattern creation program. According to execution of the roller speed control pattern creation program, the first motion controller 360 creates a roller speed control pattern RT2 for the two-sheet feeding mode, based on the sheet feeding speed and the basic roller drive pattern BRP21 contained in the roller speed control pattern creation instruction, and temporarily stores the roller speed control pattern RT2 in the first speed control pattern memory 363. Further, when the batch-forming sheet number-designating information represents an even sheet number, according to execution of the roller speed control pattern creation program, the first motion controller 360 also creates a full cycle-stop roller speed control pattern RT2F for the two-sheet feeding mode, based on the sheet feeding speed and the full cycle-stop basic roller drive pattern BRP23 contained in the roller speed control pattern creation instruction, and temporarily stores the full cycle-stop roller speed control pattern RT2F in the first speed control pattern memory 363. On the other hand, when the batch-forming sheet number-designating information represents an odd sheet number, according to execution of the roller speed control pattern creation program, the first motion controller 360 also creates a half cycle-stop roller speed control pattern RT2H for the two-sheet feeding mode, based on the sheet feeding speed and the half cycle-stop basic roller drive pattern BRP22 contained in the roller speed control pattern creation instruction, and temporarily stores the half cycle-stop roller speed control pattern RT2H in the first speed control pattern memory 363. Details of the full cycle-stop roller speed control pattern RT2F and the half cycle-stop roller speed control pattern RT2H will be described later.

Figure 20:
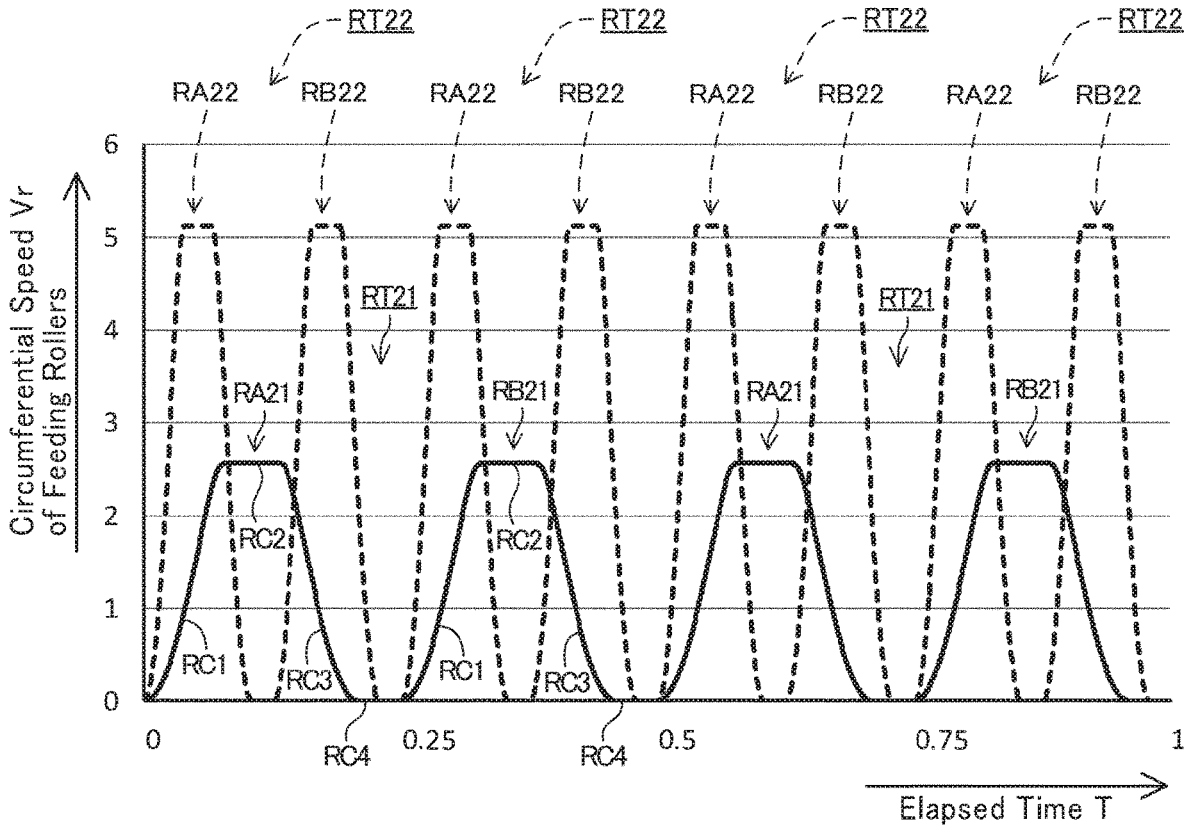
FIG. 20 is a chart depicting a change in circumferential speed Vr of each feeding roller according to a roller speed control pattern (RT21, RT22).

With reference to FIG. 20, the creation of the roller speed control pattern RT2 will be described in more detail. FIG. 20 depicts a change in circumferential speed Vr of each of the feeding rollers. In FIG. 20, the horizontal axis represents an elapsed time T by seconds, and the vertical axis represents the circumferential speed Vr of each of the feeding rollers by m/sec. In FIG. 20, a roller speed control pattern RT21 indicated by the solid lines is a pattern designating the circumferential speed Vr of each of the feeding rollers in the case where the sheet feeding speed of corrugated paperboard sheets SH is 240 sheets/min. In FIG. 20, a roller speed control pattern RT22 indicated by the broken lines is a pattern designating the circumferential speed Vr of each of the feeding rollers in the case where the sheet feeding speed of corrugated paperboard sheets SH is 480 sheets/min.

In the case where the sheet feeding speed contained in the roller speed control pattern creation instruction is 240 sheets/min as a value of the sheet feeding speed of corrugated paperboard sheets SH, the first motion controller 360 creates the roller speed control pattern RT21 based on the sheet feeding speed (240 sheets/min) and the basic roller drive pattern BRP21 depicted in FIG. 10A. Specifically, in the case where the sheet feeding speed is 240 sheets/min, i.e., the rotational speed of each of the printing cylinders is 120 rpm, each of the printing cylinders 25A, 26A requires 0.5 sec for rotating 360 degrees to complete one processing cycle. Based on the sheet feeding speed (240 sheets/min), the first motion controller 360 converts the rotational angle θp in FIGS. 10A to 10C to the elapsed time T. Further, based on the diameter Dp of each of the printing cylinders, and the sheet feeding speed (240 sheets/min), the first motion controller 360 converts the speed ratio Rf in FIGS. 10A to 10C to the circumferential speed Vr(=Rf×Dp×π×120/60) of each of the feeding rollers. Through these conversions, the first motion controller 350 creates the roller speed control pattern RT21 depicted in FIG. 20.

The roller speed control pattern RT21 is formed of two roller speed control sub-patterns RA21, RB21 each having the same pattern shape, in one processing cycle. Each of the two roller speed control sub-patterns RA21, RB21 comprises, within 0.25 sec, an acceleration region RC1, a constant-speed region RC2, a deceleration region RC3, and a stop region RC4. The acceleration region RC1, the constant-speed region RC2, the deceleration region RC3 and the stop region RC4 in each of the two roller speed control sub-patterns correspond, respectively, to the acceleration region BR21, the constant-speed region BR22, the deceleration region BR23, and the stop region BR24 in each of the basic roller drive sub-patterns BRP2A, BRP2B.

As with the creation of the roller speed control pattern RT21, through the processing of converting the rotational angle θp depicted in FIGS. 10A to 10C to the elapsed time T, and the processing of converting the speed ratio Rf depicted in FIGS. 10A to 10C to the circumferential speed Vr of each of the feeding rollers, the first motion controller 360 creates the full cycle-stop roller speed control pattern RT2F in which the circumferential speed Vr of each of the feeding rollers is "0", based on the sheet feeding speed contained in the roller speed control pattern creation instruction and the full cycle-stop basic roller drive pattern BRP23. The full cycle-stop roller speed control pattern RT2F corresponds to the stop region BR26 depicted in FIG. 10C. Further, through the processing of converting the rotational angle θp depicted in FIGS. 10A to 10C to the elapsed time T, and the processing of converting the speed ratio Rf depicted in FIGS. 10A to 10C to the circumferential speed Vr of each of the feeding rollers, the first motion controller 360 creates the half cycle-stop roller speed control pattern RT2H, based on the sheet feeding speed contained in the roller speed control pattern creation instruction and the half cycle-stop basic roller drive pattern BRP22. The half cycle-stop roller speed control pattern RT2H is formed of a roller speed control sub-pattern RA21, and a roller speed control sub-pattern RC21 in which the circumferential speed Vr of each of the feeding rollers is "0". The roller speed control sub-pattern RA21 of the half cycle-stop roller speed control pattern RT2H is identical to the roller speed control sub-pattern RA21 of the roller speed control pattern RT21. The roller speed control sub-pattern RC21 corresponds to the stop region BR25 depicted in FIG. 10B.

(Creation of Order-Specific Grate Raising-Lowering Pattern DGP)

Upon receiving from the upper-level management device 300 the order preparation instruction for directing preparation for execution of the next order, the lower-level management device 310 reads out the grate raising-lowering pattern creation program stored in the first program memory 320 and executes the grate raising-lowering pattern creation program. According to execution of the grate raising-lowering pattern creation program, the lower-level management device 310 creates an order-specific grate raising-lowering pattern DGP conforming to the sheet length of the next order, based on one of the two basic grate raising-lowering patterns BGS2, BGL2 stored in the basic grate raising-lowering pattern memory 370, and temporarily stores the order-specific grate raising-lowering pattern DGP in the order-specific grate raising-lowering pattern memory 371. The sheet length of the next order is designated in a range from a minimum sheet length to a maximum sheet length processable in the two-sheet feeding mode. The minimum sheet length processable in the two-sheet feeding mode is set based on the distance LF depicted in FIG. 1, and the maximum sheet length processable in the two-sheet feeding mode is set based on a half of the outer peripheral length of each of the printing cylinders.

Figure 21:
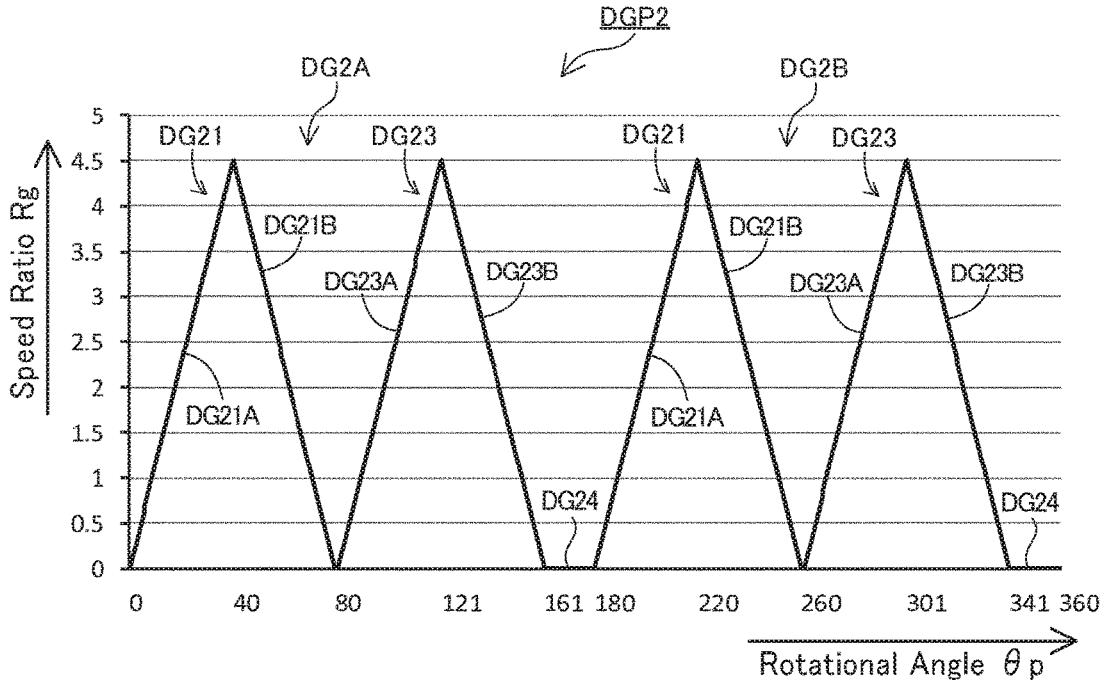
FIG. 21 is a chart depicting one example of an order-specific grate raising-lowering pattern DGP2 conforming to a sheet length of an order.

With reference to FIG. 21, the following description will be made about creation of an order-specific grate raising-lowering pattern DGP conforming to the sheet length of the next order. FIG. 21 depicts one example of an order-specific grate raising-lowering pattern DGP2 conforming to the sheet length of the next order in the two-sheet feeding mode. For example, the sheet length of the next order is 390 mm. In FIG. 21, the horizontal axis represents the rotational angle θp of each of the printing cylinders of the printer 3, and the vertical axis represents the speed ratio Rg of the angular speed ωg of the raising-lowering drive shaft 170 to the angular speed ωp of each of the printing cylinders.

As depicted in FIG. 21, the order-specific grate raising-lowering pattern DGP2 is formed of two grate raising-lowering sub-patterns DG2A, DG2B each having the same pattern shape, in one processing cycle. Each of the grate raising-lowering sub-patterns DG2A, DG2B comprises: a variable-speed lowering region DG21, a variable-speed raising region DG23 and an upper-position control region DG24, in a time period during which the rotational angle θp changes by 180 degrees. More specifically, the grate raising-lowering sub-pattern DG2A comprises: a variable-speed lowering region DG21 in which the rotational angle θp changes from 0 degree to 80 degrees; a variable-speed raising region DG23 in which the rotational angle θp changes from 80 degree to 161 degrees; and an upper-position control region DG24 in which the rotational angle θp changes from 161 degree to 180 degrees. The grate raising-lowering sub-pattern DG2B comprises: a variable-speed lowering region DG21 in which the rotational angle θp changes from 180 degree to 260 degrees; a variable-speed raising region DG23 in which the rotational angle θp changes from 260 degree to 341 degrees; and an upper-position control region DG24 in which the rotational angle θp changes from 341 degree to 360 degrees. Each of the variable-speed lowering regions DG21 is composed of an acceleration sub-region DG21A and a deceleration sub-region DG21B. Similarly, each of the variable-speed raising regions DG23 is composed of an acceleration sub-region DG23A and a deceleration sub-region DG23B. A speed change rate per unit time in the acceleration sub-regions DG21A, DG23A and a speed change rate per unit time in the deceleration sub-regions DG21B, DG23B are set to be equal, respectively, to the speed change rate per unit time in the acceleration sub-regions BG21A (i.e., BS21A or BL21), BG23A (i.e., BS23A or BL23A) of the basic grate raising-lowering patterns BGP2 (i.e., BGS2 and BGL2), and the speed change rate per unit time in the deceleration sub-regions BG21B (i.e., BS21B or BL21B), BG23B (i.e., BS23B or BL23B), in the basic grate raising-lowering pattern BGP2.

In FIG. 21, the variable-speed lowering region DG21 and the variable-speed raising region DG23 are arranged at a time interval set in conformity to the sheet length of the next order, in a direction causing an increase in the rotational angle θp, i.e., in the arrowed direction along the horizontal axis in FIG. 21. In a specific example, the lower-level management device 310 executes processing of moving the variable-speed raising region BL23 toward the variable-speed lowering region BL21 in each of the basic grate raising-lowering sub-patterns of the basic grate raising-lowering pattern BGL2, until an internal therebetween becomes equal to a value corresponding to the sheet length of the next order, to thereby create the order-specific grate raising-lowering pattern DGP2.

(Creation of Grate Raising-Lowering Speed Control Pattern GT)

After creating the order-specific grate raising-lowering pattern DGP2, the lower-level management device 310 generates a grate raising-lowering speed control pattern creation instruction and sends the grate raising-lowering speed control pattern creation instruction to the second motion controller 380. Upon receiving the grate raising-lowering speed control pattern creation instruction from the lower-level management device 310, the second motion controller 380 reads out the grate raising-lowering speed control pattern creation program from the third program memory 381, and executes the grate raising-lowering speed control pattern creation program. According to execution of the grate raising-lowering speed control pattern creation program, the second motion controller 380 creates a grate raising-lowering speed control pattern GT, based on the sheet feeding speed contained in the grate raising-lowering speed control pattern creation instruction, and the order-specific grate raising-lowering pattern DGP2, and temporarily stores the grate raising-lowering speed control pattern GT in the second speed control pattern memory 382.

Figure 22:
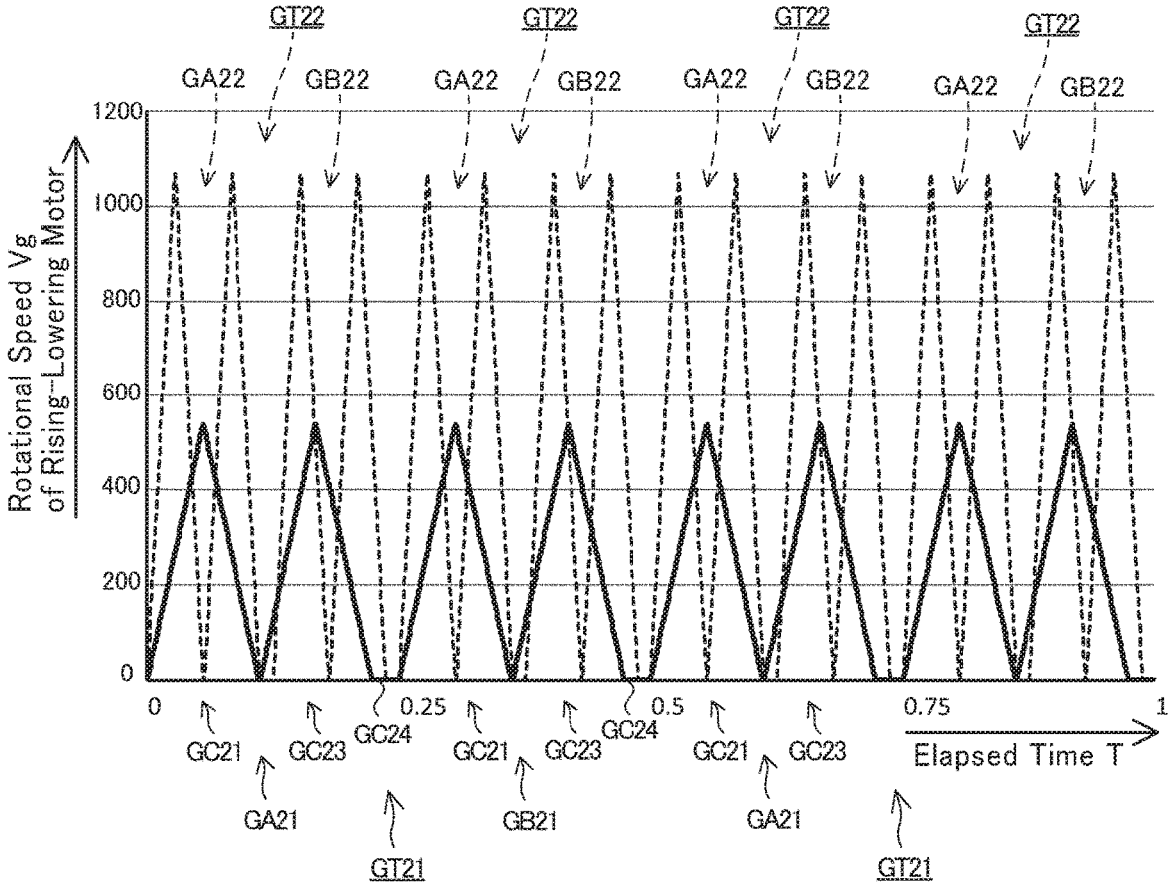
FIG. 22 is a chart depicting one example of a grate raising-lowering speed control pattern GT21 conforming to a sheet length of an order, and one example of a grate raising-lowering speed control pattern GT22 conforming to a sheet length of a processing order.
Figure 23:
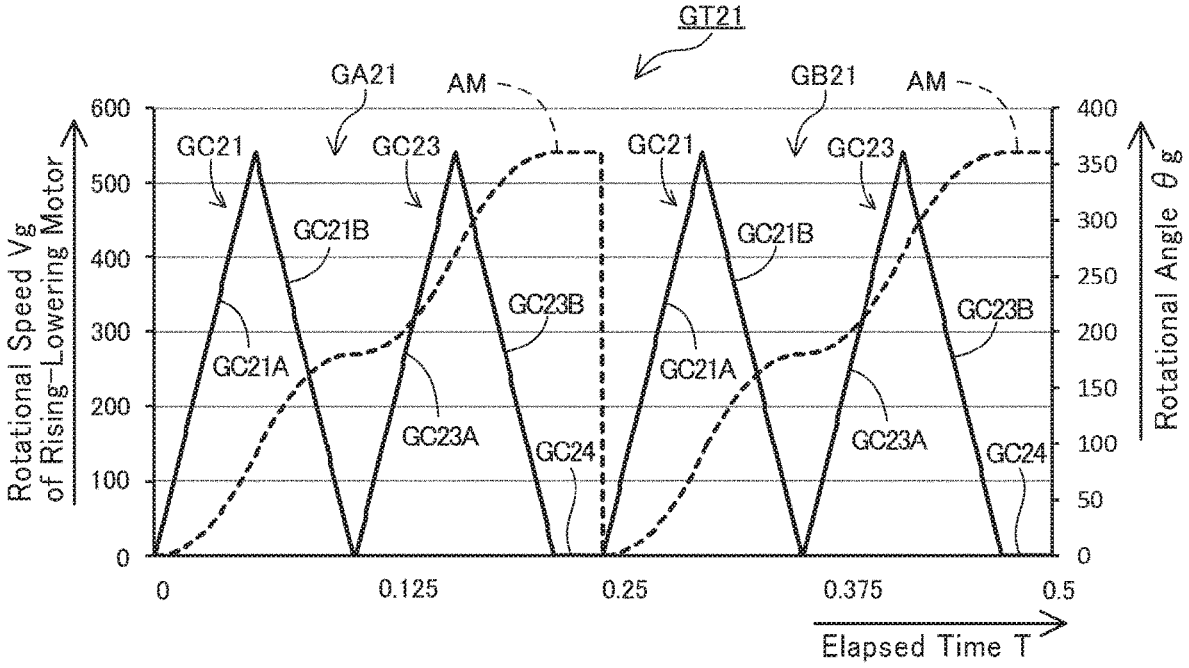
FIG. 23 is a chart depicting one example of the grate raising-lowering speed control pattern GT21, and a curve AM representing a change in rotational angle θg of the raising-lowering drive shaft.
Figure 24:
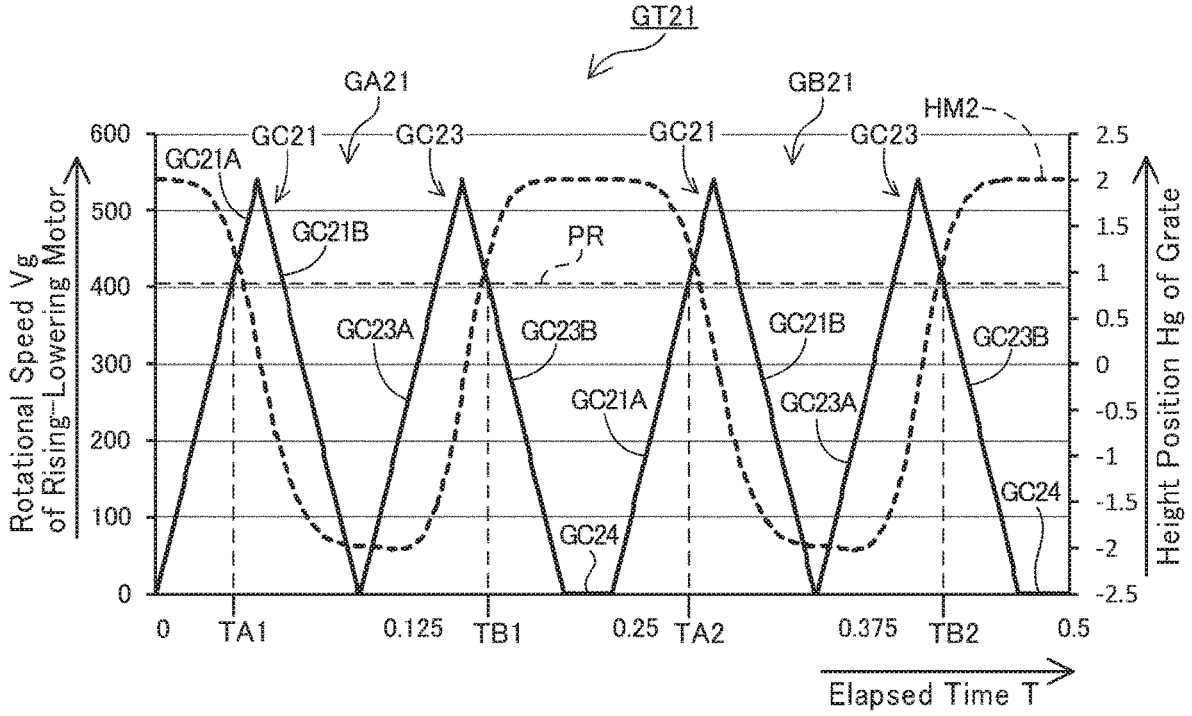
FIG. 24 is a chart depicting one example of the grate raising-lowering speed control pattern GT21, and a curve HM2 representing a change in height position Hg of the grate.

With reference to FIGS. 22 to 24, the following description will be made about creation of the grate raising-lowering speed control pattern GT. FIG. 22 depicts a change in rotational speed Vg of the raising-lowering motor 80, during feeding of corrugated paperboard sheets each having the sheet length of the next order. In FIG. 22, the horizontal axis represents the elapsed time T by seconds, and the vertical axis represents the rotational speed Vg of the raising-lowering motor 80 by m/sec. In FIG. 22, a grate raising-lowering speed control pattern GT21 indicated by the solid lines is a pattern designating the rotational speed Vg of the raising-lowering motor 80 in the case where the rotational speed of each of the printing cylinders is 120 rpm, i.e., the feeding speed of corrugated paperboard sheets SH is 240 sheets/min in the two-sheet feeding mode. In FIG. 20, a grate raising-lowering speed control pattern GT22 indicated by the broken lines is a pattern designating the rotational speed Vg of the raising-lowering motor 80 in the case where the rotational speed of each of the printing cylinders is 240 rpm, i.e., the feeding speed of corrugated paperboard sheets SH is 480 sheets/min in the two-sheet feeding mode.

In the case where the sheet feeding speed contained in the grate raising-lowering speed control pattern creation instruction is 240 sheets/min as a value of the sheet feeding speed of corrugated paperboard sheets SH, the second motion controller 380 creates the grate raising-lowering speed control pattern GT21, based on the sheet feeding speed (240 sheets/min) and the order-specific grate raising-lowering pattern DGP2 depicted in FIG. 21. Specifically, in the case where the sheet feeding speed is 240 sheets/min, each of the printing cylinders 25A, 26A requires 0.5 sec for rotating 360 degrees. Based on the sheet feeding speed (240 sheets/min), the second motion controller 380 converts the rotational angle θp in FIG. 21 to the elapsed time T. Further, based on the sheet feeding speed (240 sheets/min), i.e., the rotational speed (120 rpm) of each of the printing cylinders, the second motion controller 380 converts the speed ratio Rf in FIG. 21 to the rotational speed Vg(=Rg×120) of the raising-lowering motor 80. Through these conversions, the second motion controller 380 creates the grate raising-lowering speed control pattern GT21 depicted in FIG. 22. On the other hand, in the case where the sheet feeding speed of corrugated paperboard sheets SH in the two-sheet feeding mode is 480 sheets/min, the second motion controller 380 creates the grate raising-lowering speed control pattern GT22, based on the sheet feeding speed (480 sheets/min) and the order-specific grate raising-lowering pattern DGP2 depicted in FIG. 21.

As depicted in FIG. 22, the grate raising-lowering speed control pattern GT21 is formed of two grate raising-lowering speed control sub-patterns GA21, GB21 each having the same pattern shape, in one processing cycle. Each of the two grate raising-lowering speed control sub-patterns GA21, GB21 comprises, within 0.25 sec, a variable-speed lowering region GC21, a variable-speed raising region GC23, and an upper-position control region GC24.

FIGS. 23 and 24 enlargedly depicts the grate raising-lowering speed control pattern GT21 in a time period during which each of the printing cylinders rotates 360 degrees, i.e., in one processing cycle. In FIG. 23, the horizontal axis represents the elapsed time T by seconds, and the left vertical axis and the right vertical axis represent, respectively, the rotational speed Vg of the raising-lowering motor 80 by rpm, and the rotational angle θg of the raising-lowering drive shaft 170. A curve AM indicated by the broken line in FIG. 23 represents a change in the rotational angle θg of the raising-lowering drive shaft 170. In FIG. 24, the horizontal axis represents the elapsed time T by seconds, and the left vertical axis and the right vertical axis represent, respectively, the rotational speed Vg of the raising-lowering motor 80 by rpm, and the height position Hg of the upper surface of each of the grates 141 on the basis of the upper surface of the table 20 by mm. A curve HM2 indicated by the broken line in FIG. 24 represents a change in the height position Hg of the upper surface of each of the grates 141. A position PR indicated by the broken line in FIG. 24 represents a position of the uppermost point of the outer peripheral surface of each of the feeding rollers.

Specifically, as depicted in FIG. 23, the grate raising-lowering speed control sub-pattern GA21 comprises: a variable-speed lowering region GC21, a variable-speed raising region GC23 and an upper-position control region GC24, in a time period during which the elapsed time T changes from 0 sec to 0.25 sec. As with the grate raising-lowering speed control sub-pattern GA21, the grate raising-lowering speed control sub-pattern GB21 comprises: a variable-speed lowering region GC21, a variable-speed raising region GC23 and an upper-position control region GC24, in a time period during which the elapsed time T changes from 0.25 sec to 0.5 sec. The variable-speed lowering region GC21 comprises an acceleration sub-region GC21A and a deceleration sub-region GC21B. The variable-speed raising region GC23 comprises an acceleration sub-region GC23A and a deceleration sub-region GC23B. The variable-speed lowering region GC21, the variable-speed raising region GC23 and the upper-position control region GC24 correspond, respectively, to the variable-speed lowering region DG21, the variable-speed raising region DG23 and the upper-position control region DG24 each depicted in FIG. 21.

As depicted in FIG. 23, the rotational angle θg of the raising-lowering drive shaft 170 is increased to reach 360 degrees at a time point of termination of the deceleration sub-region GC23B of the variable-speed raising region GC23, and subsequently, kept at 360 degrees in the upper-position control region GC24. As depicted in FIG. 24, the height position Hg of the upper surface of each of the grates 141 becomes lower than the position PR in mid-course of the acceleration sub-region GC21A, and then becomes higher than the position PR in mid-course of the deceleration sub-region GC23B.

(Feeding Operation of Corrugated Paperboard Sheets SH)

Figure 25:
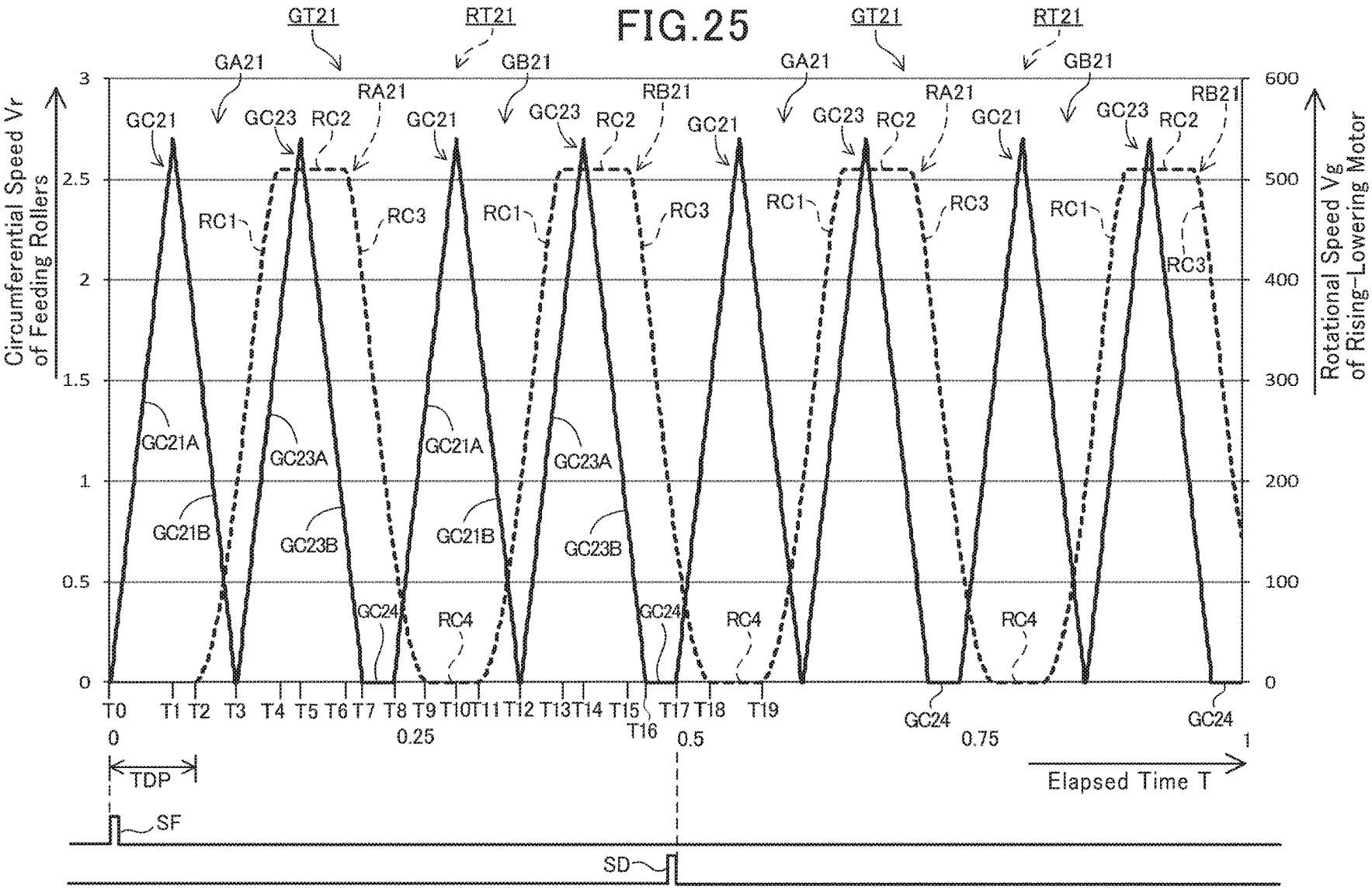
FIG. 25 is a timing chart depicting a temporal relationship among a roller speed control pattern RT21, a grate raising-lowering speed control pattern GT21, a feeding start signal SF and a detection signal SD, in the two-sheet feeding mode.
Figure 26:
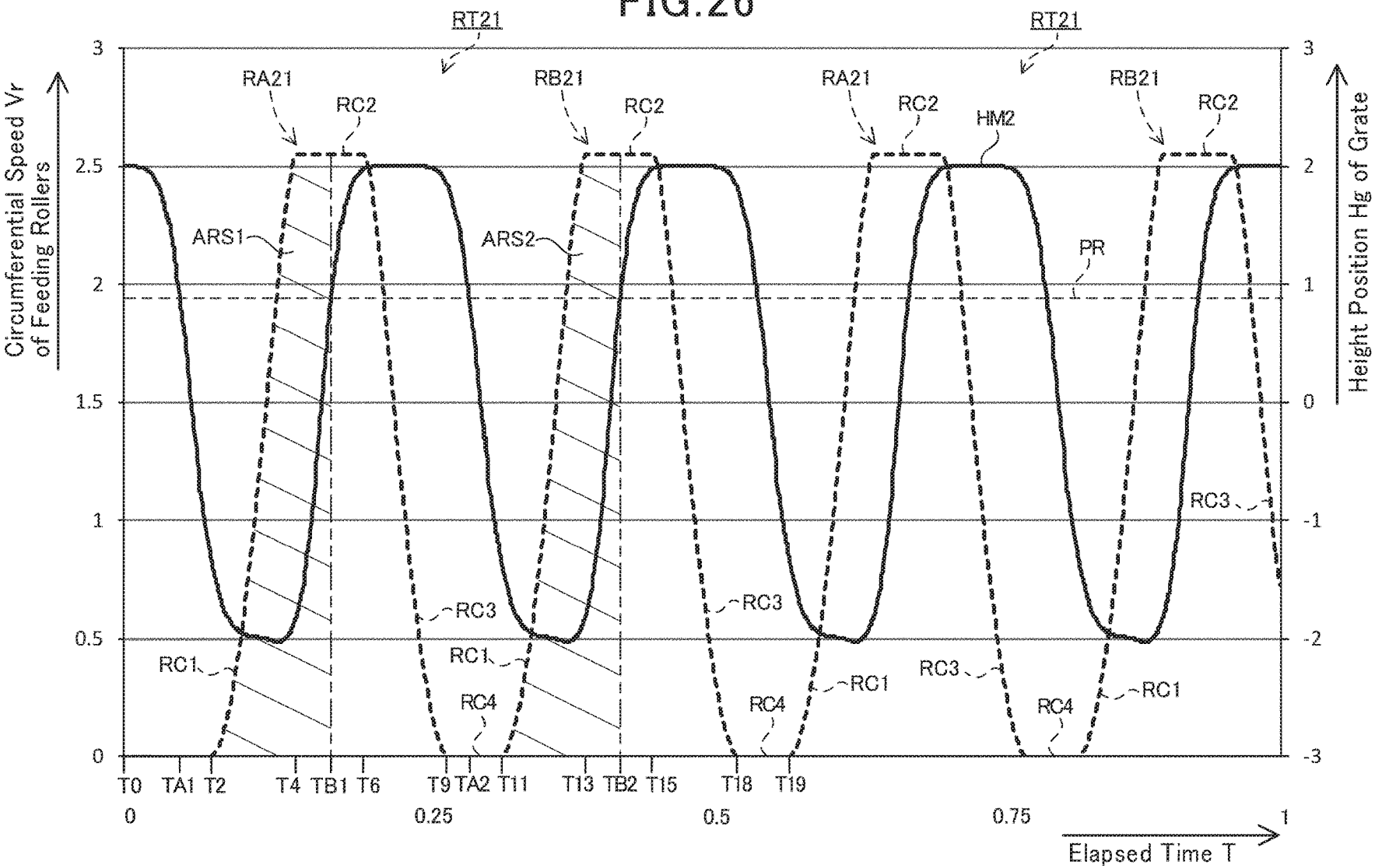
FIG. 26 is a timing chart depicting a temporal relationship between the roller speed control pattern RT21 and the curve HM2 representing a change in height position Hg of the upper surface of the grate, in the two-sheet feeding mode.

With reference to FIGS. 23 and 24, the following description will be made about an operation of feeding corrugated paperboard sheets SH under the condition that the sheet feeding speed in the two-sheet feeding mode is 240 sheets/min. FIG. 25 is a timing chart presenting a temporal relationship among the roller speed control pattern RT21, the grate raising-lowering speed control pattern GT21, the feeding start signal SF from the manipulation panel 340, and the detection signal SD from the rotational position sensor 190. In FIG. 25, the horizontal axis represents the elapsed time T by seconds, and the left vertical axis and the right vertical axis represent, respectively, the circumferential speed Vr of each of the feeding rollers by m/sec, and the rotational speed Vg of the raising-lowering motor 80 by rpm. FIG. 26 is a timing chart presenting a temporal relationship between the roller speed control pattern RT21 and the curve HM2 representing a change in the height position Hg of the upper surface of each of the grates 141. In FIG. 26, the horizontal axis represents the elapsed time T by seconds, and the left vertical axis and the right vertical axis represent, respectively, the circumferential speed Vr of each of the feeding rollers by m/sec, and the height position Hg of the upper surface of each of the grates 141 by mm.

When an operator manipulates the feeding button 341 after completion of preparation for execution of the next order, the lower-level management device 310 receives the feeding start signal SF from the manipulation panel 340. In response to the received feeding start signal SF, the lower-level management device 310 sends control instruction information containing the feeding start instruction and the sheet feeding speed to each of the drive control device 350 and the roller motor control device 356, and sends, as the motion start instruction, the control instruction information to the second motion controller 380.

In conformity to the sheet feeding speed contained in the control instruction information, the drive control device 350 rotationally drives the main drive motor MT at a rotational speed corresponding to the sheet feeding speed. Along with the rotation of the main drive motor MT, the printing cylinders 25A, 26A of the printing units 25, 26, the upper slotters of the slotter units 31, 32 and others are rotated at a speed corresponding to the sheet feeding speed, e.g., 240 sheets/min in the two-sheet feeding mode.

In response to the motion start instruction, the second motion controller 380 reads out the speed control instructions of the grate raising-lowering speed control pattern GT21 from the second speed control pattern memory 382 at intervals of a given control cycle, and sequentially send the speed control instructions to the second drive control circuit 383. Based on the speed control instructions, and a frequency of the rotation pulses from the encoder 85, the second drive control circuit 383 controls the rotational speed of the raising-lowering motor 80 to cause the rotational speed of the raising-lowering motor 80 to become equal to the rotational speed Vg according to the grate raising-lowering speed control pattern GT21 depicted in FIG. 25.

As depicted in FIG. 25, the rotational speed of the raising-lowering motor 80 is accelerated from time T0 just after the generation of the feeding start signal SF at the speed change rate per unit time in the acceleration sub-region GC21A of the grate raising-lowering speed control sub-pattern GA21. When the elapsed time T reaches time T1, the rotational speed of the raising-lowering motor 80 is decelerated at the speed change rate per unit time in the deceleration sub-region GC21B. When the elapsed time T reaches time T3, the rotation of the raising-lowering motor 80 is stopped. In a time period from the time T0 to the time T3, each of the grates 141 is lowered from the uppermost position and moved to the lowermost position. The upper surface of each of the grates 141 is lowered to reach the position PR of the uppermost point of the outer peripheral surface of each of the feeding rollers, at time TA1 depicted in FIG. 26, and, subsequently, further lowered toward the lowermost position.

In order to set start time T2 of the acceleration region RC1 of the roller speed control pattern RT21, the roller motor control device 356 calculates a time period TDP from the time T0 to the time T2, based on the sheet feeding speed contained in the control instruction information, and the phase-difference set value DPP stored in the second program memory 362. Until the elapsed time T becomes equal to the time period TDP, the roller motor control device 356 does not issue any motion start instruction. Thus, the first drive control circuit 364 keeps the roller motors 90, 91, 102, 103 in the stopped state, in the time period TDP from the time T0 just after the generation of the feeding start signal SF.

When the elapsed time T becomes equal to the time period TDP, the roller motor control device 356 generates the motion start instruction and sends it to the first motion controller 360. In response to the received motion start instruction, the first motion controller 360 reads out the speed control instructions of the roller speed control pattern RT21 from the first speed control pattern memory 363 at intervals of a given control cycle, and, after converting the speed control instructions to rotational speed control instructions for each of the roller motors, sequentially send the rotational speed control instructions to the first drive control circuit 364. Specifically, the speed control instructions are converted to rotational speed control instructions for each of the roller motors, based on the diameter Dr of each of the feeding rollers. Based on the rotational speed control instructions, and a frequency of the rotation pulses from each of the group of encoders 100, 106, 112, 113, the first drive control circuit 364 controls the rotational speed of each of the roller motors 90, 91, 102, 103 to cause the rotational speed of each of the roller motors to become equal to the rotational speed according to the roller speed control pattern RT21 depicted in FIG. 25.

As depicted in FIG. 25, the elapsed time T reaches the time T2, the rotational speed of each of the roller motors is accelerated at the speed change rate per unit time in the acceleration region RC1 of the roller speed control pattern RT21. Thus, each of the feeding rollers in the stopped state starts rotating. The time T2 is later than the time TA1 as depicted in FIG. 26. Therefore, when each of the feeding rollers starts rotating, the lower surface of a bottommost one of the stacked corrugated paperboard sheets SH is in contact with the feeding rollers, so that the bottommost corrugated paperboard sheet SH is fed out in the feeding direction FD.

Among the speed control instructions for directing the rotational speed Vg of the raising-lowering motor 80, one speed control instruction at the time T3 designates a rotation speed of "0", so that the raising-lowering motor 80 is in an approximately stopped state or in a rotating state at an extremely low speed, in a given time range around the time T3. Two or more of the speed control instructions generated in the given time range around the time T3 correspond to those for the lower-position control region in which the rotational speed of the raising-lowering motor 80 is controlled to cause the upper surface of each of the grates 141 to be located below the position PR of the uppermost point of the outer peripheral surface of each of the feeding rollers 124 to 127. The raising-lowering motor 80 is accelerated in a time period from the time T3 to time T5, according to the speed control instructions in the acceleration sub-region GC23A of the variable-speed raising region GC23, and decelerated in a time period from the time T5 to time T7, according to the speed control instructions in the deceleration sub-region GC23B of the variable-speed raising region GC23. In a time period from the time T3 to the time T7, each of the grates 141 is raised from the lowermost position and moved to the uppermost position. The upper surface of each of the grates 141 is raised to reach the position PR of the uppermost point of the outer peripheral surface of each of the feeding rollers, at a time TB1 depicted in FIG. 26, and, subsequently, further raised toward the uppermost position. In a time period from the time T7 to time T8, the raising-lowering motor 80 is kept in the stopped state according to the speed control instructions in the upper-position control region GC24.

When the elapsed time T reaches the time T8, the rotational speed of the raising-lowering motor 80 is accelerated at the speed change rate per unit time in the acceleration sub-region GC21A of the grate raising-lowering speed control sub-pattern GA21. When the elapsed time T reaches time T10, the rotational speed of the raising-lowering motor 80 is decelerated at the speed change rate per unit time in the deceleration sub-region GC21B. When the elapsed time T reaches time T12, the rotation of the raising-lowering motor 80 is stopped. In a time period from the time T8 to the time T13, each of the grates 141 is lowered from the uppermost position and moved to the lowermost position. The upper surface of each of the grates 141 is lowered to reach the position PR of the uppermost point of the outer peripheral surface of each of the feeding rollers, at time TA2 depicted in FIG. 26, and, subsequently, further lowered toward the lowermost position.

Among the speed control instructions for directing the rotational speed Vg of the raising-lowering motor 80, one speed control instruction at the time T12 designates a rotation speed of "0", so that the raising-lowering motor 80 is in an approximately stopped state or in a rotating state at an extremely low speed, in a given time range around the time T12. Two or more of the speed control instructions generated in the given time range around the time T12 correspond to those for the lower-position control region in which the rotational speed of the raising-lowering motor 80 is controlled to cause the upper surface of each of the grates 141 to be located below the position PR of the uppermost point of the outer peripheral surface of each of the feeding rollers 124 to 127. The raising-lowering motor 80 is accelerated in a time period from the time T12 to time T14, according to the speed control instructions in the acceleration sub-region GC23A of the variable-speed raising region GC23, and decelerated in a time period from the time T14 to time T16, according to the speed control instructions in the deceleration sub-region GC23B of the variable-speed raising region GC23. In a time period from the time T12 to the time T16, each of the grates 141 is raised from the lowermost position and moved to the uppermost position. The upper surface of each of the grates 141 is raised to reach the position PR of the uppermost point of the outer peripheral surface of each of the feeding rollers, at time TB2 depicted in FIG. 26, and, subsequently, further raised toward the uppermost position. In a time period from the time T16 to time T17, the raising-lowering motor 80 is kept in the stopped state according to the speed control instructions in the upper-position control region GC24.

In order to issue the speed control instructions in a time period from the time T0 to the time T17, the second motion controller 380 reads out, as a first readout operation, all of the speed control instructions in the three regions GC21, GC23, GC24 of the grate raising-lowering speed control sub-pattern GA21 and in three regions GC21, GC23, GC24 of the grate raising-lowering speed control sub-pattern GB21, from the second speed control pattern memory 382. The speed control instructions in the three regions GC21, GC23, GC24 of the grate raising-lowering speed control sub-pattern GA21 are used to feed a first one of two corrugated paperboard sheets SH in one processing cycle, and the speed control instructions in three regions GC21, GC23, GC24 of the grate raising-lowering speed control sub-pattern GB21 are used to feed a second one of the two corrugated paperboard sheets SH in the same processing cycle. In this embodiment, the sheet feeding speed in the two-sheet feeding mode is 240 sheets/min. Thus, the time period from the time T0 to the time T17 is 0.5 sec.

When the elapsed time T reaches the time T17, the lower-level management device 310 receives a first detection signal SD from the rotational position sensor 190. In response to receiving the detection signal SD, the lower-level management device 310 sends control instruction information containing the synchronization instruction and the sheet feeding speed, to each of the drive control device 350 and the roller motor control device 356, and sends, as the motion start instruction, the control instruction information to the second motion controller 380. According to the sheet feeding speed contained in the control instruction information, the drive control device 350 continues to rotationally drive the main drive motor MT at a rotational speed corresponding to the sheet conveyance speed.

In response to the motion start instruction, the second motion controller 380 reads out the speed control instructions of the grate raising-lowering speed control pattern GT21 from the second speed control pattern memory 382 at intervals of a given control cycle, and sequentially send the speed control instructions to the second drive control circuit 383. The second motion controller 380 reads out, as a second readout operation, all of the speed control instructions in the three regions GC21, GC23, GC24 of the grate raising-lowering speed control sub-patterns GA21, GB21 in the same grate raising-lowering speed control pattern GT21, from the speed control pattern memory 382. The speed control instructions in the three regions GC21, GC23, GC24 of the grate raising-lowering speed control sub-pattern GA21 are used to feed a first one of two corrugated paperboard sheets SH in the next processing cycle, and the speed control instructions in three regions GC21, GC23, GC24 of the grate raising-lowering speed control sub-pattern GB21 are used to feed a second one of the two corrugated paperboard sheets SH in the same processing cycle. After the time T17, in response to each motion start instruction based on the detection signal SD, the second motion controller 380 repeatedly performs the same control processing as that in the time period from the time T0 to the time T17.

In a time period from the time T2 to the time T4, each of the roller motors is accelerated at the speed change rate per unit time in the acceleration region RC1 of the roller speed control sub-pattern RA21, to a rotational speed corresponding to the sheet feeding speed (240 sheets/min) in the two-sheet feeding mode. Subsequently, in a time period from the time T4 to the time T6, each of the roller motors is kept at a rotational speed corresponding to the sheet feeding speed in the constant-speed region RC2. In a time period from the time T6 to the time T9, each of the roller motors is decelerated from the sheet feeding speed at the speed change rate per unit time the deceleration region RC3. In a time period from the time T9 to the time T11, each of the roller motors is kept in the stopped state in the stop region RC4.

When the elapsed time T reaches the time T11, in a time period from the time T11 to the time T13, each of the roller motors is accelerated at the speed change rate per unit time in the acceleration region RC1 of the roller speed control sub-pattern RB21, to the rotational speed corresponding to the sheet feeding speed (240 sheets/min) in the two-sheet feeding mode. Subsequently, in a time period from the time T13 to the time T15, each of the roller motors is kept at a rotational speed corresponding to the designated feeding speed, in the constant-speed region RC2. In a time period from the time T15 to the time T18, each of the roller motors is decelerated from the sheet feeding speed at the speed change rate per unit time the deceleration region RC3. In a time period from the time T18 to the time T19, each of the roller motors is kept in the stopped state, in the stop region RC4.

In order to issue the speed control instructions in a time period from the time T2 to the time T19, the first motion controller 360 reads out, as a first readout operation, all of the speed control instructions in the four regions RC1 to RC4 of each of the roller speed control sub-patterns RA21, RB21 of the roller speed control pattern RT21, from the first speed control pattern memory 363. The speed control instructions in the four regions RC1 to RC4 of the roller speed control sub-pattern RA21 are used to feed a first one of two corrugated paperboard sheets SH in one processing cycle, and the speed control instructions in the four regions RC1 to RC4 of the roller speed control sub-pattern RB21 are used to feed a second one of the two corrugated paperboard sheets SH in the same processing cycle. In this embodiment, the feeding speed in the two-sheet feeding mode is 240 sheets/min. Thus, the time period from the time T2 to the time T19 is 0.5 sec.

At the time T19 after the elapse of the time period TDP from the time T17 when receiving the synchronization instruction based on the detection signal SD, the roller motor control device 356 generates the motion start instruction and sends it to the first motion controller 360.

In response to the received motion start instruction, the first motion controller 360 reads out the speed control instructions of the roller speed control pattern RT21 from the first speed control pattern memory 363 at intervals of a given control cycle, and sequentially send the speed control instructions to the first drive control circuit 364. The first motion controller 360 reads out, as a second readout operation, all of the speed control instructions in the four regions RC1 to RC4 of each of the roller speed control sub-patterns RA21, RB21 of the roller speed control pattern RT21, from the first speed control pattern memory 363. The speed control instructions in the four regions RC1 to RC4 of the roller speed control sub-pattern RA21 are used to feed a first one of two corrugated paperboard sheets SH in the next processing cycle, and the speed control instructions in the four regions RC1 to RC4 of the roller speed control sub-pattern RB21 are used to feed a second one of the two corrugated paperboard sheets SH in the same processing cycle. After the time T19, in response to each motion start instruction based on the synchronization instruction, the first motion controller 360 repeatedly performs the same control processing as that in the time period from the time T2 to the time T19.

A first one on two corrugated paperboard sheets SH in one processing cycle starts to be fed from the time T2, and is released from the feeding rollers at the time TB1 depicted in FIG. 26. A distance by which the first corrugated paperboard sheet SH is fed by the feeding rollers corresponds to an area ARS1 of the shaded region in FIG. 26, and depends on the sheet length. A second one of the two corrugated paperboard sheets SH in the same processing cycle starts to be fed from the time T11, and is released from the feeding rollers at the time TB2 which is later than the time T11. A distance by which the second corrugated paperboard sheet SH is fed by the feeding rollers corresponds to an area ARS2 of the shaded region in FIG. 26, and depends on the sheet length.

<Grate Raising-Lowering Speed Control Pattern GT21-1 Conforming to Minimum Sheet Length>

Figure 27:
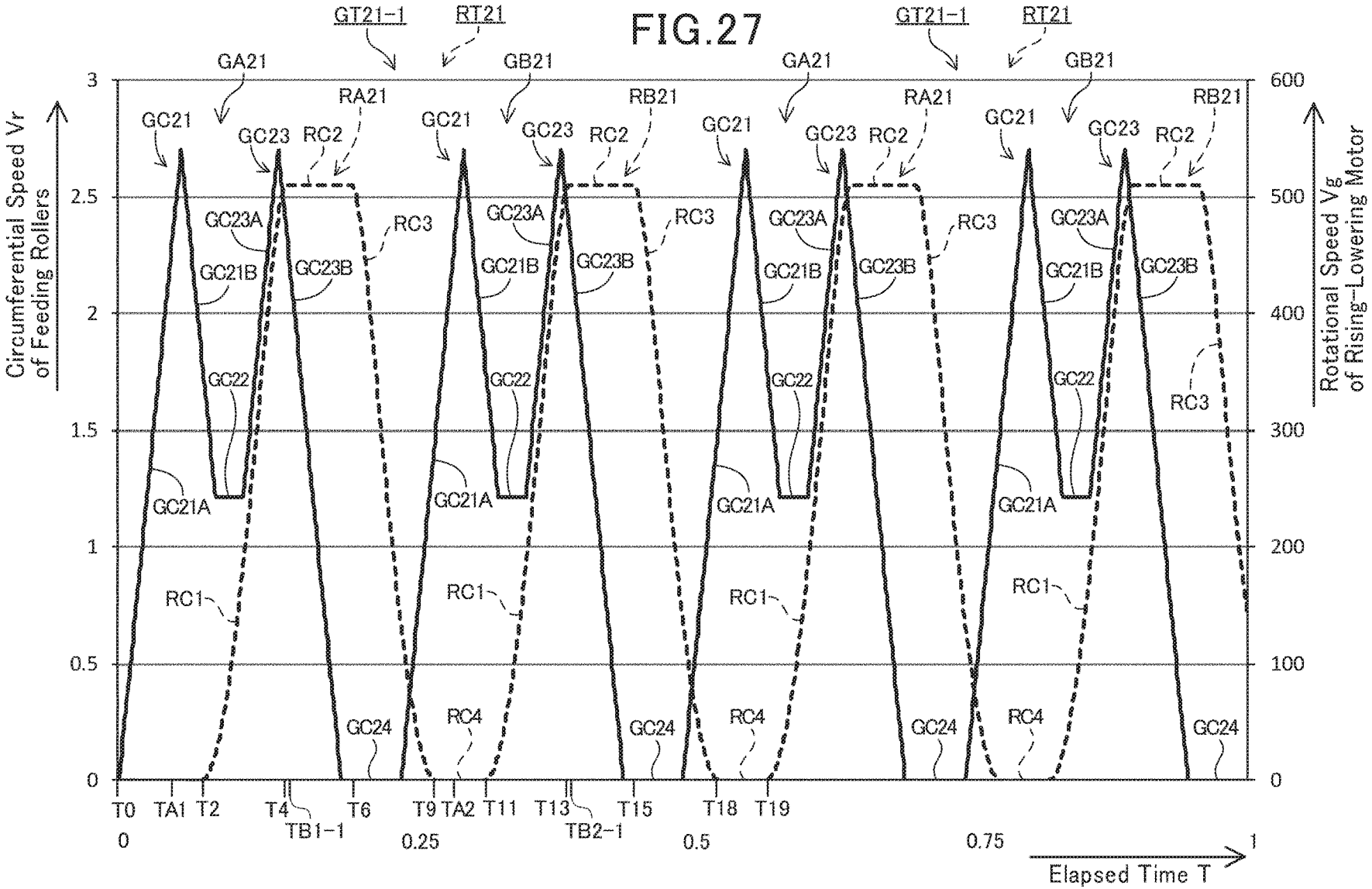
FIG. 27 is a timing chart depicting a temporal relationship between the roller speed control pattern RT21 and a grate raising-lowering speed control pattern GT21-1, in the case where corrugated paperboard sheets SH each having the minimum sheet length are fed in the two-sheet feeding mode.

With reference to FIG. 27, a grate raising-lowering speed control pattern GT21-1 conforming to the minimum sheet length will be described. FIG. 27 is a timing chart presenting a temporal relationship between the roller speed control pattern RT21 and the grate raising-lowering speed control pattern GT21-1, in the case where corrugated paperboard sheets SH to be fed in the two-sheet feeding mode have the minimum sheet length. In the grate raising-lowering speed control pattern GT21-1 depicted in FIG. 27, the same or corresponding portion or region as/to that in the grate raising-lowering speed control pattern GT21 depicted in FIG. 25 will be described by assigning the same reference sign. A roller speed control pattern RT21 depicted in FIG. 27 is the same as that of the roller speed control pattern RT21 depicted in FIG. 25.

In the grate raising-lowering speed control pattern GT21-1 depicted in FIG. 27, the upper surface of each of the grates 141 is lowered to reach the position PR of the uppermost point of the outer peripheral surface of each of the feeding rollers at the time TA1, and, subsequently, further lowered toward the lowermost position, as with the grate raising-lowering speed control pattern GT21 depicted in FIG. 25. However, differently from the grate raising-lowering speed control sub-pattern GA21 of the grate raising-lowering speed control pattern GT21 depicted in FIG. 25, in a grate raising-lowering speed control sub-pattern GA21 of the grate raising-lowering speed control pattern GT21-1 depicted in FIG. 27, the upper surface of each of the grates 141 is raised to reach the position PR of the uppermost point of the outer peripheral surface of each of the feeding rollers at time TB1-1 which is earlier than the time TB1 in FIG. 26, and, subsequently, further raised toward the uppermost position. A time point of termination of a deceleration sub-region GC23B of the grate raising-lowering speed control sub-pattern GA21 of the grate raising-lowering speed control pattern GT21-1 becomes earlier than the time T7 in FIG. 25.

<Grate Raising-Lowering Speed Control Pattern GT21-2 Conforming to Maximum Sheet Length>

Figure 28:
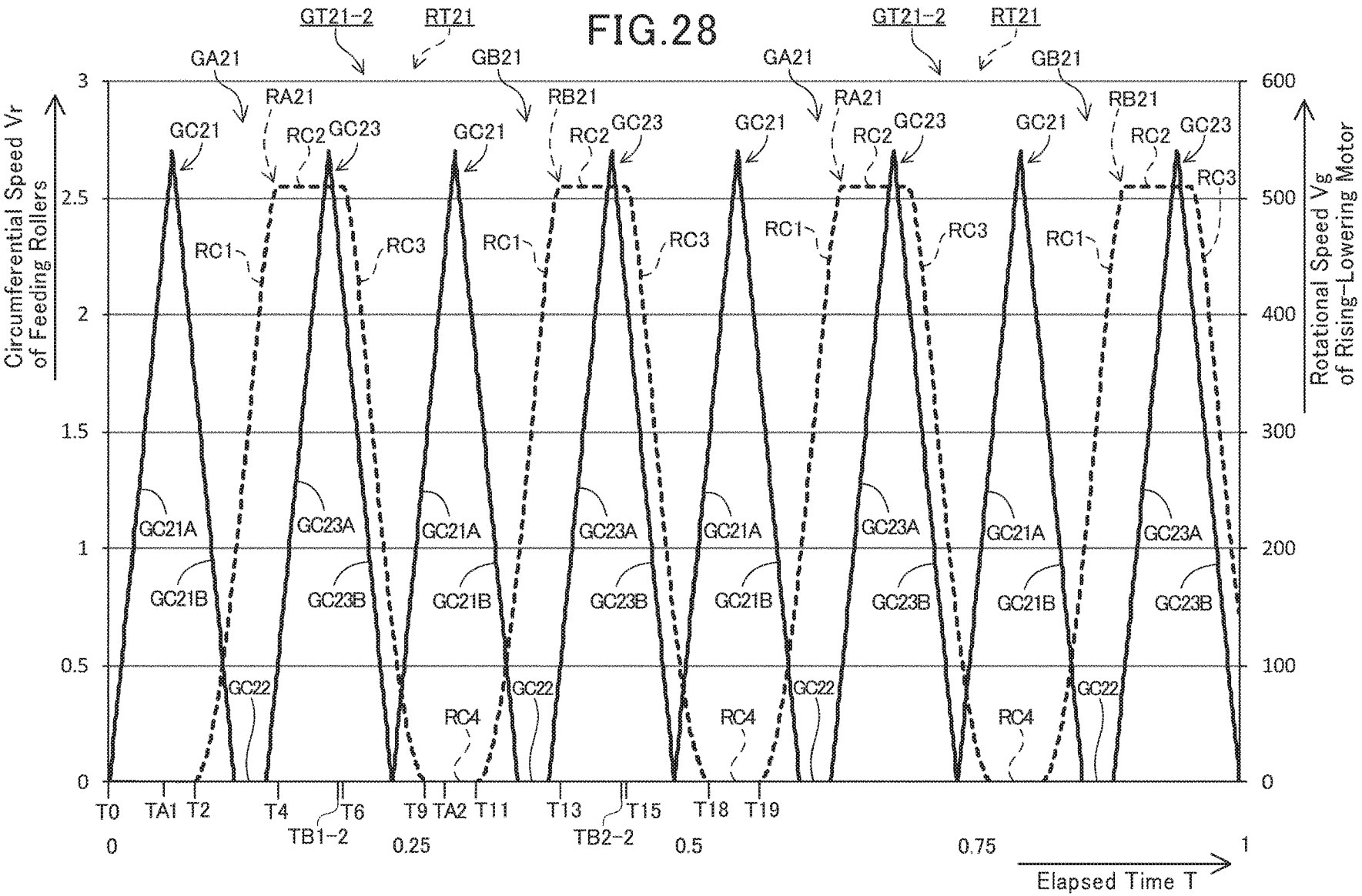
FIG. 28 is a timing chart depicting a temporal relationship between the roller speed control pattern RT21 and a grate raising-lowering speed control pattern GT21-2, in the case where corrugated paperboard sheets SH each having the maximum sheet length are fed in the two-sheet feeding mode.

With reference to FIG. 28, a grate raising-lowering speed control pattern GT21-2 conforming to the maximum sheet length will be described. FIG. 28 is a timing chart presenting a temporal relationship between the roller speed control pattern RT21 and the grate raising-lowering speed control pattern GT21-2, in the case where corrugated paperboard sheets SH to be fed in the two-sheet feeding mode have the maximum sheet length. In the grate raising-lowering speed control pattern GT21-2 depicted in FIG. 28, the same or corresponding portion or region as/to that in the grate raising-lowering speed control pattern GT21 depicted in FIG. 25 will be described by assigning the same reference sign. A roller speed control pattern RT21 depicted in FIG. 28 is the same as the roller speed control pattern RT21 depicted in FIG. 25.

In the grate raising-lowering speed control pattern GT21-2 depicted in FIG. 28, the upper surface of each of the grates 141 is lowered to reach the position PR of the uppermost point of the outer peripheral surface of each of the feeding rollers at the time TA1, and, subsequently, further lowered toward the lowermost position, as with the grate raising-lowering speed control pattern GT21 depicted in FIG. 25. However, differently from the grate raising-lowering speed control sub-pattern GA21 of the grate raising-lowering speed control pattern GT21 depicted in FIG. 25, in a grate raising-lowering speed control sub-pattern GA21 of the grate raising-lowering speed control pattern GT21-2 depicted in FIG. 28, the upper surface of each of the grates 141 is raised to reach the position PR of the uppermost point of the outer peripheral surface of each of the feeding rollers at time TB1-2 which is later than the time TB1 in FIG. 26, and, subsequently, further raised toward the uppermost position. A time point of termination of a deceleration sub-region GC23B of the grate raising-lowering speed control sub-pattern GA21 of the grate raising-lowering speed control pattern GT21-2 becomes later than the time T6 which is a time point of termination of the constant-speed region RC2 of the roller speed control sub-pattern RA21 of the roller speed control pattern RT21. That is, the constant-speed region RC2 of the roller speed control sub-pattern RA21 of the roller speed control pattern RT21 is continued after the time TB1-2 at which the upper surface of each of the grates 141 is raised to reach the position PR, and terminated at the time T6 which is earlier than the time point of termination of the deceleration sub-region GC23B of the grate raising-lowering speed control sub-pattern GA21 of the grate raising-lowering speed control pattern GT21-2.

<Control Operation for Sheet Feeding Operation in One-Sheet Feeding Mode>

A sheet feeding operation of the sheet feeding apparatus 2 will be described, on the assumption that a feeding mode set in conformity to a next order is the two-sheet feeding mode. In order to process corrugated paperboard sheets SH according to a sheet feeding operation in the one-sheet feeding mode, an operator carries out preparatory works, such as replacement of printing die members, replacement of slotter blades and replacement of punching dies. FIG. 1 depicts the corrugated paperboard box making machine 1 in a state after the preparatory works for the one-sheet feeding mode are completed. In advance of the preparatory works, the operator can look at contents displayed on the information display 344 to ascertain that the feeding mode is the one-sheet feeding mode, and a value of the batch-forming sheet number.

The lower-level management device 310 temporarily stores the feeding mode-designating information representing the one-sheet feeding mode, in a given storage area of the working memory 330. Further, according to the order preparation instruction and the feeding mode-designating information, the lower-level management device 310 issues an instruction for adjusting a rotational phase of each of the printing cylinders 25A, 26A, an instruction for adjusting a rotational phase of each of the upper slotters 31B, 32B, and an instruction for adjusting a rotational phase of the die cylinder 33, respectively, to the printing control device 351, the creaser-slotter control device 352 and the die cutter control device 353.

(Creation of Roller Speed Control Pattern RT)

Upon detecting an input manipulation complete signal from the manipulation panel 340 after receiving from the upper-level management device 300 the order preparation instruction for directing preparation for execution of the next order, the lower-level management device 310 reads out the feeding mode-designating information from the working memory 330 and sends the feeding mode designation signal and the order preparation instruction to the roller motor control device 356. According to the feeding mode-designating information, the roller motor control device 356 reads out, from the basic roller drive pattern memory 361, the combination of the basic roller drive pattern BRP11 and the full cycle-stop basic roller drive pattern BRP12, and generates a roller speed control pattern creation instruction. The roller motor control device 356 sends the roller speed control pattern creation instruction to the first motion controller 360.

Upon receiving the roller speed control pattern creation instruction from the roller motor control device 356, the first motion controller 360 reads out the roller speed control pattern creation program from the second program memory 362, and executes the roller speed control pattern creation program. According to execution of the roller speed control pattern creation program, the first motion controller 360 creates a roller speed control pattern RT1 for the one-sheet feeding mode, based on a sheet feeding speed contained in the roller speed control pattern creation instruction, and the basic roller drive pattern BRP11, and temporarily stores the roller speed control pattern RT1 in the first speed control pattern memory 363.

Figure 29:
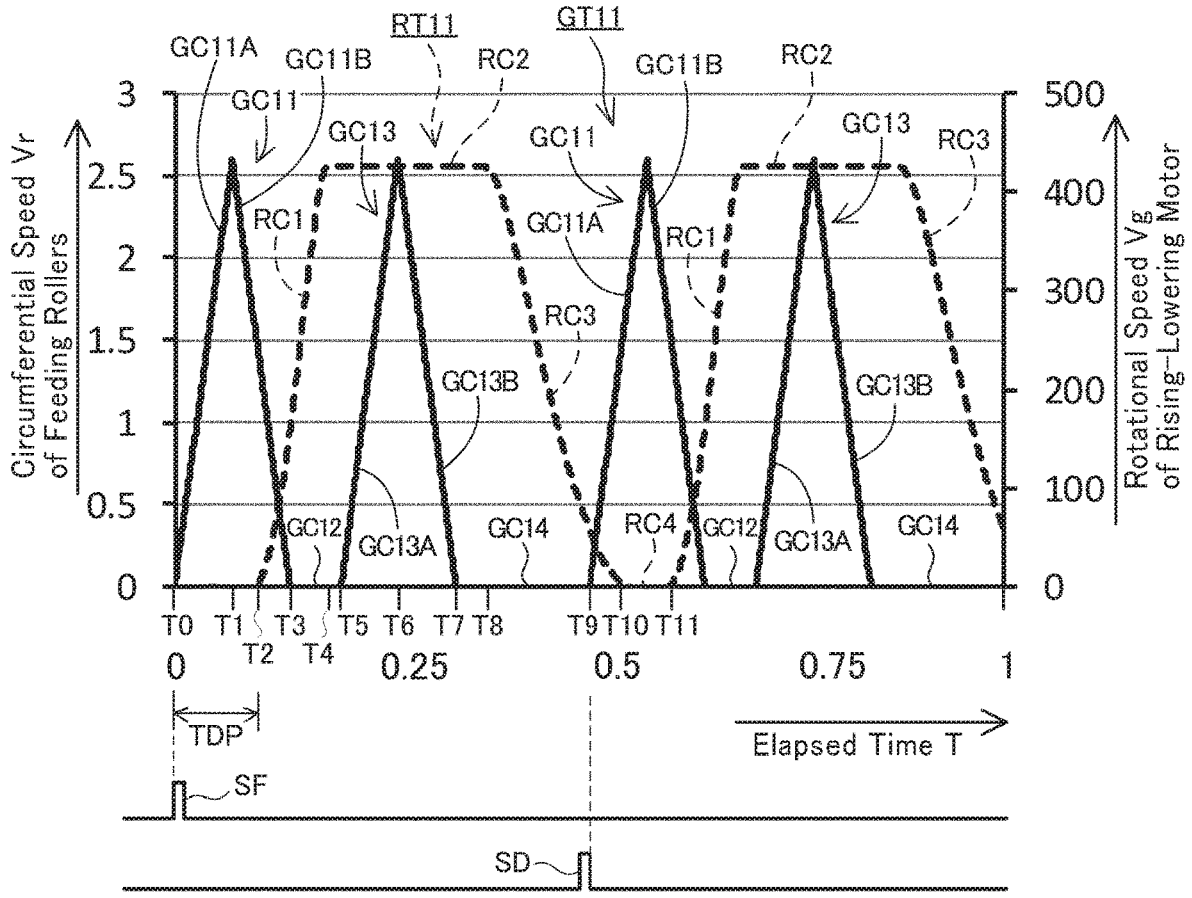
FIG. 29 is a timing chart depicting a temporal relationship among a roller speed control pattern RT11, a grate raising-lowering speed control pattern GT11, the feeding start signal SF and the detection signal SD, in the one-sheet feeding mode.

A process for creating the roller speed control pattern RT1 for the one-sheet feeding mode is the same as that for creating the roller speed control pattern RT2 for the two-sheet feeding mode, and therefore its description will be omitted. In the case where the sheet feeding speed of corrugated paperboard sheets SH in the one-sheet feeding mode is 120 sheets/min, a roller speed control pattern RT11 depicted in FIG. 29 is created. FIG. 29 is a timing chart presenting a temporal relationship among the roller speed control pattern RT11 indicated by the broken lines, a grate raising-lowering speed control pattern GT11 indicated by the solid lines, the feeding start signal SF from the manipulation panel 340, and the detection signal SD from the rotational position sensor 190. In FIG. 29, the horizontal axis represents the elapsed time T by seconds, and the left vertical axis and the right vertical axis represent, respectively, the circumferential speed Vr of each of the feeding rollers by m/sec, and the rotational speed Vg of the raising-lowering motor 80 by rpm.

The roller speed control pattern RT11 is formed for each processing cycle. The roller speed control pattern RT11 comprises, within 0.5 sec, an acceleration region RC1, a constant-speed region RC2, a deceleration region RC3, and a stop region RC4. The acceleration region RC1, the constant-speed region RC2, the deceleration region RC3 and the stop region RC4 correspond, respectively, to the acceleration region BR11, the constant-speed region BR12, the deceleration region BR13 and the stop region BR14 in the basic roller drive pattern BRP1 depicted in FIG. 9A.

As with the creation of the roller speed control pattern RT11, through the processing of converting the rotational angle θp depicted in FIGS. 9A and 9B to the elapsed time T, and the processing of converting the speed ratio Rf depicted in FIGS. 9A and 9B to the circumferential speed Vr of each of the feeding rollers, the first motion controller 360 creates the full cycle-stop roller speed control pattern RT1F in which the circumferential speed Vr of each of the feeding rollers is "0", based on the sheet feeding speed contained in the roller speed control pattern creation instruction and the full cycle-stop basic roller drive pattern BRP12. The full cycle-stop roller speed control pattern RT1F corresponds to the stop region BR15 depicted in FIG. 9B.

(Creation of Order-Specific Grate Raising-Lowering Pattern DGP)

Upon receiving from the upper-level management device 300 the order preparation instruction for directing preparation for execution of the next order, the lower-level management device 310 reads out the grate raising-lowering pattern creation program stored in the first program memory 320 and executes the grate raising-lowering pattern creation program. According to execution of the grate raising-lowering pattern creation program, the lower-level management device 310 creates an order-specific grate raising-lowering pattern DGP conforming to the sheet length of the next processing order, based on one of the two basic grate raising-lowering patterns BGS1, BGL1 stored in the basic grate raising-lowering pattern memory 370, and temporarily stores the order-specific grate raising-lowering pattern DGP in the order-specific grate raising-lowering pattern memory 371. The sheet length of the next order is designated in a range from a minimum sheet length to a maximum sheet length processable in the one-sheet feeding mode. The minimum sheet length processable in the one-sheet feeding mode is set based on the distance LF depicted in FIG. 1, and the maximum sheet length processable in the one-sheet feeding mode is set based on an overall outer peripheral length of each of the printing cylinders. In this embodiment, the lower-level management device 310 reads out a basic grate raising-lowering pattern for the one-sheet feeding mode, in conformity to the sheet length of the next order contained in the order preparation instruction, and the feeding mode designation signal, and creates an order-specific grate raising-lowering pattern DGP.

In the case where the sheet length of the next order is an intermediate length between the minimum sheet length and the maximum sheet length, e.g., 720 mm, an order-specific grate raising-lowering pattern DGP1 is formed in conformity to the sheet length of the next order, based on the basic grate raising-lowering pattern BGL1 for the one-sheet feeding mode depicted in FIG. 13. A process for creating the order-specific grate raising-lowering pattern DGP in the one-sheet feeding mode is the same as that for creating the order-specific grate raising-lowering pattern DGP in the two-sheet feeding mode, and therefore its description will be omitted.

(Creation of Grate Raising-Lowering Speed Control Pattern GT)

After creating the order-specific grate raising-lowering pattern DGP1, the lower-level management device 310 generates a grate raising-lowering speed control pattern creation instruction and sends the grate raising-lowering speed control pattern creation instruction to the second motion controller 380. Upon receiving the grate raising-lowering speed control pattern creation instruction from the lower-level management device 310, the second motion controller 380 reads out the grate raising-lowering speed control pattern creation program from the third program memory 381, and executes the grate raising-lowering speed control pattern creation program. According to execution of the grate raising-lowering speed control pattern creation program, the second motion controller 380 creates a grate raising-lowering speed control pattern GT, based on a sheet feeding speed contained in the grate raising-lowering speed control pattern creation instruction, and the order-specific grate raising-lowering pattern DGP1, and temporarily stores the created grate raising-lowering speed control pattern GT in the second speed control pattern memory 382.

In FIG. 29, the grate raising-lowering speed control pattern GT11 indicated by the solid lines is designed to direct the rotational speed Vg of the raising-lowering motor 80 in the case where the sheet feeding speed of corrugated paperboard sheets SH in the one-sheet feeding mode is 120 sheets/min. The grate raising-lowering speed control pattern GT11 is created for each processing cycle. The grate raising-lowering speed control pattern GT11 comprises, within 0.5 sec, a variable-speed lowering region GC11, a lower-position control region GC12, a variable-speed raising region GC13, and an upper-position control region GC14. A process for creating the grate raising-lowering speed control pattern GT11 for the one-sheet feeding mode is the same as that for creating the grate raising-lowering speed control pattern GT21 for the two-sheet feeding mode, and therefore its description will be omitted.

(Feeding Operation of Corrugated Paperboard Sheets SH)

Figure 30:
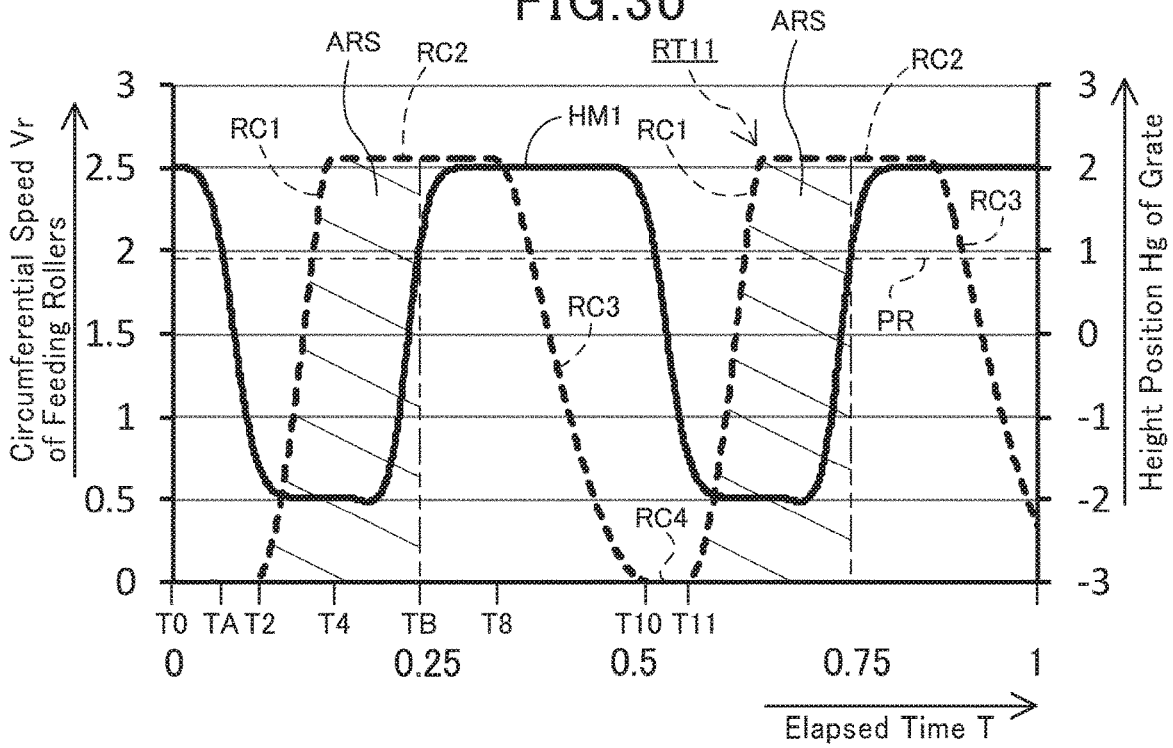
FIG. 30 is a timing chart depicting a temporal relationship between the roller speed control pattern RT11 and a curve HM1 representing a change in height position Hg of the grate, in the one-sheet feeding mode.

With reference to FIGS. 29 and 30, the following description will be made about an operation of feeding corrugated paperboard sheets SH under the condition that the sheet feeding speed in the one-sheet feeding mode is 120 sheets/min. FIG. 30 is a timing chart presenting a temporal relationship between the roller speed control pattern RT11, and a curve HM1 representing a change in height position Hg of each of the grates 141. In FIG. 30, the horizontal axis represents the elapsed time T by seconds, and the left vertical axis and the right vertical axis represent, respectively, the circumferential speed Vr of each of the feeding rollers by m/sec, and the height position Hg of the upper surface of each of the grates 141 by mm.

After completion of preparation for execution of the next order, when an operator manipulates the feeding button 341, the lower-level management device 310 receives the feeding start signal SF from the manipulation panel 340. In response to the received feeding start signal SF, the lower-level management device 310 sends control instruction information containing the feeding start instruction and the sheet feeding speed to each of the drive control device 350 and the roller motor control device 356, and sends, as the motion start instruction, the control instruction information to the second motion controller 380.

In conformity to the sheet feeding speed contained in the control instruction information, the drive control device 350 rotationally drives the main drive motor MT at a rotational speed corresponding to the sheet feeding speed. Along with the rotation of the main drive motor MT, the printing cylinders 25A, 26A of the printing units 25, 26, the upper slotters of the slotter units 31, 32 and others are rotated at a speed corresponding to the sheet feeding speed, e.g., 120 sheets/min.

In response to the motion start instruction, the second motion controller 380 reads out the speed control instructions of the grate raising-lowering speed control pattern GT11 from the second speed control pattern memory 382 at intervals of a given control cycle, and sequentially send the speed control instructions to the second drive control circuit 383. Based on the speed control instructions, and the frequency of the rotation pulses from the encoder 85, the second drive control circuit 383 controls the rotational speed of the raising-lowering motor 80.

As depicted in FIG. 29, the rotational speed of the raising-lowering motor 80 is accelerated from time T0 just after the generation of the feeding start signal SF at the speed change rate per unit time in an acceleration sub-region GC11A. When the elapsed time T reaches time T1, the rotational speed of the raising-lowering motor 80 is decelerated at the speed change rate per unit time in a deceleration sub-region GC11B. When the elapsed time T reaches time T3, the rotation of the raising-lowering motor 80 is stopped. In a time period from the time T0 to the time T3, each of the grates 141 is lowered from the uppermost position and moved to the lowermost position. The upper surface of each of the grates 141 is lowered to reach the position PR of the uppermost point of the outer peripheral surface of each of the feeding rollers, at time TA depicted in FIG. 30, and, subsequently, further lowered toward the lowermost position.

In order to set a start time point T2 of the acceleration region RC1 of roller speed control pattern RT11, the roller motor control device 356 calculates a time period TDP from the time T0 to the time T2, based on the sheet feeding speed contained in the control instruction information, and the phase-difference set value DPP stored in the second program memory 362. Until the elapsed time T becomes equal to the time period TDP, the roller motor control device 356 does not issue any motion start instruction. Thus, the first drive control circuit 364 keeps the roller motors 90, 91, 102, 103 in the stopped state, in the time period TDP from the time point T0 just after the generation of the feeding start signal SF.

When the elapsed time T becomes equal to the time period TDP, the roller motor control device 356 generates the motion start instruction and sends it to the first motion controller 360. In response to the received motion start instruction, the first motion controller 360 reads out the speed control instructions of the roller speed control pattern RT11 from the first speed control pattern memory 363 at intervals of a given control cycle, and, after converting the speed control instructions to rotational speed control instructions for each of the roller motors, sequentially send the rotational speed control instructions to the first drive control circuit 364. Specifically, the speed control instructions are converted to rotational speed control instructions for each of the roller motors, based on the diameter Dr of each of the feeding rollers. Based on the rotational speed control instructions, and the frequency of the rotation pulses from each of the group of encoders 100, 106, 112, 113, the first drive control circuit 364 controls the rotational speed of each of the roller motors.

As depicted in FIG. 29, the elapsed time T reaches the time T2, the rotational speed of each of the roller motors is accelerated at the speed change rate per unit time in the acceleration region RC1. Thus, each of the feeding rollers in the stopped state starts rotating. The time T2 is later than the time TA as depicted in FIG. 30. Therefore, when each of the feeding rollers starts rotating, the lower surface of a bottommost one of the stacked corrugated paperboard sheets SH is in contact with the sheet feed rollers, so that the bottommost corrugated paperboard sheet SH is fed out in the feeding direction FD.

According to the speed control instructions in the lower-position control region GC12, the raising-lowering motor 80 is kept in the stopped state in a time period from the time T3 to time T5. Subsequently, the raising-lowering motor 80 is accelerated in a time period from the time T5 to time T6, according to the speed control instructions in an acceleration sub-region GC13A of the variable-speed raising region GC13, and decelerated in a time period from the time T6 to time T7, according to the speed control instructions in a deceleration sub-region GC13B of the variable-speed raising region GC13. In a time period from the time T5 to the time T7, each of the grates 141 is raised from the lowermost position and moved to the uppermost position. The upper surface of each of the grates 141 is raised to reach the position PR of the uppermost point of the outer peripheral surface of each of the feeding rollers, at time TB depicted in FIG. 30, and, subsequently, further raised toward the uppermost position. In a time period from the time T7 to time T9, the raising-lowering motor 80 is kept in the stopped state according to the speed control instructions in the upper-position control region GC14. In order to generate the speed control instructions in a time period from the time T0 to the time T9, the second motion controller 380 reads out, as a first readout operation, all of the speed control instructions in the four regions GC11 to GC14 of the grate raising-lowering speed control pattern GT11, from the second speed control pattern memory 382. All of the speed control instructions in the four regions GC11 to GC14 are used to feed a first corrugated paperboard sheet SH. In this embodiment, the feeding speed is 120 sheets/min. Thus, the time period from the time T0 to the time T9 is 0.5 sec.

When the elapsed time T reaches the time T9, the lower-level management device 310 receives a first detection signal SD from the rotational position sensor 190. In response to receiving the detection signal SD, the lower-level management device 310 sends control instruction information containing the synchronization instruction and the sheet feeding speed, to each of the drive control device 350 and the roller motor control device 356, and sends, as the motion start instruction, the control instruction information to the second motion controller 380. According to the sheet feeding speed contained in the control instruction information, the drive control device 350 continues to rotationally drive the main drive motor MT at a rotational speed corresponding to the sheet feeding speed.

In response to the motion start instruction, the second motion controller 380 reads out the speed control instructions of the grate raising-lowering speed control pattern GT11 from the second speed control pattern memory 382 at intervals of a given control cycle, and sequentially send the speed control instructions to the second drive control circuit 383. The second motion controller 380 reads out, as a second readout operation, all of the speed control instructions in the four regions GC11 to GC14 of the grate raising-lowering speed control pattern GT11, from the second speed control pattern memory 382. All of the speed control instructions in the four regions GC11 to GC14 are used to feed a second corrugated paperboard sheet SH. After the time T9, in response to each motion start instruction based on the detection signal SD, the second motion controller 380 repeatedly performs the same control processing as that in the time period from the time T0 to the time T9.

In a time period from the time T2 to time T4, each of the roller motors is accelerated at the speed change rate per unit time in an acceleration region RC1, to a rotational speed corresponding to the sheet feeding speed (120 sheets/min). Subsequently, in a time period from the time T4 to time T8, each of the roller motors is kept at a rotational speed corresponding to the sheet feeding speed in a constant-speed region RC2. In a time period from the time T8 to time T10, each of the roller motors is decelerated from the sheet feeding speed, at the speed change rate per unit time a deceleration region RC3. In a time period from the time T10 to time T11, each of the roller motors is kept in the stopped state, in a stop region RC4. In order to generate the speed control instructions in a time period from the time T2 to the time T11, the first motion controller 360 reads out, as a first readout operation, all of the speed control instructions in the four regions RC1 to RC4 of the roller speed control pattern RT11, from the first speed control pattern memory 363. All of the speed control instructions in the four regions RC1 to RC4 are used to feed the first corrugated paperboard sheet SH. In this embodiment, the feeding speed is 120 sheets/min. Thus, the time period from the time T2 to the time T11 is 0.5 sec.

At the time T11 after the elapse of the time period TDP from the time T9 when receiving the synchronization instruction based on the detection signal SD, the roller motor control device 356 generates the motion start instruction and sends it to the first motion controller 360.

In response to the received motion start instruction, the first motion controller 360 reads out the speed control instructions of the roller speed control pattern RT11 from the first speed control pattern memory 363 at intervals of a given control cycle, and sequentially send the speed control instructions to the first drive control circuit 364. The first motion controller 360 reads out, as a second readout operation, all of the speed control instructions in the four regions RC1 to RC4 of the roller speed control pattern RT11, from the first speed control pattern memory 363. All of the speed control instructions in the four regions RC1 to RC4 are used to feed the second corrugated paper board sheet. After the time T11, in response to each motion start instruction based on the synchronization instruction, the first motion controller 360 repeatedly performs the same control processing as that in the time period from the time T2 to the time T11.

The first corrugated paperboard sheet SH starts to be fed from the time T2, and is released from the feeding rollers at the time TB. A distance by which the first corrugated paperboard sheet SH is fed by the feeding rollers corresponds to an area ARS of the shaded region in FIG. 30, and depends on the sheet length.

<Temporary Stopping of Sheet Feeding Operation>

Figure 31A:
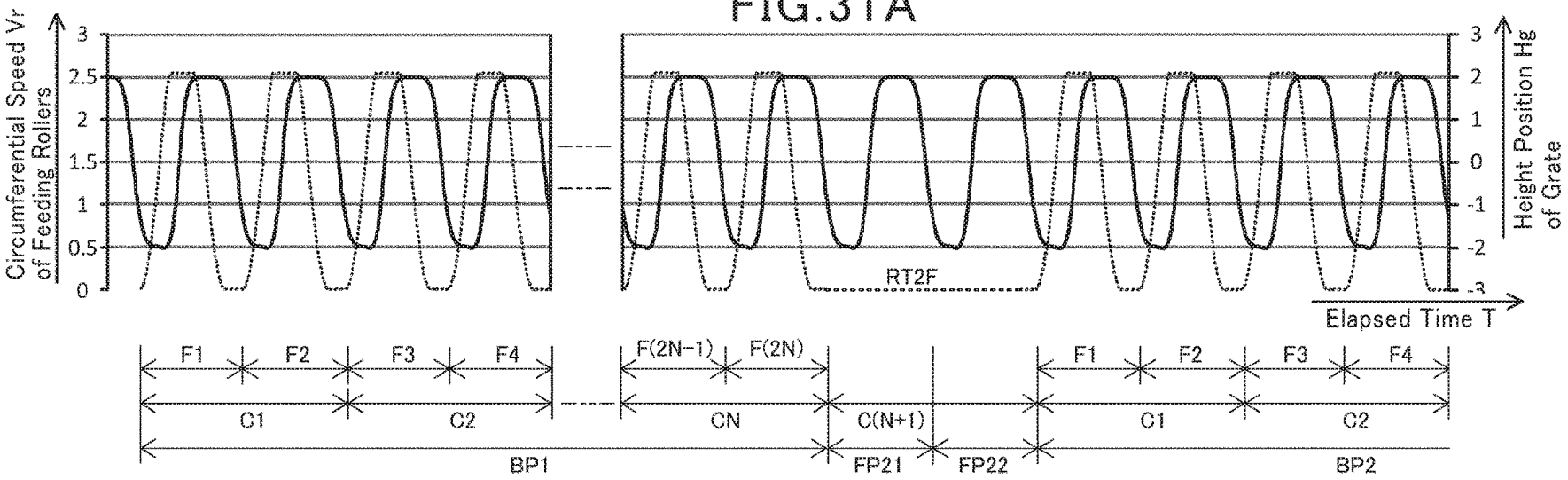
FIG. 31A is a time chart for explaining operation of temporarily stopping a sheet feeding operation, in the two-sheet feeding mode, in the case where a batch-forming sheet number is an even number.
Figure 31B:
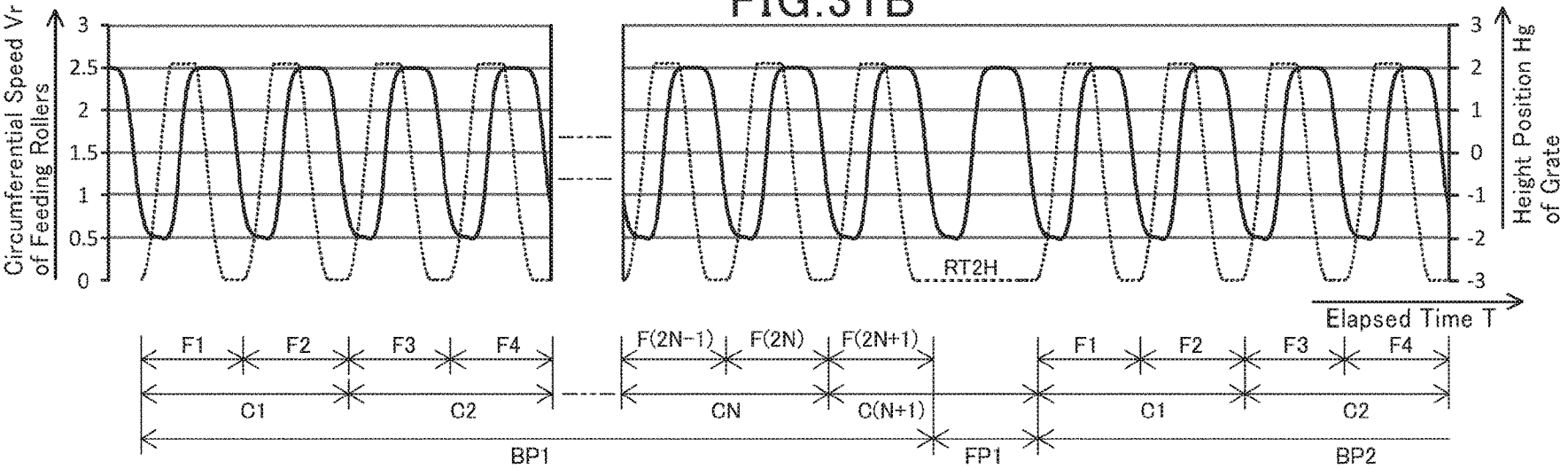
FIG. 31B is a time chart for explaining operation of temporarily stopping the sheet feeding operation, in the two-sheet feeding mode, in the case where the batch-forming sheet number is an odd number.
Figure 32:
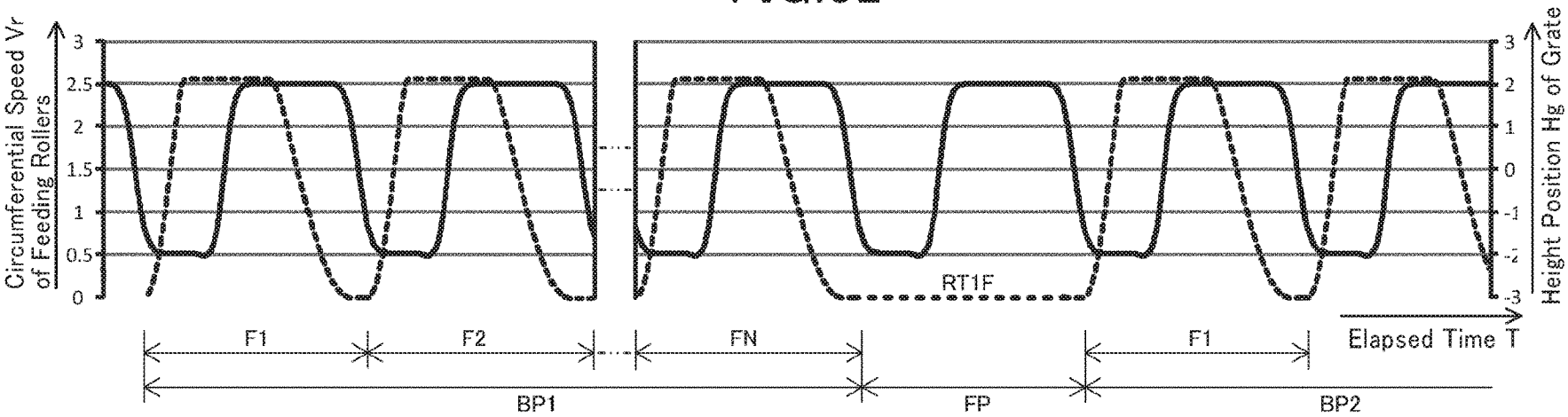
FIG. 32 is a time chart for explaining operation of temporarily stopping the sheet feeding operation, in the one-sheet feeding mode.

With reference to FIGS. 31A and 31B and FIG. 32, the following description will be made about a control operation to be executed by the printing control device 351, the counter-ejector control device 355, the roller motor control device 356 and the first and second motion controllers 360, 380 when the feeding temporary stop instruction is issued in the step S21 depicted in FIG. 19. As one example of temporary stopping of the sheet feeding operation, a temporary stop processing in the two-sheet feeding mode and a temporary stop processing in the one-sheet feeding mode will be described.

<Temporary Stop Processing in Two-Sheet Feeding Mode>

In the case where the two-sheet feeding mode is designated as the feeding mode for the next order, the lower-level management device 310 issues, at the step S21, the two-sheet feeding temporary stop instruction CS21 for directing temporary stop of two cycles of sheet feeding operation, when the batch-forming sheet number is an even number, or the two-sheet feeding temporary stop instruction CS22 for directing temporary stop of one cycle of sheet feeding operation, when the batch-forming sheet number is an odd number. One of the two-sheet feeding temporary stop instructions CS21, CS22 is sent to each of the printing control device 351 and the roller motor control device 356.

(Temporary Stop Processing when Batch-Forming Sheet Number is Even Number)

With reference to FIG. 31A, the temporary stop processing to be executed when the batch-forming sheet number is an even number, in the two-sheet feeding mode, will be described. FIG. 31A is a time chart presenting a temporal relationship between the roller speed control pattern RT21 and the curve HM2 representing a change in height position Hg of the upper surface of each of the grates 141 each depicted in FIG. 26, over two batch feeding periods BP1, BP2, in the case where the batch-forming sheet number (the number of corrugated paperboard sheets forming one batch) is "2N" (where N is an integer of 1 or more). The batch feeding period BP1 is a time period for feeding of a first batch in an order. More specifically, it is a time period from a start of feeding of a first corrugated paperboard sheet after the feeding start signal SF from the manipulation panel 340 is determined to be received, in the step S15 depicted in FIG. 19, through until feeding of a 2N-th corrugated paperboard sheet is completed. The batch feeding period BP2 is a time period for feeding of a second batch in the order. More specifically, it is a time period from a start of feeding of a first corrugated paperboard sheet in the second batch, through until feeding of a 2N-th corrugated paperboard sheet is completed. A sheet feeding period F1 means a sheet feeding period for a first corrugated paperboard sheet in each batch, and a sheet feeding period F(2N) means a sheet feeding period for a 2N-th corrugated paperboard sheet in each batch. A processing cycle period C1 means a time period during which each of the printing cylinders is rotated 360 degrees so as to subject first and second corrugated paperboard sheets in each batch to printing, i.e., a total time period of the sheet feeding period F1 and the sheet feeding period F2. A processing cycle period CN means a time period during which each of the printing cylinders is rotated 360 degrees so as to subject (2N−1)-th and 2N-th corrugated paperboard sheets in each batch to printing, i.e., a total time period of the sheet feeding period F(2N−1) and the sheet feeding period F(2N). A full cycle-stop period C(N−1)

means a time period during which the printing cylinders is rotated 360 degrees without performing printing. A first-half sheet feeding period such as the sheet feeding period F1 in each processing cycle period is a time period during which the roller speed control sub-pattern RA21 of the roller speed control pattern RT21 is generated. A last-half sheet feeding period such as the sheet feeding period F2 in each processing cycle period is a time period during which the roller speed control sub-pattern RB21 of the roller speed control pattern RT21 is generated.

When a leading edge of the 2N-th corrugated paperboard sheet is detected by the sheet sensor SN1 and then the fed-sheet number reaches a value NB which is the batch-forming sheet number, and when the sheet feeding speed is greater than the allowable speed, the lower-level management device 310 sends, at the step S21, the two-sheet feeding temporary stop instruction CS21 for directing temporary stop of two cycles of sheet feeding operation, to the roller motor control device 356. Then, the roller motor control device 356 sends the two-sheet feeding temporary stop instruction CS21 to the first motion controller 360.

Then, when the sheet feeding period F(2N) for the 2N-th corrugated paperboard sheet which is the last corrugated paperboard sheet in the first batch is terminated, the first motion controller 360 reads the speed control instructions of the full cycle-stop roller speed control pattern RT2F from the first speed control pattern memory 363 at intervals of a given control cycle, according to the two-sheet feeding temporary stop instruction CS21. Each of the read-out speed control instructions designates that the circumferential speed of each of the feeding rollers is "0". Thus, the first motion controller 360 converts the read-out speed control instructions to a stop instruction for directing stop of the roller motors, and sends it to the first drive control circuit 364. Based on the stop instruction and the frequency of the rotation pulses from each of the group of encoders 100, 106, 112, 113, the first drive control circuit 364 stops the rotation of each of the roller motors.

A sheet feeding stop period FP21 depicted in FIG. 31A is a first-half period of the full cycle-stop roller speed control pattern RT2F, and is a time period equal to the first-half sheet feeding period such as the sheet feeding period F1 in each processing cycle period. A sheet feeding stop period FP22 depicted in FIG. 31A is a last-half period of the full cycle-stop roller speed control pattern RT2F, and is a time period equal to the last-half sheet feeding period such as the sheet feeding period F2 in each processing cycle period. A full cycle-stop period C(N+1) is a total time period of the sheet feeding stop period FP21 and the sheet feeding stop period FP22.

In the step S21 depicted in FIG. 19, the lower-level management device 310 sends the two-sheet feeding temporary stop instruction CS21 for directing temporary stop of two cycles of sheet feeding operation, to the printing control device 351. According to this two-sheet feeding temporary stop instruction CS21, just after the printing die for subjecting, to printing, the 2N-th corrugated paperboard sheet which is the last corrugated paperboard sheet in each batch, passes through the anilox roll 25E, the printing control device 351 activates the air cylinder 25G to move the anilox roll 25E to the spaced-apart position. A time period during which the anilox roll 25E is moved away from the printing dies 25B1, 25B2 and located at the spaced-apart position is equal to the total time period of the sheet feeding stop periods FP21, FP22 depicted in FIG. 31A, and is equivalent to two sheet feeding periods (two cycles of sheet feeding operation). When a time period equivalent to two sheet feeding periods has elapsed, the printing control device 351 deactivates the air cylinder 25G to move the anilox roll 25E to the contactable position. Further, just after the printing die for subjecting the 2N-th corrugated paperboard sheet of each batch to printing passes through the anilox roll 26E, the printing control device 351 activates the air cylinder 26G to move the anilox roll 26E to the spaced-apart position, according to the two-sheet feeding temporary stop instruction CS21. A time period during which the anilox roll 26E is moved away from the printing dies 26B1, 26B2 and located at the spaced-apart position is equal to the total time period of the sheet feeding stop periods FP21, FP22 depicted in FIG. 31A, and is equivalent to two sheet feeding periods. When a time period equivalent to two sheet feeding periods has elapsed, the printing control device 351 deactivates the air cylinder 26G to move the anilox roll 26E to the contactable position.

When a given time period adjusted in conformity to the sheet length of each order has elapsed after detection of a leading edge of the 2N-th box-structured corrugated paperboard sheet in the batch by the sheet sensor SN2, the counter-ejector control device 355 drives the ledge raising-lowering motor 208 to move the main ledge 46 downwardly from the given standby position to the given lower position. After the 2N-th corrugated paperboard sheet which is the last corrugated paperboard sheet in each batch is fed in the sheet feeding period F(2N), the sheet feeding stop period FP21 and the sheet feeding stop period FP22 are provided as mentioned above. This makes it possible to enable the main ledge 46 to be reliably moved to a given position slightly below the upper conveyance roll 42 before a first box-structured corrugated paperboard sheet in the next batch is fed out from the upper conveyance roll 42 of the sheet transfer apparatus 7.

(Temporary Stop Processing when Batch-Forming Sheet Number is Odd Number)

With reference to FIG. 31B, the temporary stop processing to be executed when the batch-forming sheet number is an odd number, in the two-sheet feeding mode, will be described. FIG. 31B is a time chart presenting a temporal relationship between the roller speed control pattern RT21 and the curve HM2 representing a change in height position Hg of the upper surface of each of the grates 141 each depicted in FIG. 26, over two batch feeding periods BP1, BP2, in the case where the batch-forming sheet number is "2N+1" (where N is an integer of 1 or more). The batch feeding period BP1 is a time period for feeding of a first batch in an order. More specifically, it is a time period from a start of feeding of a first corrugated paperboard sheet after the feeding start signal SF from the manipulation panel 340 is determined to be received, in the step S15 depicted in FIG. 19, through until feeding of a (2N+1)-th corrugated paperboard sheet is completed. The batch feeding period BP2 is a time period for feeding of a second batch in the order. More specifically, it is a time period from a start of feeding of a first corrugated paperboard sheet in the second batch, through until feeding of a (2N+1)-th corrugated paperboard sheet is completed. A sheet feeding period F1 means a sheet feeding period for a first corrugated paperboard sheet in each batch, and a sheet feeding period F(2N+1) means a sheet feeding period for a (2N+1)-th corrugated paperboard sheet in each batch. A processing cycle period C1 means a time period during which each of the printing cylinders is rotated 360 degrees so as to subject first and second corrugated paperboard sheets in each batch to printing, i.e., a total time period of the sheet feeding period F1 and the sheet feeding period F2. A processing cycle period CN means a time period during which each of the printing cylinders is rotated 360 degrees so as to subject (2N−1)-th and 2N-th corrugated paperboard sheets in each batch to printing, i.e., a total time period of the sheet feeding period F(2N−1) and the sheet feeding period F(2N). A half cycle-stop period C(N+1) is a total time period of the sheet feeding period F(2N+1) and a sheet feeding stop period FP1, and is a time period during which the printing cylinders is rotated 360 degrees. A first-half sheet feeding period such as the sheet feeding period F1 in each processing cycle period, or the sheet feeding period F(2N+1), is a time period during which the roller speed control sub-pattern RA21 of the roller speed control pattern RT21 is generated. A last-half sheet feeding period such as the sheet feeding period F2 in each processing cycle period is a time period during which the roller speed control sub-pattern RB21 of the roller speed control pattern RT21 is generated.

When a leading edge of the 2N-th corrugated paperboard sheet is detected by the sheet sensor SN1 and then the fed-sheet number reaches a value NB which is the batch-forming sheet number, and when the sheet feeding speed is greater than the allowable speed, the lower-level management device 310 sends, at the step S21, the two-sheet feeding temporary stop instruction CS22 for directing temporary stop of one cycle of sheet feeding operation, to the roller motor control device 356. Then, the roller motor control device 356 sends the two-sheet feeding temporary stop instruction CS22 to the first motion controller 360.

Then, when the sheet feeding period F(2N) for the 2N-th corrugated paperboard sheet which is the second-last corrugated paperboard sheet in the first batch is terminated, the first motion controller 360 reads the speed control instructions of the half cycle-stop roller speed control pattern RT2H from the first speed control pattern memory 363 at intervals of a given control cycle, according to the two-sheet feeding temporary stop instruction CS22. The half cycle-stop roller speed control pattern RT2H is formed of the roller speed control sub-pattern RA21, and the roller speed control sub-pattern RC21 in which the circumferential speed Vr of each of the feeding rollers is "0". In the sheet feeding period F(2N+1), the first motion controller 360 reads the speed control instructions of the roller speed control sub-pattern RA21 of the half cycle-stop roller speed control pattern RT2H at intervals of a given control cycle, and, after converting the speed control instructions to rotational speed control instructions for each of the roller motor, sends the rotational speed control instructions to the first drive control circuit 364. The speed control instructions are converted to the rotational speed control instructions for each of the roller motor, based on the diameter Dr of each of the feeding rollers. Based on the rotational speed control instructions and the frequency of the rotation pulses from each of the group of encoders 100, 106, 112, 113, the first drive control circuit 364 controls the rotational speed of each of the roller motors 90, 91, 102, 103 to conform to the roller speed control pattern RT21 depicted in FIG. 25. When the sheet feeding period F(2N+1) has elapsed, the first motion controller 360 reads the speed control instructions of the roller speed control sub-pattern RC21 at intervals of a given control cycle. Each of the read-out speed control instructions designates that the circumferential speed of each of the feeding rollers is "0". Thus, the first motion controller 360 converts the read-out speed control instructions to a stop instruction for directing stop of the roller motors, and sends it to the first drive control circuit 364. Based on the stop instruction and the frequency of the rotation pulses from each of the group of encoders 100, 106, 112, 113, the first drive control circuit 364 stops the rotation of each of the roller motors.

The sheet feeding stop period F(2N+1) depicted in FIG. 31B is a first-half period of the half cycle-stop roller speed control pattern RT2H, and is a time period equal to the first-half sheet feeding period such as the sheet feeding period F1 in each processing cycle period. The sheet feeding stop period FP1 depicted in FIG. 31B is a last-half period of the half cycle-stop roller speed control pattern RT2H, and is a time period equal to the last-half sheet feeding period such as the sheet feeding period F2 in each processing cycle period. A half cycle-stop period C(N+1) is a total time period of the sheet feeding period F(2N+1) and the sheet feeding stop period FP1.

In the step S21 depicted in FIG. 19, the lower-level management device 310 sends the two-sheet feeding temporary stop instruction CS22 for directing temporary stop of one cycle of sheet feeding operation, to the printing control device 351. According to this two-sheet feeding temporary stop instruction CS22, when the printing cylinder 25A is rotated 180 degrees after one of the printing dies for subjecting, to printing, the 2N-th corrugated paperboard sheet which is the second-last corrugated paperboard sheet in each batch, passes through the anilox roll 25E, the printing control device 351 activates the air cylinder 25G to move the anilox roll 25E to the spaced-apart position. A time when the printing cylinder 25A is rotated 180 degrees after the one printing die for subjecting the 2N-th corrugated paperboard sheet to printing passes through the anilox roll 25E corresponds a time when the other printing die for subjecting, to printing, the (2N+1)-th corrugated paperboard sheet which is the last corrugated paperboard sheet in each batch, passes through the anilox roll 25E. A time period during which the anilox roll 25E is moved away from the printing dies 25B1, 25B2 and located at the spaced-apart position is equal to the sheet feeding stop period FP1 depicted in FIG. 31B, which is one sheet feeding period (one cycle of sheet feeding operation). When a time period equivalent to one sheet feeding period has elapsed, the printing control device 351 deactivates the air cylinder 25G to move the anilox roll 25E to the contactable position. Further, when the printing cylinder 26A is rotated 180 degrees after one of the printing dies for subjecting, to printing, the 2N-th corrugated paperboard sheet which is the second-last corrugated paperboard sheet in each batch, passes through the anilox roll 26E, the printing control device 351 activates the air cylinder 26G to move the anilox roll 26E to the spaced-apart position, according to the two-sheet feeding temporary stop instruction CS22. A time when the printing cylinder 26A is rotated 180 degrees after the one printing die for subjecting the 2N-th corrugated paperboard sheet to printing passes through the anilox roll 26E corresponds a time when the other printing die for subjecting, to printing, the (2N+1)-th corrugated paperboard sheet which is the last corrugated paperboard sheet in each batch, passes through the anilox roll 26E. A time period during which the anilox roll 26E is moved away from the printing dies 26B1, 26B2 and located at the spaced-apart position is equal to the sheet feeding stop period FP1 depicted in FIG. 31B, which is one sheet feeding period.

When a time period equivalent to one sheet feeding period has elapsed, the printing control device 351 deactivates the air cylinder 26G to move the anilox roll 26E to the contactable position.

When a given time period adjusted in conformity to the sheet length of each order has elapsed after detection of a leading edge of the (2N+1)-th box-structured corrugated paperboard sheet in the batch by the sheet sensor SN2, the counter-ejector control device 355 drives the ledge raising-lowering motor 208 to move the main ledge 46 downwardly from the given standby position to the given lower position. After the (2N+1)-th corrugated paperboard sheet which is the last corrugated paperboard sheet in each batch is fed in the sheet feeding period F(2N+1), the sheet feeding stop period FP1 is provided as mentioned above. This makes it possible to enable the main ledge 46 to be reliably moved to a given position slightly below the upper conveyance roll 42 before a first box-structured corrugated paperboard sheet in the next batch is fed out from the upper conveyance roll 42 of the sheet transfer apparatus 7.

<Temporary Stop Processing in One-Sheet Feeding Mode>

In the case where the one-sheet feeding mode is designated as the feeding mode for the next order, the lower-level management device 310 issues, at the step S21, the one-sheet feeding temporary stop instruction CS1 for directing temporary stop of one cycle of sheet feeding operation. The one-sheet feeding temporary stop instruction CS1 is sent to each of the printing control device 351 and the roller motor control device 356.

With reference to FIG. 32, the temporary stop processing to be executed in the one-sheet feeding mode will be described. FIG. 32 is a time chart presenting a temporal relationship between the roller speed control pattern RT11 and the curve HM1 representing a change in height position Hg of the upper surface of each of the grates 141 each depicted in FIG. 30, over two batch feeding periods BP1, BP2, in the case where the batch-forming sheet number (the number of corrugated paperboard sheets forming one batch) is "N" (where N is an integer of 1 or more). The batch feeding period BP1 is a time period for feeding of a first batch in an order. More specifically, it is a time period from a start of feeding of a first corrugated paperboard sheet after the feeding start signal SF from the manipulation panel 340 is determined to be received, in the step S15 depicted in FIG. 19, through until feeding of an N-th corrugated paperboard sheet is completed. The batch feeding period BP2 is a time period for feeding of a second batch in the order. More specifically, it is a time period from a start of feeding of a first corrugated paperboard sheet in the second batch, through until feeding of an N-th corrugated paperboard sheet is completed. A sheet feeding period F1 means a sheet feeding period for a first corrugated paperboard sheet in each batch, and a sheet feeding period FN means a sheet feeding period for a N-th corrugated paperboard sheet in each batch. Each of the sheet feeding periods F1 to FN is equal to a processing (printing) cycle period during which each of the printing cylinders is rotated 360 degrees so as to subject each corrugated paperboard sheet in each batch to printing. A sheet feeding stop period FP depicted in FIG. 32 is a time period in which the full cycle-stop roller speed control pattern RT1F is generated, and which is equal to each of the sheet feeding periods.

When a leading edge of the N-th corrugated paperboard sheet is detected by the sheet sensor SN1 and then the fed-sheet number reaches a value NB which is the batch-forming sheet number, and when the sheet feeding speed is greater than the allowable speed, the lower-level management device 310 sends, at the step S21, the one-sheet feeding temporary stop instruction CS1 for directing temporary stop of one cycle of sheet feeding operation, to the roller motor control device 356. Then, the roller motor control device 356 sends the one-sheet feeding temporary stop instruction CS1 to the first motion controller 360.

Then, when the sheet feeding period FN for the N-th corrugated paperboard sheet which is the last corrugated paperboard sheet in the first batch is terminated, the first motion controller 360 reads the speed control instructions of the full cycle-stop roller speed control pattern RT1F from the first speed control pattern memory 363 at intervals of a given control cycle, according to the one-sheet feeding temporary stop instruction CS1. Each of the read-out speed control instructions designates that the circumferential speed of each of the feeding rollers is "0". Thus, the first motion controller 360 converts the read-out speed control instructions to a stop instruction for directing stop of the roller motors, and sends it to the first drive control circuit 364. Based on the stop instruction and the frequency of the rotation pulses from each of the group of encoders 100, 106, 112, 113, the first drive control circuit 364 stops the rotation of each of the roller motors.

In the step S21 depicted in FIG. 19, the lower-level management device 310 sends the one-sheet feeding temporary stop instruction CS1 for directing temporary stop of one cycle of sheet feeding operation, to the printing control device 351. According to this one-sheet feeding temporary stop instruction CS1, just after the printing die for subjecting, to printing, the N-th corrugated paperboard sheet which is the last corrugated paperboard sheet in each batch, passes through the anilox roll 25E, the printing control device 351 activates the air cylinder 25G to move the anilox roll 25E to the spaced-apart position. A time period during which the anilox roll 25E is moved away from the printing die 25B and located at the spaced-apart position is equal to the sheet feeding stop period FP depicted in FIG. 32, and is equivalent to one sheet feeding period (one cycle of sheet feeding operation). When a time period equivalent to one sheet feeding period has elapsed, the printing control device 351 deactivates the air cylinder 25G to move the anilox roll 25E to the contactable position. Further, just after the printing die for subjecting the 2N-th corrugated paperboard sheet of each batch to printing passes through the anilox roll 26E, the printing control device 351 activates the air cylinder 26G to move the anilox roll 26E to the spaced-apart position, according to the one-sheet feeding temporary stop instruction CS21. A time period during which the anilox roll 26E is moved away from the printing die 26B and located at the spaced-apart position is equal to the total time period of the sheet feeding stop period FP depicted in FIG. 32, and is equivalent to one sheet feeding period. When a time period equivalent to one sheet feeding period has elapsed, the printing control device 351 deactivates the air cylinder 26G to move the anilox roll 26E to the contactable position.

When a given time period adjusted in conformity to the sheet length of each order has elapsed after detection of a leading edge of the N-th box-structured corrugated paperboard sheet in the batch by the sheet sensor SN2, the counter-ejector control device 355 drives the ledge raising-lowering motor 208 to move the main ledge 46 downwardly from the given standby position to the given lower position. After the N-th corrugated paperboard sheet which is the last corrugated paperboard sheet in each batch is fed in the sheet feeding period FN, the sheet feeding stop period FP is provided as mentioned above. This makes it possible to enable the main ledge 46 to be reliably moved to a given position slightly below the upper conveyance roll 42 before a first box-structured corrugated paperboard sheet in the next batch is fed out from the upper conveyance roll 42 of the sheet transfer apparatus 7.

Advantageous Effects of Embodiment

Generally, along with an increase in sheet length of a corrugated paperboard sheet in the feeding direction FD, a time period during which a box-structured corrugated paperboard sheet is fed out from the upper conveyance roll 42 of the sheet transfer apparatus 7 into the counter-ejector becomes longer. In order to enable the main ledge to enter between the last box-structured corrugated paperboard sheet in the previous batch and the first box-structured corrugated paperboard sheet in the next batch so as to separate between the batches, it is necessary to set the sheet feeding speed to a value equal to or less than an allowable speed which is determined according to the sheet length. However, there is a need for setting the sheet feeding speed as high as possible. Considering this need, in the above embodiment, at least one sheet feeding stop period, such as the sheet feeding stop period FP, FP1, FP21 or FP22 depicted in FIGS. 31 and 32, is provided after an elapse of a sheet feeding period of the last corrugated paperboard sheet in a batch, so that it becomes possible to reliably separate a batch without collision between the main ledge 46 and a box-structured corrugated paperboard sheet, and set the sheet feeding speed to a value greater than the allowable speed.

In the above embodiment, in a situation where the sheet feeding speed is set to be greater than the allowable speed, when the feeding mode is the two-sheet feeding mode, and the batch-forming sheet number is an even number, two sheet feeding stop periods FP21, FP22 are provided after an elapse of the sheet feeding period F(2N) of the last corrugated paperboard sheet in each batch, as depicted in FIG. 31A. Further, when the feeding mode is the two-sheet feeding mode, and the batch-forming sheet number is an odd number, one sheet feeding stop period FP1 is provided after an elapse of the sheet feeding period F(2N+1) of the last corrugated paperboard sheet in each batch, as depicted in FIG. 31B. On the other hand, when the feeding mode is the one-sheet feeding mode, one sheet feeding stop period FP is provided after an elapse of the sheet feeding period FN of the last corrugated paperboard sheet in each batch, as depicted in FIG. 32. This makes it possible to enable each of the printing cylinders 25A, 26A of the printer 3 to face, at a predetermined rotational phase, the first corrugated paperboard sheet in the next batch fed to be subjected to printing, irrespective of whether the batch-forming sheet number is an even number or an odd number and whether the feeding mode is the one-sheet feeding mode or the two-sheet feeding mode, and thus subject the corrugated paperboard sheets in the batch to printing with good positional accuracy.

In the above embodiment, according to the roller speed control pattern RT21 and the grate raising-lowering speed control pattern GT21 depicted in FIG. 25, or the roller speed control pattern RT11 and the grate raising-lowering speed control pattern GT11 depicted in FIG. 29, the sheet feeding operation of corrugated paperboard sheets is controlled by the first and second motion controllers 360, 380. This makes it possible to relatively easily execute control processing of changing the feeding mode and control processing of changing the sheet feeding stop period, while eliminating a need for complicated mechanical adjustments such as adjustment of rotational phase of a control cam.

In the above embodiment, as depicted in FIGS. 25 and 29, in order to enable the sheet feeding apparatus 2 to perform the sheet feeding operation of corrugated paperboard sheets, the speed control instructions of the grate raising-lowering speed control pattern such as the grate raising-lowering speed control pattern GT21 or GT11 are generated at a timing earlier than the speed control instructions of the roller speed control pattern such as the roller speed control pattern RT21 or RT11 by the time period TDP. Similarly, for the temporary stopping of the sheet feeding operation, the speed control instructions of the grate raising-lowering speed control pattern are generated at a timing earlier than the speed control instructions of each of the full cycle-stop roller speed control pattern RT2F, the half cycle-stop roller speed control pattern RT2H and the full cycle-stop roller speed control pattern RT1F by the time period TDP. Further, in the above embodiment, for the temporary stopping of the sheet feeding operation, a technique of stopping the rotation of each of the roller motors 90, 91, 102, 103 is employed. Thus, as compared to a technique of stopping the rotation of the raising-lowering motor 80, the technique of stopping the rotation of each of the roller motors 90, 91, 102, 103 makes it possible to enable the roller motor control device 356 to execute control processing for switching from a sheet feeding state to a temporary stop state, in the sheet feeding period before the sheet feeding stop period FP21, FP1 or FP, with a margin comprising at least the time period TDP. In addition, in order to achieve the temporary stopping, it is only necessary for the first drive control circuit 364 to execute control of stopping the rotation of each of the roller motors 90, 91, 102, 193. Thus, accuracy required for stop positions of the roller motors is not so high, as compared to a technique of controlling the rotational phase of the raising-lowering motor 80 to enable each of the grates 141 to stop at a given position above the table 20 so as to achieve the temporal stop. Therefore, it becomes possible to stop the sheet feeding operation by a simple control processing.

In the above embodiment, the motion conversion mechanism 140 comprises the support mechanisms 142 and the swing mechanism 143. The swing mechanism 143 is configured to convert the unidirectional rotation of the raising-lowering motor 80 to the swinging motion of the swingable member 172. The raising-lowering coupling shaft 173 is configured to be swung by the given angle θs along with the winging motion of the swingable member 172. The support mechanisms 142 are configured to raise and lower each of the grates 141 along with the bidirectional swing motion. Thus, the first motion controller 380 and the first drive control circuit 383 can simply control the unidirectional control of the raising-lowering motor 80 without any need for controlling the rotational position of the raising-lowering motor in different rotational directions. Therefore, it becomes possible to accurately control a feeding timing and a feeding amount of each corrugated paperboard sheet SH.

In the above embodiment, the lower-level management device 310 and the second motion controller 380 are operable to calculate the grate raising-lowering speed control pattern GT21, based on one of the basic grate raising-lowering patterns BGS1, BGL1, BGS2, BGL2, the sheet feeding speed, and the feeding mode. Thus, as compared to a technique of preliminarily storing in a storage area a variety of grate raising-lowering speed control patterns conforming to various sheet lengths, sheet feeding speeds and feeding modes, it becomes possible to cope with various orders which are different in terms of sheet length and sheet feeding speed, and create a variety of grate raising-lowering speed control patterns, using a relatively small amount of data and control instructions.

Correspondence Relationship Between Respective Elements of Embodiment and Appended Claims The corrugated paperboard box making machine 1 and the sheet feeding apparatus 2 are, respectively, examples of a corrugated paperboard box making machine and a sheet feeding apparatus recited in the appended claims. The printer 3 is an example of a processing apparatus recited in the appended claims, and an example of a printer recited in the appended claims. The folder-gluer 6 and the counter-ejector 8 are, respectively, examples of a folder-gluer and a counter-ejector recited in the appended claims. The printing cylinder (25A, 26A), the printing die (25B, 26B) and the ink application mechanism (25C, 26C) are, respectively, examples of a printing cylinder, a printing die and an application mechanism recited in the appended claims. The raising-lowering motor 80, the roller motor (90, 91, 102, 103), the feeding roller (124 to 127), the motion conversion mechanism 140 and the grate 141 are, respectively, examples of a raising-lowering motor, a roller drive motor, a feeding roller, a motion conversion mechanism and a grate recited in the appended claims. The sheet feeding speed change button 343 and the information display 344 are, respectively, examples of a manipulation section and a display unit recited in the appended claims. A combination of the lower-level management device 310, the roller motor control device 356 and the first and second controllers 360, 380 is an example of a control apparatus recited in the appended claims. The grate raising-lowering speed control pattern GT21 is an example of a raising-lowering speed control pattern recited in the appended claims.

[Modifications]

An advantageous embodiment of the present invention has been shown and described. It is obvious to a person of ordinary skill in the art that various changes and modifications may be made therein without departing from the spirit and scope thereof as set forth in appended claims.

(1) In the above embodiment, as depicted in FIG. 19, it is determined, in the step S10, whether or not the sheet feeding speed changing manipulation has been performed, and then it is determined, in the step S15, whether or not the sheet feeding start manipulation has been performed. However, the present invention is not limited thereto. For example, the routine may be configured such that the step of the determination about the sheet feeding speed changing manipulation is set as a subsequent step with respect to the determination about the sheet feeding start manipulation. That is, the routine may be configured such that the sheet feeding speed is changed after start of the sheet feeding operation. In this modification, it is determined, during the sheet feeding operation, whether or not the sheet feeding speed is greater than the allowable speed, wherein, when the sheet feeding speed is determined to be greater than the allowable speed, the sheet feeding stop control is set.

(2) In the above embodiment, when the feeding mode is the two-sheet feeding mode, and the batch-forming sheet number is an even number, two sheet feeding stop periods FP21, FP22 are provided after the elapse of the sheet feeding period F(2N) of the last corrugated paperboard sheet in the batch, as depicted in FIG. 31A. On the other hand, when the feeding mode is the two-sheet feeding mode, and the batch-forming sheet number is an odd number, one sheet feeding stop period FP1 is provided after the elapse of the sheet feeding period F(2N+1) of the last corrugated paperboard sheet in the batch, as depicted in FIG. 31B. Alternatively, when the feeding mode is the two-sheet feeding mode, and the batch-forming sheet number is an even number, one sheet feeding stop period may be provided after the elapse of the sheet feeding period F(2N) of the last corrugated paperboard sheet in the batch. In this modification, in place of the full cycle-stop basic roller drive pattern BRP2 illustrated in FIG. 10A, a half cycle-stop basic roller drive pattern different from the half cycle-stop basic roller drive pattern BRP22 depicted in FIG. 10B is stored. This alternative half cycle-stop basic roller drive pattern has only the basic roller drive sub-pattern BRP2B depicted in FIG. 10A, which appears when the rotational angle θp is in the range of 180 degree to 360 degrees.

(3) In the above embodiment, when a given time period adjusted in conformity to the sheet length of each order has elapsed after detection of the leading edge of the last box-structured corrugated paperboard sheet in the batch by the sheet sensor SN2, the counter-ejector control device 355 drives the ledge raising-lowering motor 208 to move the main ledge 46 downwardly from the given standby position to the given lower position. When the batch-forming sheet number becomes smaller, the main ledge 46 is more likely to become unable to return from the given lower position to the standby position before the elapse of the time period adjusted in conformity to the sheet length of each batch. Therefore, as to a batch whose sheet number is small enough to cause the situation where the main ledge 46 cannot return from the given lower position to the standby position before the elapse of the time period adjusted in conformity to the sheet length of each batch, it is necessary to provide the sheet feeding stop period. In the above embodiment, in the step S7 depicted in FIG. 19, the allowable speed Sa (sheets/min) is calculated based on the outer peripheral length Cp (mm) of each of the printing cylinders 25A, 26A, the feeding mode, the given downward-movement time period Td (sec) of the main ledge 46, and the sheet length Ls (mm). However, the present invention is not limited thereto. For example, in addition to the outer peripheral length Cp (mm) of each of the printing cylinders 25A, 26A, the feeding mode, the given downward-movement time period Td (sec) of the main ledge 46, and the sheet length Ls (mm), the allowable speed Sa (sheets/min) may be determined while taking into account the batch-forming sheet number. More specifically, in the situation where the batch-forming sheet number is less than a minimum sheet number which poses hindrance to the return of the main ledge to the standby position, the allowable speed Sa may be calculated based on a time period obtained by adding a correction time period according to the batch-forming sheet number to the downward-movement time period Td.

(4) In the above embodiment, the lower-level management device 310 creates the order-specific grate raising-lowering pattern DGP, based on one of the basic grate raising-lowering patterns BGS1, BGL1, BGS2, BGL2, the sheet length of the next processing order, and the feeding mode-designating information. Subsequently, the second motion controller 380 creates the grate raising-lowering speed control pattern GT based on the order-specific grate raising-lowering pattern DGP and the sheet feeding speed. In the above embodiment, the lower-level management device 310 having a relatively high processing capacity has charge of a part of the processing of creating the grate raising-lowering speed control pattern GT, so that it is possible to quickly and reliably create a large variety of grate raising-lowering speed control patterns GT. In place of this configuration in the above embodiment, the second motion controller 380 may be configured to create the order-specific grate raising-lowering pattern DGP and the grate raising-lowering speed control pattern GT by itself.

(5) In the above embodiment, each of the basic roller drive patterns BRP11, BRP21 is set based on the maximum sheet length processable by the corrugated paperboard box making machine 1, and is therefore fixedly stored in the basic roller drive pattern memory 361. However, with a view to coping with various types of corrugated paperboard box making machines, the lower-level management device 310 or the roller motor control device 356 may be configured to, when a value of the maximum sheet length determined by the configuration of a corrugated paperboard box making machine used is input from the manipulation panel, create one of the basic roller drive patterns BRP11, BRP21, based on the input maximum sheet length.

(6) In the above embodiment, the basic grate raising-lowering pattern memory 370 fixedly stores therein the four basic grate raising-lowering patterns BGS1, BGL1, BGS2, BGL2. When the sheet length of an order is small so that an overlapping area is formed between the variable-speed lowering region and the variable-speed raising region, as indicated by the shaded region in FIG. 11, the lower-level management device 310 creates the order-specific grate raising-lowering pattern DGP, based in the basic grate raising-lowering pattern BGS1 depicted in FIG. 11 or the basic grate raising-lowering pattern BGS2 depicted in FIG. 15. On the other hand, when the sheet length of an order is large so that the variable-speed lowering region and the variable-speed raising region are disposed in spaced-apart relation as depicted in FIG. 13, the lower-level management device 310 creates the order-specific grate raising-lowering pattern DGP, based in the basic grate raising-lowering pattern BGL1 depicted in FIG. 13 or the basic grate raising-lowering pattern BGL2 depicted in FIG. 17. However, the technique of creating the order-specific grate raising-lowering pattern DGP in conformity to the sheet length of each order is not limited thereto. For example, in one modification, the basic grate raising-lowering pattern memory 370 may fixedly store therein only one basic grate raising-lowering pattern, e.g., the basic grate raising-lowering pattern BGL1. Further, the lower-level management device 310 may be configured to change an interval between the variable-speed lowering region and the variable-speed raising region of the one basic grate raising-lowering pattern, according to the sheet length of each order, to thereby create the order-specific grate raising-lowering pattern DGP. In another modification, the lower-level management device 310 may be configured create the order-specific grate raising-lowering pattern DGP, based on the sheet length of each processing order, a time period and a speed change rate per unit time in each of the acceleration sub-region and the deceleration sub-region, without providing any basic grate raising-lowering pattern.

(7) In the above embodiment, creation of the roller speed control pattern RT21 and the grate raising-lowering speed control pattern GT21 has been described based on an example where the sheet feeding speed is kept constant during execution of an order. However, in the case where the sheet feeding speed is changed to a plurality of different values during execution of an order, a plurality of types of roller speed control pattern RT and a plurality of types of grate raising-lowering speed control pattern GT are created based on the plurality of different sheet feeding speeds and stored, respectively, in the first and second speed control pattern memories 363, 382.

(8) In the above embodiment, the upper-level management device 300 preliminarily stores, as a production management plan, the feeding mode-designating information for designating the feeding mode for each order, and, when preparing for execution of each order, the feeding mode-designating information is temporarily stored in the working memory 330. However, the present invention is not limited thereto. For example, the manipulation panel may comprise a feeding mode designation key, and the feeding mode-designating information for designating the feeding mode for each order may be generated in response to manipulation of the feeding mode designation key by an operator, and then temporarily stored in the working memory 330.

(9) In the above embodiment, in order to convert the unidirectional rotation of the single raising-lowering motor 80 to the raising-lowering motion of the grate 141, the motion conversion mechanism 140 comprises the support mechanisms 142 and the swing mechanism 143. However, the present invention is not limited thereto. For example, in one modification, the motion conversion mechanism comprises two raising-lowering motors and two eccentric rotors. The eccentric rotors are fixed, respectively, to two raising-lowering drive shafts, and each of the eccentric rotors has a circular outer peripheral surface eccentric with respect to a rotational center of a corresponding one of the raising-lowering drive shafts. Rotary shafts of the raising-lowering motors are coupled, respectively, to the raising-lowering drive shafts through heretofore-known transmission means such as a transmission belt. The two eccentric rotors are disposed such that the outer peripheral surfaces thereof support, respectively, a left end and a right end of the grate from therebelow. The second motion controller 380 and the second drive control circuit 383 are configured to control the raising-lowering motors such that they are unidirectionally rotated in a synchronized manner. According to such synchronous rotation of the raising-lowering motors, the eccentric rotors are operable to raise and lower the grate. In another modification, the motion conversion mechanism comprises two raising-lowering motors, two rotors, and two coupling rods. Two coupling pins are fixed, respectively, to the rotors, at positions eccentric with respect to respective (horizontally-extending) rotational centers of the rotors. One of the coupling rods has a lower end coupled to one of the rotors via one of the coupling pins, and an upper end coupled to a left end of the grate. The other coupling rod has a lower end coupled to the other rotor via the other coupling pin, and an upper end coupled to a right end of the grate. Rotary shafts of the raising-lowering motors are coupled, respectively, to rotary shafts of the rotors through heretofore-known transmission means such as a transmission belt. The second motion controller 380 and the second drive control circuit 383 are configured to control the raising-lowering motors such that they are unidirectionally rotated in a synchronized manner. According to such synchronous rotation of the raising-lowering motors, the coupling rods are operable to raise and lower the grate.

What is claimed is:

1. A corrugated paperboard box making machine comprising:

a sheet feeding apparatus configured to repeatedly perform a sheet feeding operation that feeds one corrugated paperboard sheet at a time in synchronism with continuous regular operation cycles, each of which corresponds to a length of one sheet feeding operation, the corrugated paperboard sheet having one of different sheet lengths that is specified by an order;

a processing apparatus positioned downstream of the sheet feeding apparatus, the processing apparatus comprising a processing cylinder configured for rotation to process each of the corrugated paperboard sheets fed from the sheet feeding apparatus;

a folder-gluer positioned downstream of the processing apparatus and configured to fold and glue each of the processed corrugated paperboard sheets to form each of the processed corrugated paperboard sheets in a box structure;

a counter-ejector positioned downstream of the folder-gluer and configured to make a stack of the box-structured corrugated paperboard sheets, wherein the counter-ejector is configured to count a number of the box-structured corrugated paperboard sheets fed from the folder-gluer and eject the stack of the box-structured corrugated paperboard sheets as a batch when the count reaches a batch-forming sheet number;

a speed selector configured for an operator to set a sheet feeding speed at which the corrugated paperboard sheets are to be fed from the sheet feeding apparatus, wherein the speed selector is configured to allow the operator to set an over-limit sheet feeding speed that is greater than a maximum sheet feeding speed with which the counter-ejector can keep up to make a stack of the box-structured corrugated paperboard sheets and elect the batch of the box-structured corrugated paperboard sheets; and a control apparatus programmed to control the sheet feeding apparatus and the processing apparatus to continuously produce batches of the box-structured corrugated paperboard sheets to fulfill the order in which an ordered number of the box-structured corrugated paperboard sheets is larger than the batch-forming sheet number, wherein the control apparatus is programmed to control the sheet feeding apparatus to stop the sheet feeding operation, while fulfilling the order during a break time equal to at least one operation cycle between two consecutive batches, when the sheet feeding speed set by the speed selector is the over-limit sheet feeding speed, and the control apparatus is further programmed to control the processing apparatus to continuously process each of the corrugated paperboard sheets during the break time.

2. The corrugated paperboard box making machine according to claim 1, wherein the control apparatus is programmed to determine whether or not the over-limit sheet feeding speed is set by the speed selector, and in response to determination that the over-limit sheet feeding speed is, set by the speed selector, the control apparatus is programmed to control the sheet feeding apparatus to stop the sheet feeding operation between the two consecutive batches, while fulfilling the order, for the break time.

3. The corrugated paperboard box making machine according to claim 1, wherein the control apparatus is programmed to operate a display unit to separately display thereon (i) an upper limit speed which is a maximum feeding speed for the sheet feeding apparatus to feed the corrugated paperboard sheets, (ii) the sheet feeding speed set by the speed selector, and (iii) the maximum sheet feeding speed, and wherein the speed selector is configured to allow the operator to set the sheet feeding speed within a speed range including an upper limit equal to or less than the upper limit speed.

4. The corrugated paperboard box making machine according to claim 1, wherein the processing apparatus comprises a printer configured to print a printing pattern on each of the corrugated paperboard sheets, the printer comprising a printing cylinder to which a printing die having the printing pattern is attached, and wherein the control apparatus is programmed to operate the sheet feeding apparatus to perform one cycle of the sheet feeding operation while the printing cylinder makes a 360 degree rotation.

5. The corrugated paperboard box making machine according to claim 4, the control apparatus is programmed to set a feeding control mode to one of a first feeding control mode in which one cycle of the sheet feeding operation is performed while the printing cylinder makes a 360 degree rotation, or a second feeding control mode in which two cycles of the sheet feeding operation are performed while the printing cylinder makes a 360 degree rotation, wherein the control apparatus is programmed to control the sheet feeding apparatus to stop the sheet feeding operation, while fulfilling the order, during a first break time equal to one operation cycle between two consecutive batches, when the feeding control mode is set to the first feeding control mode, and wherein the control apparatus is programmed to control the sheet feeding apparatus to (i) stop the sheet feeding operation, while fulfilling the order, during a second break time equal to two operation cycles between two consecutive batches, when the feeding control mode is set to the second feeding control mode, and the batch forming sheet number is an even number, and (ii) stop the sheet feeding operation, while fulfilling the order, during a third break time equal to only one operation cycle between two consecutive batches, when the feeding control mode is set to the second feeding control mode, and the batch forming sheet number is an odd number.

6. The corrugated paperboard box making machine according to claim 1, wherein the sheet feeding apparatus comprises:

a plurality of feeding rollers configured for rotation to feed a bottommost one of a plurality of stacked corrugated paperboard sheets;

a raisable-lowerable member configured for vertical movement to raise or lower a corrugated paperboard sheet passing on the raisable-lowerable member to bring the passing corrugated paperboard sheet off and on the plurality of feeding rollers, wherein the raisable-lowerable member is operable to move vertically according to a raising-lowering speed control pattern;

a roller drive motor configured to rotate the plurality of feeding rollers, individually;

a raising-lowering drive motor configured to operate the raisable-lowerable member to raise or lower the passing corrugated paperboard sheet; and a motion conversion mechanism configured to convert rotation of the raising-lowering drive motor into vertical movement of the raisable-lowerable member, wherein the control apparatus is programmed to vary a rotational speed of the raising-lowering drive motor according to the raising-lowering speed control pattern that varies the vertical movement of the raisable-lowerable member, and wherein the control apparatus is programmed to change the raising-lowering speed control pattern according to said one of the different sheet lengths specified by the order.

7. The corrugated paperboard box making machine according to claim 6, wherein the control apparatus is programmed to stop the roller driver motor to stop the sheet feeding operation.

8. The corrugated paperboard box making machine according to claim 1, wherein the processing apparatus comprises a printer configured to print a printing pattern on each of the corrugated paperboard sheets, the printer comprising a printing cylinder to which a printing die having the given printing pattern is attached, and an application mechanism configured to apply ink to the printing die, and wherein the control apparatus is programmed to control the application mechanism to prevent the ink from being applied to the printing die during at least a part of the break time.

9. A sheet feeding control apparatus for use in a corrugated paperboard box making machine, wherein the corrugated paperboard box making machine comprises:

a sheet feeding apparatus configured to repeatedly perform a sheet feeding operation that feeds one corrugated paperboard sheet at a time in synchronism with continuous regular operation cycles, each of which corresponds to a length of one sheet feeding operation, the corrugated paperboard sheet having one of different sheet lengths that is specified by an order;

a processing apparatus positioned downstream of the sheet feeding apparatus, the processing apparatus comprising a processing cylinder configured for rotation to process each of the corrugated paperboard sheets fed from the sheet feeding apparatus;

a folder-gluer positioned downstream of the processing apparatus and configured to fold and glue each of the processed corrugated paperboard sheets to form each of the processed corrugated paperboard sheets in a box structure;

a counter-ejector positioned downstream of the folder-gluer and configured to make a stack of the box-structured corrugated paperboard sheets, wherein the counter-ejector is configured to count a number of the box-structured corrugated paperboard sheets fed from the folder-gluey and eject the stack of the box-structured corrugated paperboard sheets as a batch when the count reaches a batch-forming sheet number; and a speed selector configured for an operator to set a sheet feeding speed at which the corrugated paperboard sheets are to be fed from the sheet feeding apparatus, wherein the speed selector is configured to allow the operator to set an over-limit sheet feeding speed that is greater than a maximum sheet feeding speed with which the counter-ejector can keep up to make a stack of the box-structured corrugated paperboard sheets and eject the batch of the box-structured corrugated paperboard sheets, wherein the sheet feeding control apparatus is programmed to control the sheet feeding apparatus and the processing apparatus to continuously produce batches of the box-structured corrugated paperboard sheets to fulfill the order in which an ordered number of the box-structured corrugated paperboard sheets is larger than the batch-forming sheet number, wherein the sheet feeding control apparatus is programmed to control the sheet feeding apparatus to stop the sheet feeding operation, while fulfilling the order, during a break time equal to at least one operation cycle between two consecutive batches, when the sheet feeding speed set by the speed selector is the over-limit sheet feeding speed, and the sheet feeding control apparatus is further programmed to control the processing apparatus to continuously process each of the corrugated paperboard sheets during the break time.

* * * * *